US008320797B2

(12) United States Patent
Inomata et al.

(10) Patent No.: US 8,320,797 B2
(45) Date of Patent: Nov. 27, 2012

(54) DEVELOPER STORING VESSEL AND IMAGE FORMING APPARATUS

(75) Inventors: Mitsugu Inomata, Saitama (JP); Naomasa Okimura, Saitama (JP); Atsuna Saiki, Saitama (JP); Kazuhiro Saito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 488 days.

(21) Appl. No.: 12/581,210

(22) Filed: Oct. 19, 2009

(65) Prior Publication Data

US 2010/0322666 A1 Dec. 23, 2010

(30) Foreign Application Priority Data

Jun. 23, 2009 (JP) ..... 2009-148282

(51) Int. Cl.
*G03G 15/08* (2006.01)

(52) U.S. Cl. ..... 399/120; 399/263

(58) Field of Classification Search ..... 399/120, 399/262, 263; 222/DIG. 1
See application file for complete search history.

(56) References Cited

U.S. PATENT DOCUMENTS 5,109,254 A * 4/1992 Oka et al. ..... 399/257
5,204,720 A * 4/1993 Ishida et al. ..... 399/256
5,307,128 A 4/1994 Murasaki et al.
5,329,340 A 7/1994 Fukuchi et al.
6,125,243 A 9/2000 Shoji et al.
6,212,340 B1 4/2001 Sugimoto et al.
7,024,138 B2 4/2006 Ikeda et al.
2002/0154914 A1 10/2002 Funayama et al.
2003/0118368 A1 6/2003 Saito et al.
2005/0281591 A1* 12/2005 Kitozaki et al. ..... 399/258
2006/0204272 A1* 9/2006 Ikeda et al. ..... 399/101
2006/0222413 A1* 10/2006 Nagae ..... 399/262
2008/0031658 A1 2/2008 Okamoto et al.
2008/0232858 A1 9/2008 Uematsu
2009/0148192 A1 6/2009 Hatakeyama et al.

(Continued)

FOREIGN PATENT DOCUMENTS

EP 0634705 A1 1/1995

(Continued)

OTHER PUBLICATIONS

Partial European Search Report issued in Application No. 09178199.7, dated Sep. 27, 2010.

(Continued)

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

A developer storing vessel includes a supplied developer storing portion including: a first supply storing portion which is stored a developer to be supplied to a developer unit; a second supply storing portion which is provided under the first supply storing portion and formed with a horizontal width narrower than that of the first supply storing portion; and a supply outlet from which the developer stored in the second supply storing portion flows out; and a recovered developer storing portion including: a recovery inlet which is disposed above the supply outlet in a direction of gravity, in a position displaced therefrom horizontally and within the horizontal width of the first supply storing portion, and from which recovered developer flows in, and a recovery storing portion which is provided under the recovery inlet and in which the developer flowing from the recovery inlet is stored.

17 Claims, 31 Drawing Sheets

U.S. PATENT DOCUMENTS

| | | | | |
|---|---|---|---|---|
| 2010/0054815 | A1* | 3/2010 | Okimura et al. | 399/254 |
| 2011/0262189 | A1* | 10/2011 | Saito | 399/258 |
| 2012/0076548 | A1* | 3/2012 | Ninomiya et al. | 399/262 |

FOREIGN PATENT DOCUMENTS

| | | | |
|---|---|---|---|
| EP | 0 652 493 | A2 | 5/1995 |
| JP | 5-088423 | A | 4/1993 |
| JP | 06-258987 | A | 9/1994 |
| JP | 7-28319 | A | 1/1995 |
| JP | 09-090752 | A | 4/1997 |
| JP | 9-269639 | A | 10/1997 |
| JP | 11-044990 | A | 2/1999 |
| JP | 2003-337521 | A | 11/2003 |
| JP | 2004-018138 | A | 1/2004 |
| JP | 2006-091385 | A | 4/2006 |
| JP | 2006-243446 | A | 9/2006 |
| JP | 2008-090106 | A | 4/2008 |
| JP | 2008-122825 | A | 5/2008 |
| JP | 2009-145610 | A | 7/2009 |
| KR | 10-2009-063065 | | 6/2009 |

OTHER PUBLICATIONS

Office Action issued by the Russian Patent Office dated Mar. 11, 2011 in a counterpart application No. 2009146973/28.

European Search Report, dated Jan. 12, 2011, issued in Application No. 09178199.7.

* cited by examiner

G1y
LHy
1b
1a
1
12
12c
G15
12a
12b
12e
11
G14
Gy
Z
X
Y
(-Y)
(-X)
(-Z)
Py
12F
41
41a
41b
41c
41d
42
42a
42b
42c
26a
26b
26c
26d
TCy

DEVELOPER STORING VESSEL AND IMAGE FORMING APPARATUS

CROSS-REFERENCE TO RELATED APPLICATION

This application is based on and claims priority under 35 USC 119 from Japanese Patent Application No. 2009-148282 filed on Jun. 23, 2009.

BACKGROUND

Technical Field

The present invention relates to a developer storing vessel and an image forming apparatus.

SUMMARY

According to an aspect of the invention, a developer storing vessel includes a supplied developer storing portion including: a first supply storing portion which is stored a developer to be supplied to a developer unit; a second supply storing portion which is provided under the first supply storing portion and formed with a horizontal width narrower than that of the first supply storing portion; and a supply outlet from which the developer stored in the second supply storing portion flows out; and a recovered developer storing portion including: a recovery inlet which is disposed above the supply outlet in a direction of gravity, in a position displaced therefrom horizontally and within the horizontal width of the first supply storing portion, and from which recovered developer flows in, and a recovery storing portion which is provided under the recovery inlet and in which the developer flowing from the recovery inlet is stored.

BRIEF DESCRIPTION OF THE DRAWINGS

Exemplary embodiments of the invention will be described in detail based on the following figures.

FIG. 31B is a main portion sectional view showing the recovery inlet portion in the state where the toner cartridge has been detached.

DETAILED DESCRIPTION

Figure 1:
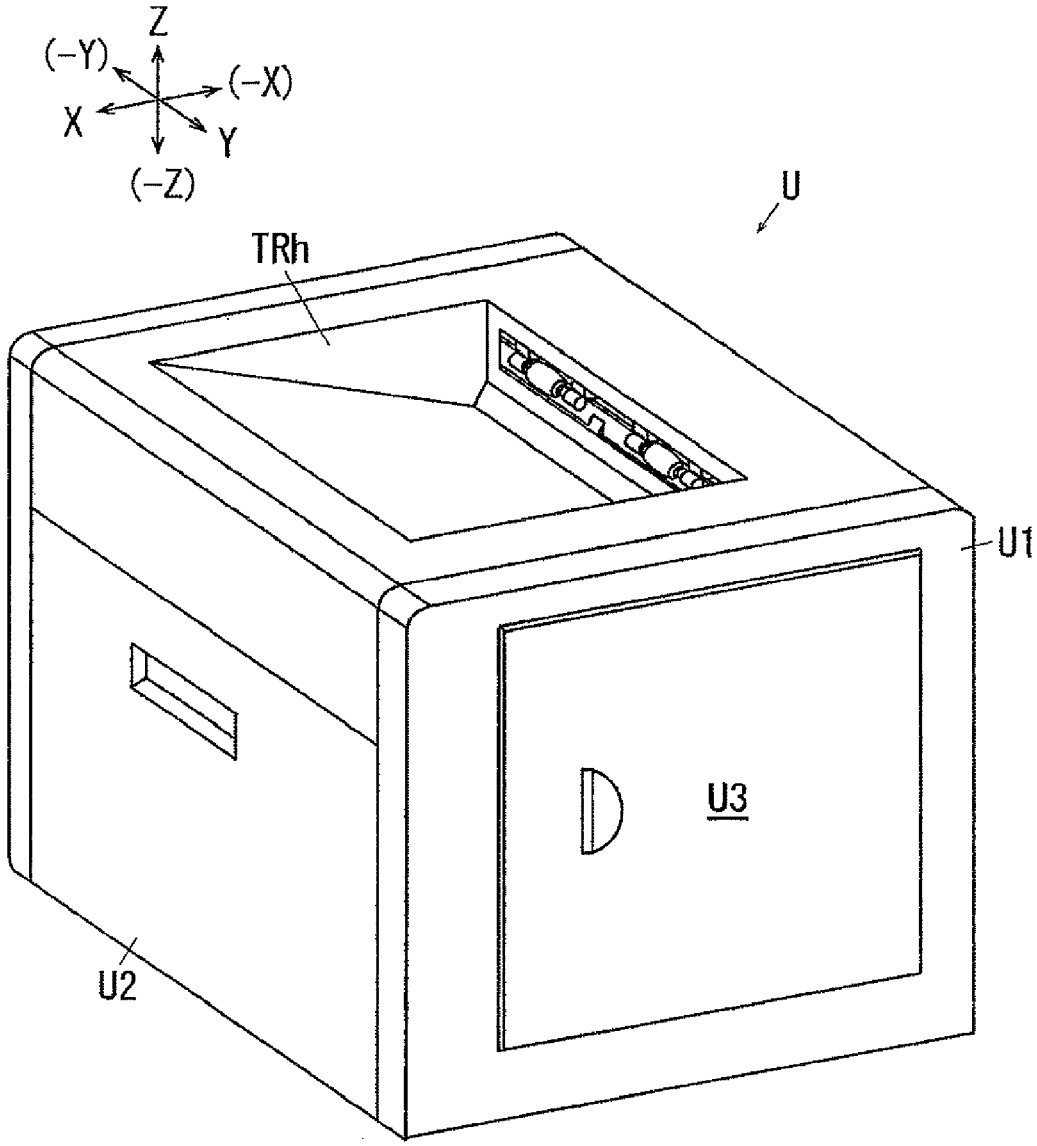
FIG. 1 is an overall perspective view of a printer according to a first exemplary embodiment of the invention.

Although specific examples of modes for carrying out the invention (hereinafter referred to as "exemplary embodiments") will be described below with reference to the drawings, the invention is not limited to the following exemplary embodiments.

In order to facilitate understanding of the following description, in the drawings, the front/rear direction is indicated as an X-axis direction, the left/right direction is indicated as a Y-axis direction and the up/down direction is indicated as a Z-axis direction, and directions or sides designated by the arrows X, −X, Y, −Y, Z and −Z are indicated as the front direction, the rear direction, the right direction, the left direction, the upper direction and the lower direction, or the front side, the rear side, the right side, the left side, the upper side and the lower side respectively.

In the drawings, each arrow with "·" written in "○" is an arrow directed from the back side of the sheet to the front side thereof and each arrow with "×" written in "○" is an arrow directed from the front side of the sheet to the back side thereof.

In the following description using the drawings, any other member than members required for description is omitted from the drawings suitably for the purpose of facilitating understanding.

First Exemplary Embodiment

FIG. 1 is an overall perspective view of a printer according to a first exemplary embodiment of the invention.

Figure 2:
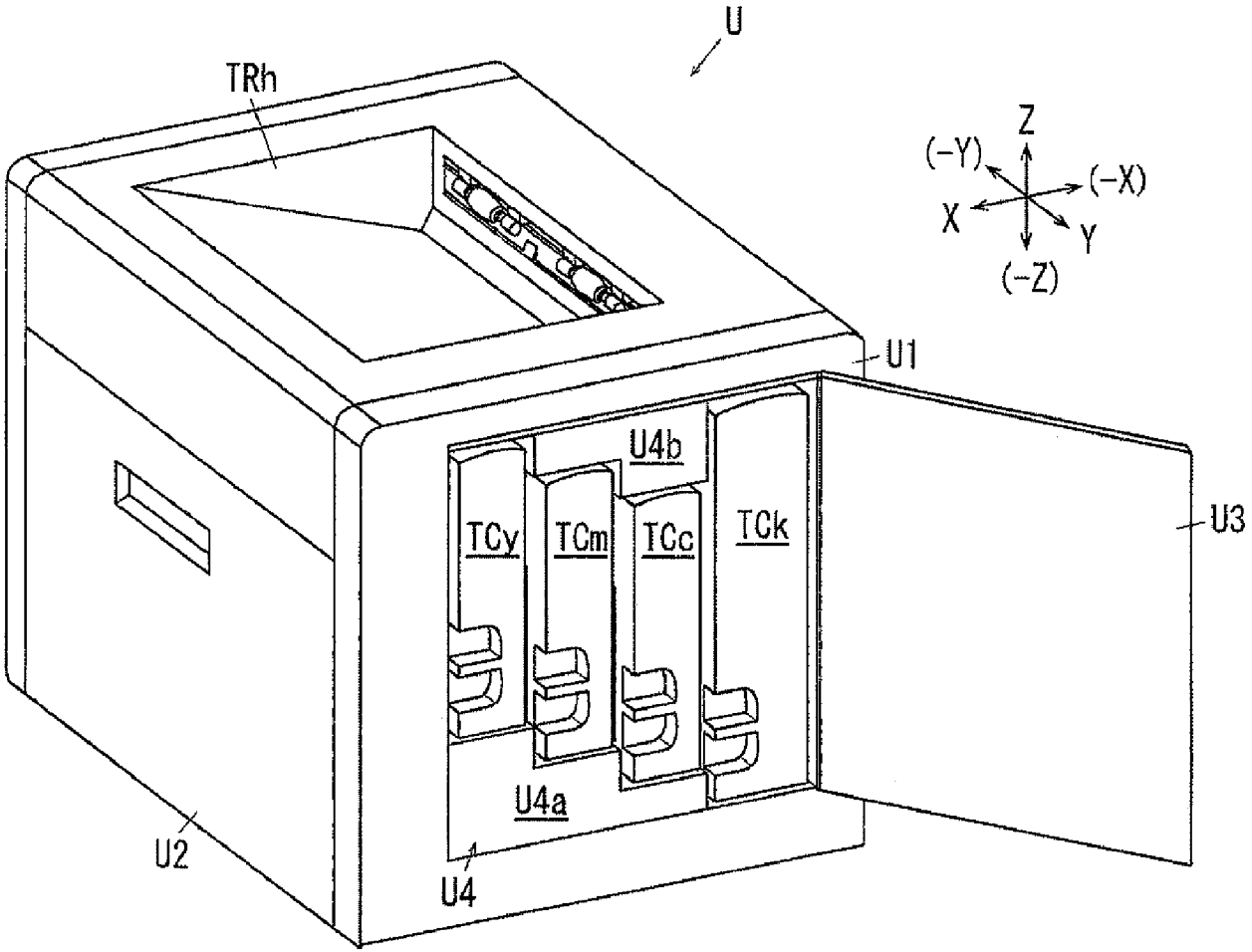
FIG. 2 is a view for explaining the printer according to the first exemplary embodiment of the invention, in which a side cover has been opened.

FIG. 2 is a view for explaining the printer according to the first exemplary embodiment of the invention, whose side cover has been opened.

In FIG. 1, a printer U as an image forming apparatus according to the first exemplary embodiment of the invention has an image forming apparatus body U1. A front cover U2 is supported on the front surface of the image forming apparatus body U1 so as to be openable around the lower end of the front cover U2. The front cover U2 is an example of an openable member which can be opened when a new sheet is supplied. A discharge tray TRh which is an example of a paper discharge portion is provided on the top of the image forming apparatus body U1.

Figure 3:
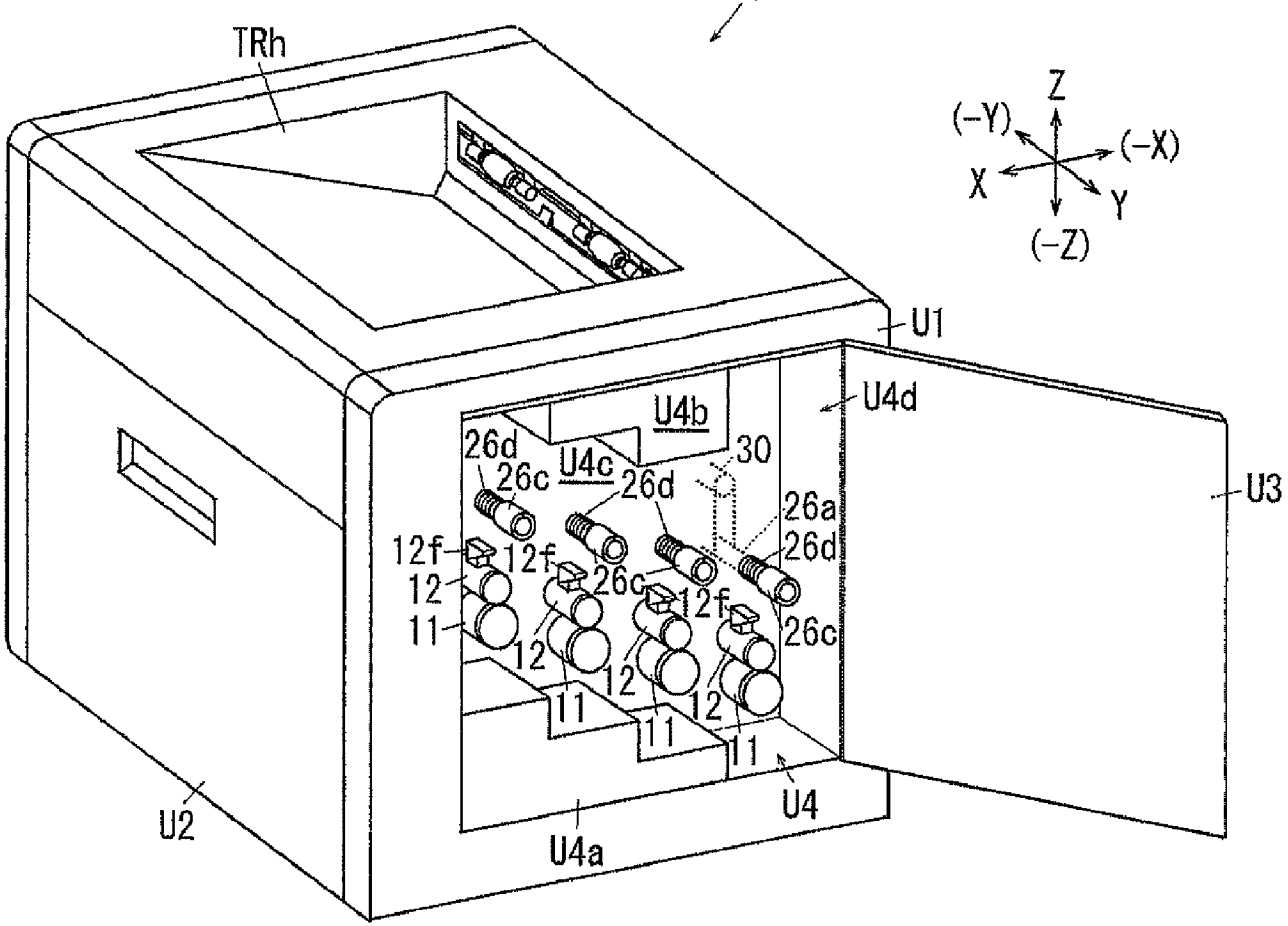
FIG. 3 is a view for explaining the state where toner cartridges have been removed from the printer according to the first exemplary embodiment.

FIG. 3 is a view for explaining the state where toner cartridges have been removed from the printer according to the first exemplary embodiment.

In FIGS. 1 and 2, a side cover U3 is supported on the right side face of the image forming apparatus body U1 so as to be openable around the rear end of the side cover U3. The side cover U3 is an example of an openable member for vessel replacement. The side cover U3 is opened and closed when toner cartridges are replaced.

In FIGS. 2 and 3, a cartridge attachment/detachment portion U4 as an example of a vessel attachment/detachment portion is formed in the image forming apparatus body U1 inside the side cover U3. Toner cartridges TCy to TCk as examples of developer recovering vessels are removably supported in the cartridge attachment/detachment portion U4.

Guide step portions U4*a* and U4*b* are formed in the lower and upper ends of the cartridge attachment/detachment portion U4. Each guide step portion U4*a*, U4*b* is formed like steps descending rearward. The lower guide step portion U4*a* is formed into three steps, and the upper guide step portion U4*b* is formed into two steps. An attachment/detachment space U4*d* to/from which the toner cartridges TCy to TCk will be attached/detached is formed by the space surrounded by the guide step portions U4*a* and U4*b*, a side wall U4*c* on the deeper side and the side cover U3. Thus, as shown in FIG. 2, the toner cartridges TCy to TCk of respective colors are stored in the attachment/detachment space U4*d* according to the first exemplary embodiment so as to be arranged from the front side in this order and displaced from one another like steps. In addition, the rearmost space where the black toner cartridge TCk should be stored is formed to be higher in the up/down direction and longer in the front/rear direction than the space where any other color toner cartridge TCy, TCm, TCc should be stored.

Figure 4:
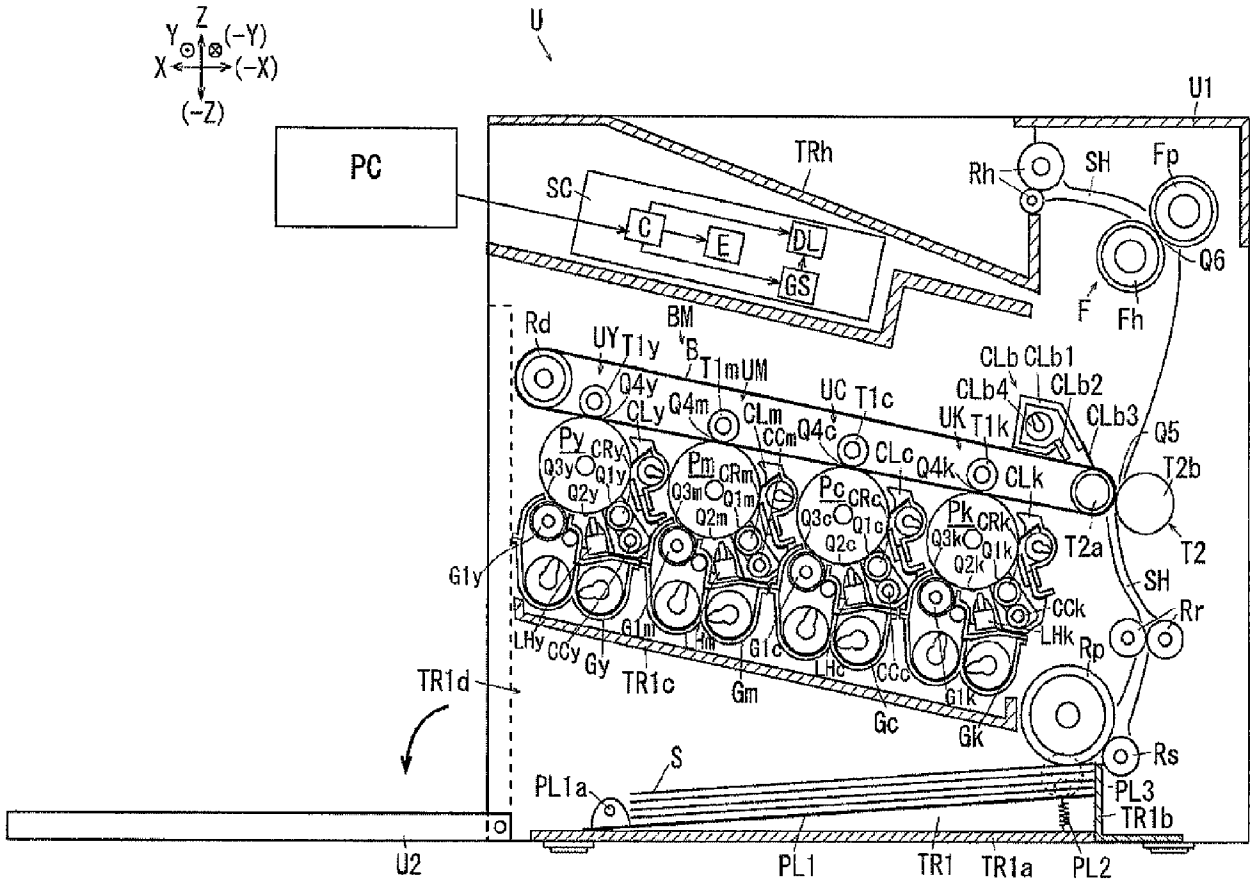
FIG. 4 is an overall view for explaining the image forming apparatus according to the first exemplary embodiment of the invention.

FIG. 4 is an overall view for explaining the image forming apparatus according to the first exemplary embodiment of the invention.

In FIGS. 1 and 4, the front cover U2 is supported movably between an open position shown by the solid line in FIG. 4 and a closed position shown in FIGS. 1 and 4. When the front cover U2 is in the open position, paper as an example of media can be inserted.

In FIG. 4, in the upper portion of the printer U, a control board SC where various control circuits, storage media, etc. have been arranged is disposed under the discharge tray TRh. The control board SC is provided with a control portion C, an image processing portion GS, a latent image forming unit drive circuit DL, a power supply circuit E, etc. The control portion C performs various controls on the printer U. The operations of the image processing portion C, the latent image forming unit drive circuit DL, the power supply circuit E, etc. are controlled by the control portion C. The power supply circuit E is an example of a power supply unit. The power supply circuit E applies voltages to each charging roller CRy to CRk as an example of a charger which will be described later, each developing roller G1*y* to G1*k* as a developer retainer, each transfer roller T1*y* to T1*k* as an example of a transfer unit, etc.

The image processing portion GS converts print information into image information for forming latent images corresponding to four color images of yellow, magenta, cyan and black, that is, Y, M, C and K. The print information is inputted from a personal computer PC or the like as an example of an external image information transmitting apparatus. The image processing portion GS outputs the image information to the latent image forming unit drive circuit DL at a predetermined timing.

When an original image is a unicolor image or a so-called monochrome image, image information of only black is inputted to the latent image forming unit drive circuit DL.

The latent image forming unit drive circuit DL has not-shown drive circuits of the respective colors Y, M, C and K to output signals corresponding to the input image information to LED heads LHy, LHm, LHc and LHk at given times respectively. Each LED head LHy, LHm, LHc, LHk is an example of a latent image forming unit disposed for each color.

In FIG. 4, visible image forming units UY, UM, UC and UK for forming toner images as examples of visible images of the respective colors, i.e. yellow, magenta, cyan and black, are disposed in the lower central portion of the image forming apparatus body U1. In FIG. 4, the visible image forming unit UK of black, that is, the color K has a photoconductor Pk which is an example of a rotary image retainer. A charging roll CRk which is an example of a charger for charging the surface of the photoconductor Pk, the LED head LHk which is an example of a latent image forming unit for forming an electrostatic latent image on the photoconductor surface, a developing unit Gk for developing the electrostatic latent image on the photoconductor surface into a visible image, a photoconductor cleaner CLk which is an example of an image retainer cleaner for removing developer staying on the surface of the photoconductor Pk, etc. are disposed around the photoconductor Pk.

The surfaces of photoconductors Py to Pk are charged uniformly in charging areas Q1*y*, Q1*m*, Q1*c* and Q1*k* opposed to charging rolls CRy to CRk by the charging rolls CRy to CRk respectively. Then, latent images are written on the surfaces by the LED heads LHy to LHk in latent image forming areas Q2*y*, Q2*m*, Q2*c* and Q2*k* respectively. The written electrostatic latent images are developed into toner images in developing areas Q3*y*, Q3*m*, Q3*c* and Q3*k* opposed to the developing units Gy to Gk respectively. The developed toner images are transported to primary transfer areas Q4*y*, Q4*m*, Q4*c* and Q4*k* contacting with an intermediate transfer belt B which is an example of an intermediate transfer body. In the primary transfer areas Q4*y*, Q4*m*, Q4*c*, Q4*k*, primary transfer voltages whose polarities are reverse to the charged polarity of the toner images are applied to primary transfer rolls T1*y*, T1*m*, T1*c* and T1*k* at given times respectively by the power supply circuit E controlled by the control portion C. Each primary transfer roll T1*y*, T1*m*, T1*c*, T1*k* is an example of a primary transfer unit disposed on the back surface side of the intermediate transfer belt B.

The toner images on the photoconductors Py to Pk are primarily transferred onto the intermediate transfer belt B by the primary transfer rolls T1*y*, T1*m*, T1*c* and T1*k* respectively.

Residual or attached materials such as untransferred toners or corona products on the surfaces of the photoconductors Py, Pm, Pc and Pk after the primary transfer are cleaned up by photoconductor cleaners CLy, CLm, CLc and CLk respectively. The cleaned surfaces of the photoconductors Py, Pm, Pc and Pk are charged again by the charging rollers CRy, CRm, CRc and CRk respectively. Residual materials etc. that cannot be removed by the photoconductor cleaners CLy to CLk but adhere to the charging rollers CRy, CRm, CRc and CRk are cleaned up by charger cleaners CCy, CCm, CCc and CCk disposed in contact with the charging rollers CRy to CRk, respectively. Each charger cleaner CCy, CCm, CCc, CCk is an example of a charger cleaning member.

In FIGS. 2 and 4, a belt module BM which is an example of an intermediate transfer unit is disposed above the photoconductors Py to Pk. The belt module BM includes the intermediate transfer belt B which is an example of an object to be transferred and an example of an intermediate transfer body. The intermediate transfer belt B is supported rotatably by an intermediate transfer support system which is constituted by a belt driving roll Rd as an example of a driving member, a backup roll T2*a* as an example of a driven member and an example of a secondary transfer opposed member, and the primary transfer rolls T1*y*, T1*m*, T1*c* and T1*k* disposed in opposition to the photoconductors Py to Pk respectively.

A belt cleaner CLb as an example of an intermediate transfer body cleaner is disposed above the rear portion of the intermediate transfer belt B. The belt cleaner CLb has a cleaning vessel CLb1, a belt cleaning blade CLb2, a film CLb3 and a residual material transport member CLb4. The belt cleaning blade CLb2 is an example of a cleaning member, which is supported on the cleaning vessel CLb1 and brought into contact with the intermediate transfer belt B to remove and clean residual materials staying on the surface of the intermediate transfer belt B. The film CLb3 is an example of a leakage prevention member, which prevents the residual materials removed by the belt cleaning blade CLb2 from flying out and leaking out. The residual material transport member CLb4 is disposed in the cleaning vessel CLb1 to transport and discharge the removed residual materials. The cleaning vessel CLb1 according to the first exemplary embodiment is disposed above the black photoconductor cleaner CLk and in a position corresponding thereto.

A secondary transfer roll T2*b* which is an example of a secondary transfer member is disposed in opposition to the surface of the intermediate transfer belt B which is in contact with the backup roll T2*a*. A secondary transfer unit T2 according to the first exemplary embodiment is constituted by the backup roll T2*a* and the secondary transfer roll T2*b*. A secondary transfer area Q5 is formed by the area where the secondary transfer roll T2*b* and the intermediate transfer belt B are opposed to each other.

Unicolor or multi-color toner images transferred to be overlapped one another in turn on the intermediate transfer belt B in the primary transfer areas Q4*y*, Q4*m*, Q4*e* and Q4*k* by the primary transfer rolls T1*y*, T1*m*, T1*c* and T1*k* respectively are transported to the secondary transfer area Q5.

A transfer unit T1*y*–T1*k*+T2+B according to the first exemplary embodiment is constituted by the first transfer rolls T1*y* to T1*k*, the intermediate transfer belt B, and the secondary transfer unit T2.

As shown in FIG. 4, the intermediate transfer belt B according to the first exemplary embodiment is disposed so that the primary transfer areas Q1*y* to Q1*k* descend rearward with respect to the horizontal plane. Correspondingly thereto, the visible image forming units UY to UK are also disposed so that one on the downstream side in the belt rotation direction is displaced downward in the direction of gravity from another on the upstream side.

Under the visible image forming units UY to UK, a paper feed tray TR1 is provided as an example of a paper storage portion. The paper feed tray TR1 has a bottom wall TR1*a*, a rear end wall TR1*b* and an upper wall TR1*c*. The bottom wall TR1*a* is an example of a lower wall. The rear end wall TR1*b* extends upward from the rear end of the bottom wall TR1*a*. The upper wall TR1*c* is disposed above the bottom wall TR1*a* and in opposition thereto. In the front end portion of the paper feed tray TR1, a supply port TR1*d* is formed for supplying new recording sheets S. The front end portion of the upper wall TR1*c* is formed to ascend frontally toward the outside of the supply port TR1*d*. Accordingly, the distance between the upper wall TR1*c* and the bottom wall TR1*a* becomes larger in a direction going toward the front side. Thus, the supply port TR1*d* is formed to be wider in a direction going toward the front side.

A lifting plate PL1 as an example of a media loading portion is disposed on the bottom wall TR1*a*. The lifting plate PL1 is supported rotatably around a rotation center PL1*a* and loaded with the recording sheets S as an example of media so as to lift the recording sheets S. A lifting spring PL2 as an example of an urging member for urging the rear end portion of the lifting plate PL1 upward is disposed on the rear end portion of the lifting plate PL1. When image formation is not performed, the lifting plate PL1 moves to a descending position where the lifting plate PL1 is kept in parallel with the bottom wall TR1*a* by depressing members PL3 like eccentric cams. The depressing members PL3 are disposed in the opposite left and right end portions of the lifting plate PL1. During image formation, the depressing members PL3 are rotated so that the lifting plate PL1 is supported movably between the descending position and an ascending position where the lifting plate PL1 has been lifted by the lifting spring PL2 as shown in FIG. 4.

When the front cover U2 is opened, the supply port TR1*d* is opened to the outside. Thus, a new sheaf of recording sheets S can be inserted to abut against the rear end wall TR1*b* so as to be loaded and stored on the lifting plate PL1 in the descending position.

A paper feed roll Rp as an example of a feeding-out member is disposed at the rear of the upper wall TR1*c*. The paper feed roll Rp is disposed in a position where the uppermost recording sheet S of the loaded recording sheets S can be pushed against the paper feed roll Rp by the spring force of the lifting spring PL2 in the state where the lifting plate PL1 has moved to the ascending position.

The recording sheets S loaded on the paper feed tray TR1 are fed out by the paper feed roll Rp, and separated one by one in the area where a retard roll Rs and the paper feed roll Rp are in contact with each other. Each separated recording sheet S is transported to a sheet transport path SH. The recording sheet S in the sheet transport path SH is transported to registration rolls Rr which are examples of paper feed timing adjustment members. The recording sheet S transported to the registration rolls Rr is fed out to the secondary transfer area Q5 in sync with the timing when the toner images on the intermediate transfer belt B reaches the secondary transfer area Q5.

From the intermediate transfer belt B where the toner images have been transferred in the secondary transfer area Q5, residual materials such as untransferred toners or corona products staying on the surface of the intermediate transfer belt B are removed and cleaned by the belt cleaner CLb.

The recording sheet S to which the toner images have been transferred is transported to a fixing area Q6 of a fixing unit F. The fixing unit F has a heating roll Fh as an example of a heating fixing member and a pressure roll Fp as an example of a pressure fixing member. The fixing area Q6 consists of an area where the heating roll Fh and the pressure roll Fp are in contact with each other with a predetermined pressure. The unfixed toner images on the surface of the recording sheet S are fixed by heat and pressure when the toner images pass through the fixing area Q6.

The recording sheet S where the images have been fixed is transported in the paper transport path SH, and exited to the output tray TRh through paper exit rolls R1 which are examples of paper exit members.

(Description of Visible Image Forming Unit)

Figure 5:
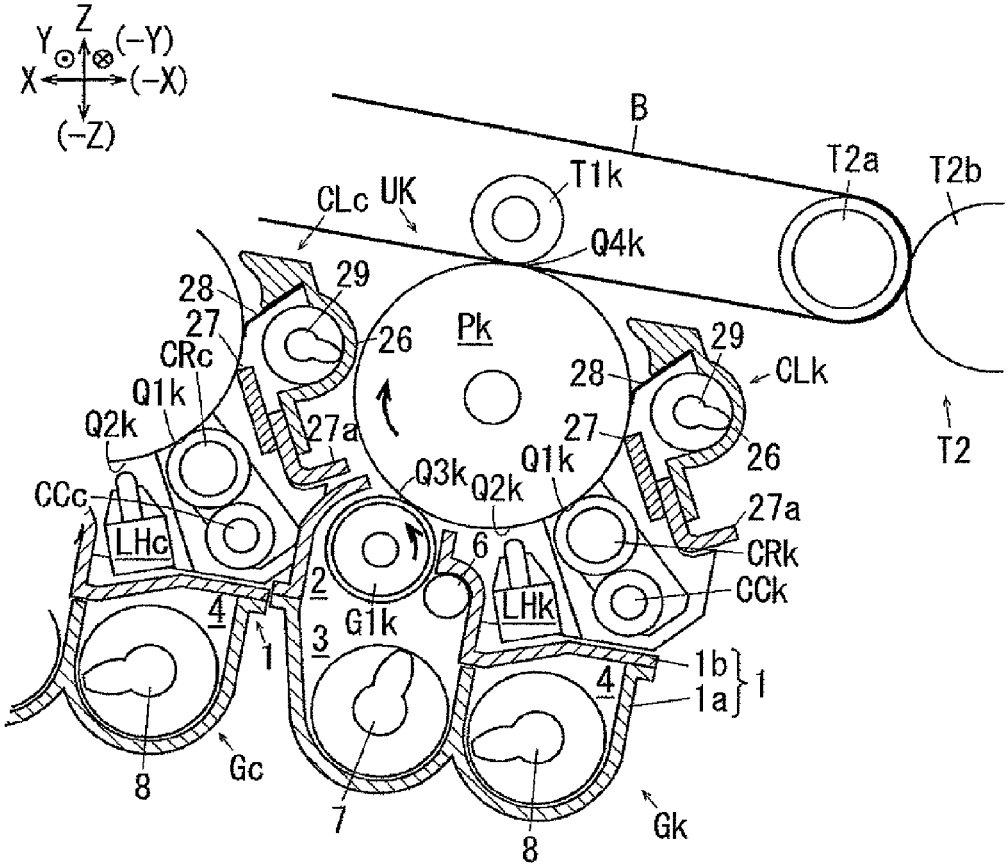
FIG. 5 is a main portion enlarged explanatory view of a visible image forming unit according to the first exemplary embodiment of the invention.

FIG. 5 is a main portion enlarged explanatory view of a visible image forming unit according to the first exemplary embodiment of the invention.

Figure 6:
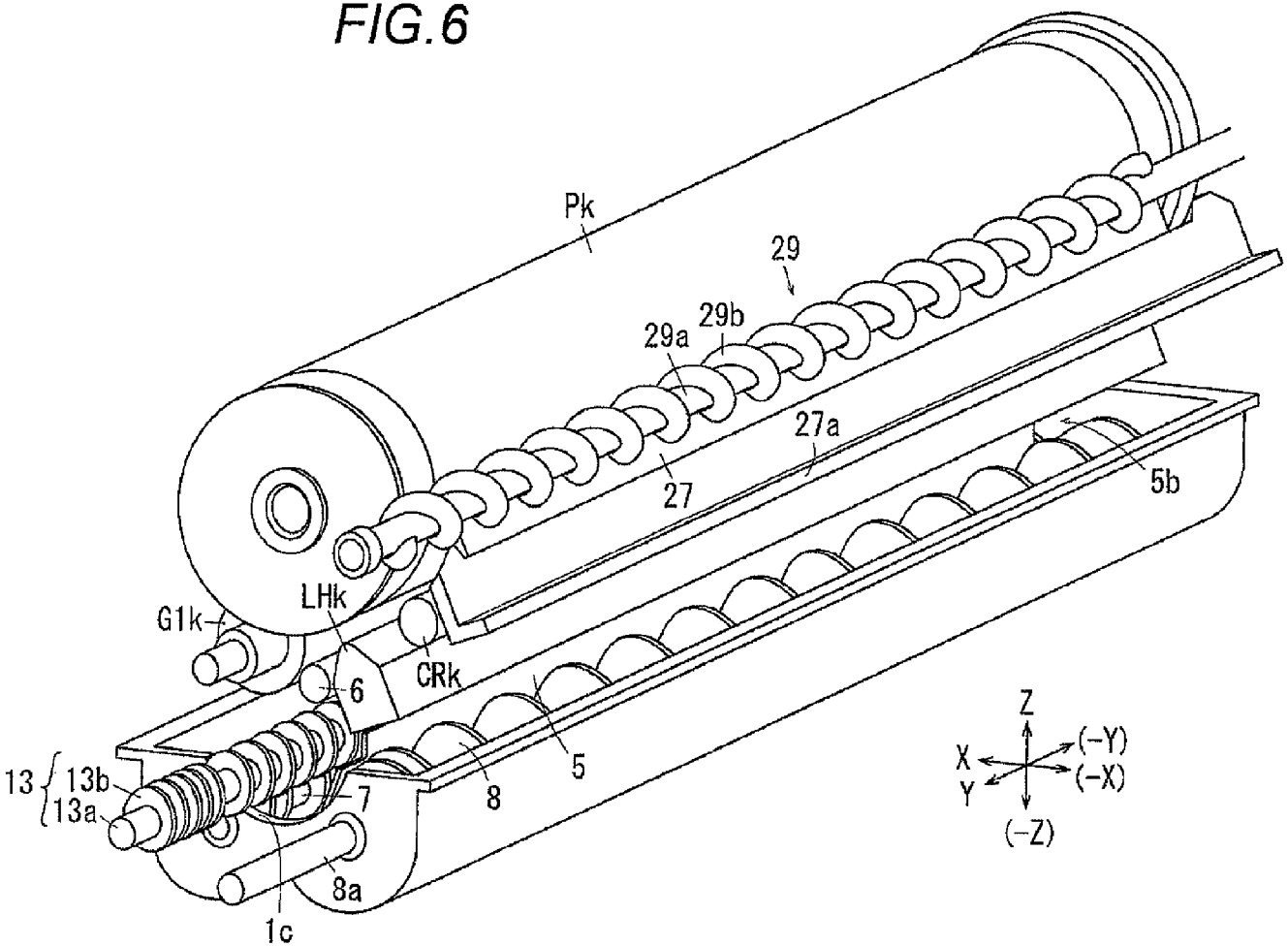
FIG. 6 is a main portion perspective view of the visible image forming unit according to the first exemplary embodiment.

FIG. 6 is a main portion perspective view of the visible image forming unit according to the first exemplary embodiment.

Figure 7:
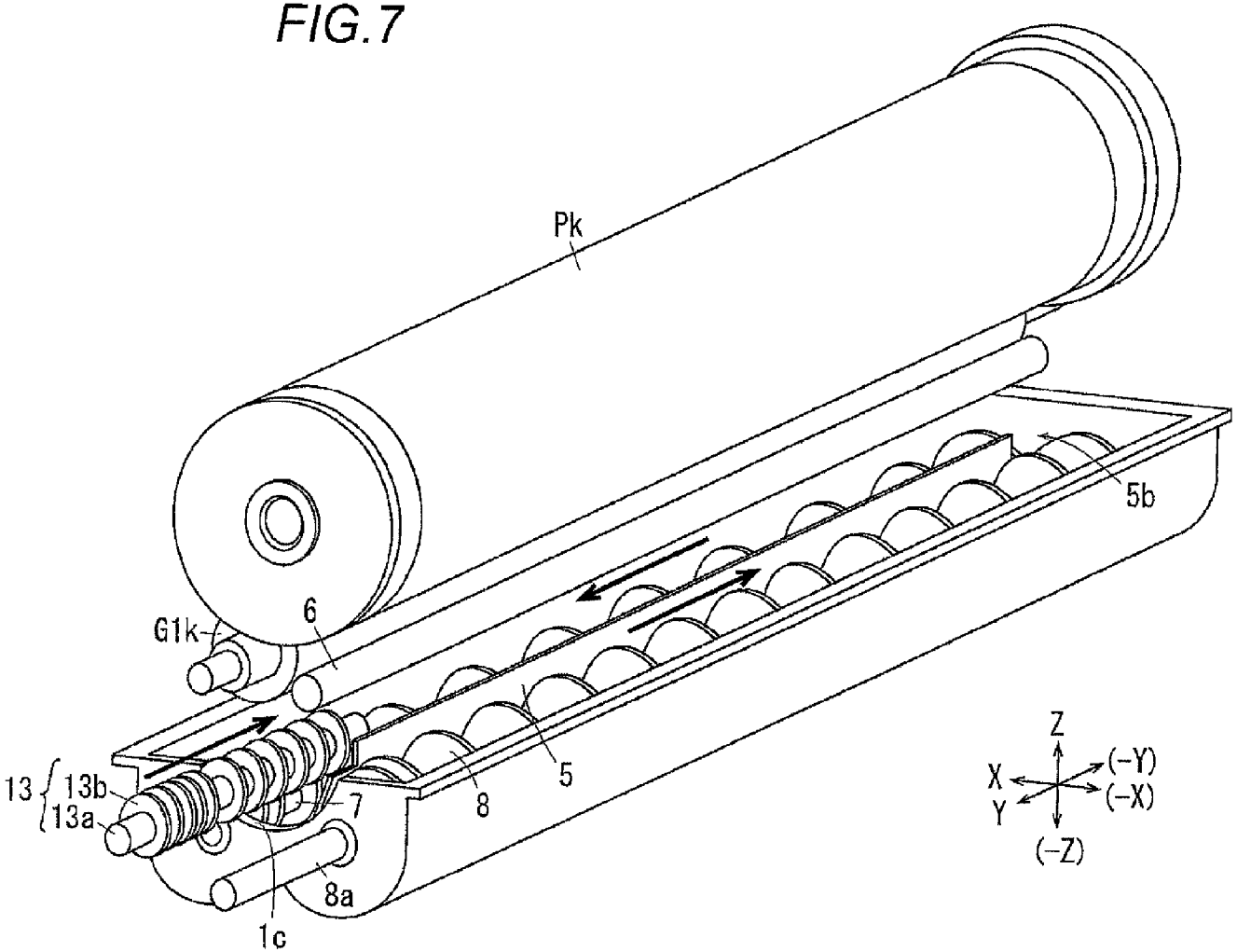
FIG. 7 is a main portion perspective view of an image retainer and a developing unit according to the first exemplary embodiment.

FIG. 7 is a main portion perspective view of an image retainer and a developing unit according to the first exemplary embodiment.

Figure 8:
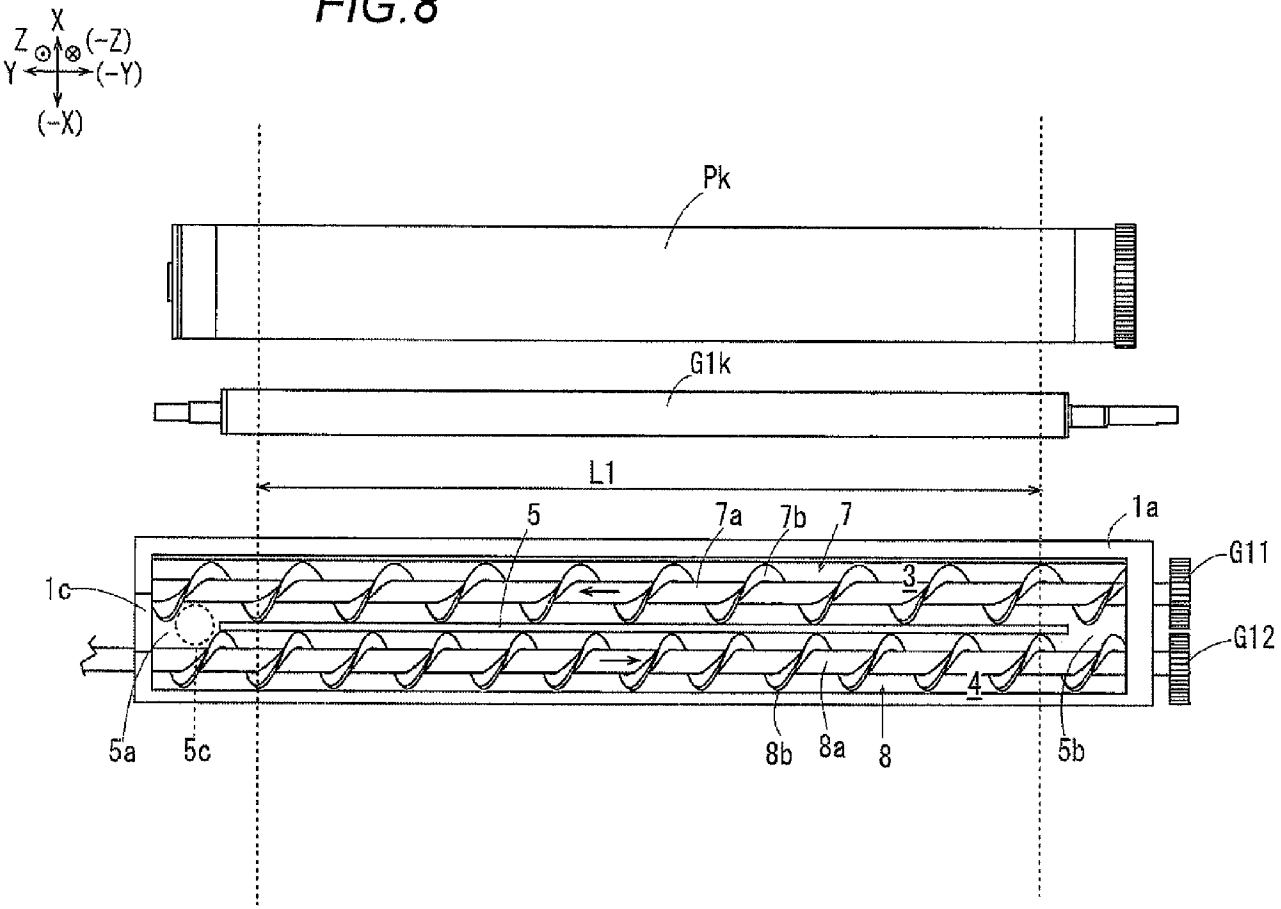
FIG. 8 is a view for explaining the longitudinal relationship among the image retainer, a developer retainer and a developing vessel.

FIG. 8 is a view for explaining the longitudinal relationship among the image retainer, a developer retainer and a developing vessel.

The visible image forming units UY to UK will be described below in detail. The visible image forming units UY to UK of the respective colors are constituted in the same manner. Therefore, only the black visible image forming unit UK will be described, but description about the other visible image forming units UY, UM and UC will be omitted.

(Description of Developing Unit)

In FIGS. 5 to 8, in the visible image forming unit UK according to the first exemplary embodiment, the developing unit Gk is disposed under the photoconductor Pk. In FIGS. 5 to 8, the developing unit Gk according to the first exemplary embodiments has a developing vessel 1 for internally storing developer. The developing vessel 1 has a lower vessel body 1*a* and a cover member 1*b* for covering the top of the vessel body 1*a*. In addition, a supply path connection portion 1*c* consisting of a semicircular recess portion is formed in the right end of the vessel body 1*a*.

A developing roll chamber 2, a first agitation chamber 3 and a second agitation chamber 4 are provided inside the developing vessel 1. The developing roller G1*k* is stored in the developing roll chamber 2. The first agitation chamber 3 is formed under the developing roll chamber 2 so as to be adjacent to and continuous with the developing roll chamber 2. The second agitation chamber 4 is formed at the rear of the first agitation chamber 3 so as to be adjacent to the first agitation chamber 3.

The first agitation chamber 3 and the second agitation chamber 4 are partitioned by a partition 5 which is an example of a partition member extending in the left/right direction. In addition, inlet portions 5*a* and 5*b* are formed in the opposite left and right end portions of the partition 5 so that developer can flow between the first agitation chamber 3 and the second agitation chamber 4. According to the first exemplary embodiment, new developer is supplied to a supplied developer inlet position 5*c* set in the right inlet portion 5*a* so that the developer newly supplied and agitated insufficiently can be restrained from being supplied to the developing roller G1*k*. In FIG. 8, according to the first exemplary embodiment, the inlet portions 5*a* and 5*b* are formed correspondingly to positions outside an image forming area L1 where an image will be formed on the photoconductor Pk. Thus, developer supplied newly or developer staying in each inlet portion 5*a*, 5*b* is restrained from having an adverse effect on image formation. The image forming area L1 is an example of a retaining area where an image will be retained by the image retainer.

In FIGS. 5 to 8, the rotation direction of the developing roller G1*k* according to the first exemplary embodiment is reverse to that of the photoconductor Pk. That is, the developing roller G1*k* rotates counterclockwise in a reverse direction to that of the photoconductor Pk which rotates clockwise. Accordingly, in the developing area Q3*k*, the surface of the photoconductor Pk rotates in the same direction as the surface of the developing roller G1*k*.

A rod-like layer thickness limiting member 6 for limiting the layer thickness of a developer layer retained on the surface of the developing roller G1*k* is supported in the developing roller chamber 2 and disposed on the upstream side of the rotation direction of the developing roller G1*k* with respect to the developing area Q3*k* and in opposition to the developing roller G1*k*.

A supply auger 7 as an example of a first agitation member extending in the left/right direction is rotatably supported in the first agitation chamber 3. An admix auger 8 as an example of a second agitation member extending in the left/right direction and in parallel with the supply auger 7 is rotatably supported in the second agitation chamber 4. The supply auger 7 and the admix auger 8 have rotary shafts 7*a* and 8*a* and spiral agitation blades 7*b* and 8*b* respectively. The agitation blades 7*b* and 8*b* are supported on the outer circumferences of the rotary shafts 7*a* and 8*a* respectively.

Gears G11 and G12 as examples of gears engaging with each other are supported on the left ends of the rotary shafts 7*a* and 8*a* respectively. When a driving force is transmitted to the gears G11 and G12 from a not-shown developing drive source, the augers 7 and 8 are driven to rotate and transport developer in opposite directions to each other as shown by the arrows in FIG. 8. Thus, due to the rotations of the augers 7 and 8, the developer agitated and transported to the downstream end of one agitation chamber 3, 4 is transported to flow into the upstream end of the other agitation chamber 4, 3 through the inlet portion 5*a*, 5*b*. As a result, the developer in the developing vessel 1 circulates through a circulating chamber 3+4 while the developer in the first agitation chamber 3 is supplied to the developing roller G1*k* and used for development.

Figures 9A, 9B, 9C:
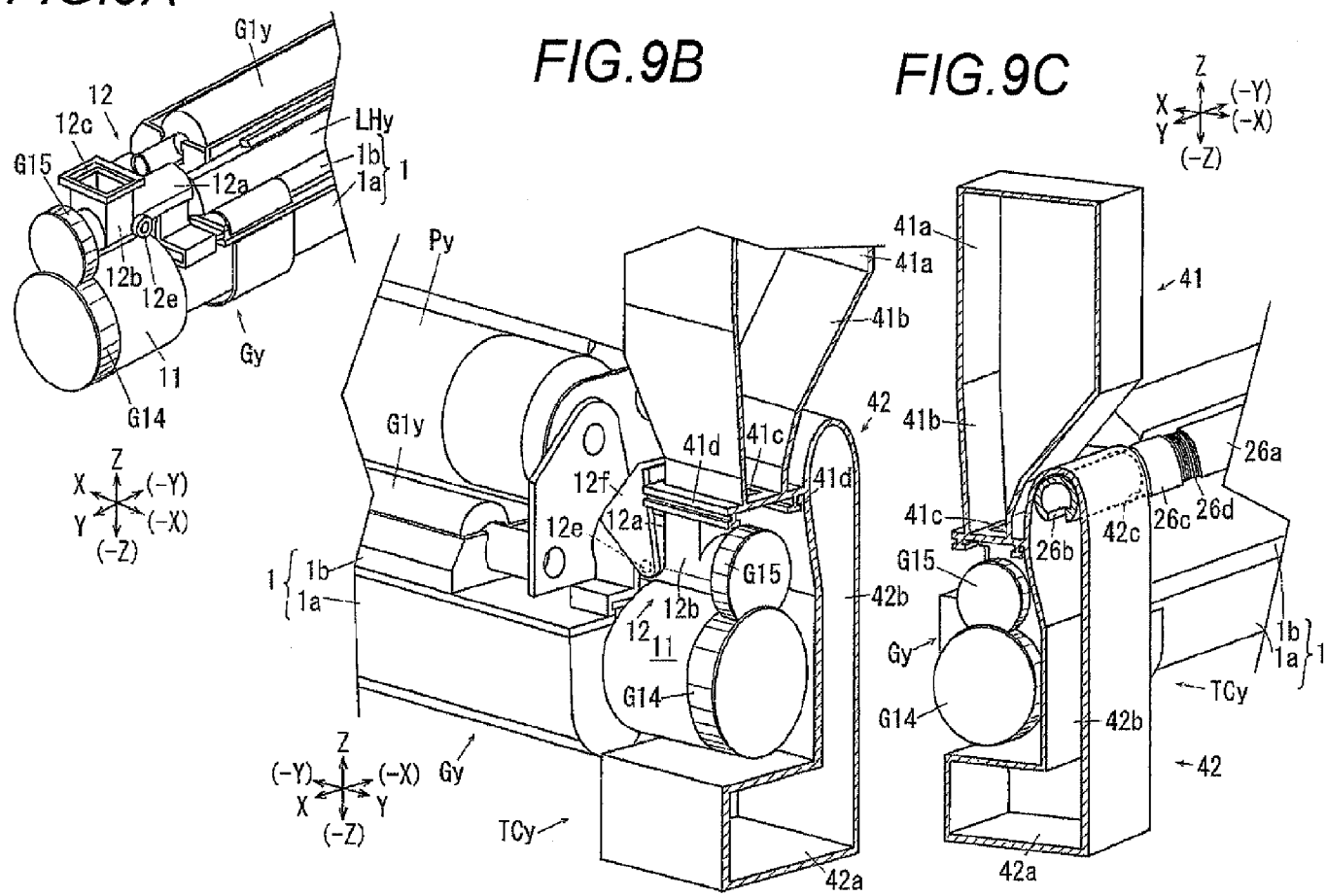
FIGS. 9A-9C are views for explaining the visible image forming unit and a replaceable vessel according to the first exemplary embodiment, FIG. 9A being a view for explaining a supply port portion of the visible image forming unit, FIG. 9B being a cutaway perspective view of a main portion for explaining the positional relationship between the visible image forming unit and the replaceable vessel, FIG. 9C being an explanatory view for explaining the relationship between a residual developer transport path and the replaceable vessel.

FIGS. 9A-9C are views for explaining a visible image forming unit and a replaceable vessel according to the first exemplary embodiment. FIG. 9A is a view for explaining a supply port portion of the visible image forming unit. FIG. 9B is a cutaway perspective view of a main portion for explaining the positional relationship between the visible image forming unit and the replaceable vessel. FIG. 9C is an explanatory view for explaining the relationship between a residual developer transport path and the replaceable vessel.

In FIGS. 2 and 9A-9C, a clutch 11 as an example of a drive transmission switching unit is supported on the right end portion of the rotary shaft 8*a* of the admix auger 8, and a supply drive gear G14 as an example of a supply drive transmission gear is provided on the right end portion of the clutch 11.

In FIGS. 2, 6-8 and 9A-9C, a supply path forming member 12 is supported on the right end portion of the developing vessel 1. The supply path forming member 12 has a supply cylinder portion 12*a* extending left from the cartridge attachment/detachment portion U4 toward the inside developing unit Gk. A not-shown supplied developer transport path where new developer to be supplied to the developing unit Gk should be transported is formed inside the supply cylinder portion 12*a*. An inlet portion 12*b* extending upward is formed in the right end portion of the supply cylinder portion 12*a*. A supplied developer inlet 12*e* is formed in the upper end portion of the inlet portion 12*b*. The supply path inside the supply cylinder portion 12*a* extends above the right inlet portion 5*a* to drop and supply the new developer down to a supplied developer inlet position 5*c*. An inlet shutter 12*f* as an example of an inlet closing member is supported in the lower end portion of the inlet portion 12*b* so as to be rotatable around a rotation center 12*e*. The inlet shutter 12*f* is supported movably between an opening position to open the supplied developer inlet 12*c* as shown in FIG. 9B and a closing position to close the supplied developer inlet 12*c* as shown in FIG. 3. In addition, the inlet shutter 12*f* is urged by a not-shown spring as an example of an urging member, so as to be moved and retained in the closed position shown in FIG. 3.

In FIGS. 6 and 7, a supply auger 13 as an example of a supplied developer transport member extending in the left/right direction is rotatably supported on the supply cylinder portion 12*a*. The supply auger 13 has a rotary shaft 13*a* and an agitation blade 13*b* formed on the outer circumference of the rotary shaft, in the same manner as the augers 7 and 8. In FIGS. 2 and 9A-9C, a supply driver gear G15 engaging with the supply drive gear G14 is supported on the right end of the rotary shaft 13*a* of the supply auger 13. Thus, when the clutch 11 switches between connection and disconnection, the rotation of the admix auger 8 driven during the operation of image formation is switched between transmission and nontransmission to the supply auger 13 through the supply gears G14 and G15, so that the supply auger 13 rotates or stops rotating. Thus, the amount of supply of the developer and the timing of supplying the developer supplied by the supply auger 13 is controlled. A drive transmission system for controlling transmission and nontransmission of a driving force to the supply auger 13 is constituted by the clutch 11, the supply gears G14 and G15, etc.

(Description of Photoconductor Cleaner)

In FIGS. 5-8, in the visible image forming unit UK according to the first exemplary embodiment, the photoconductor cleaner CLk is disposed at the rear of the photoconductor Pk. The photoconductor cleaner CLk according to the first exemplary embodiment has a cleaner vessel 26 as an example of a cleaning vessel body, a cleaning blade 27 as an example of a cleaning member and a leakage prevention film 28 as an example of a leakage prevention member. The base end portion of the cleaning blade 27 is supported on the cleaner vessel 26 through a blade support member 27*a*, and the front end portion of the cleaning blade 27 is disposed in contact with the photoconductor Pk. The leakage prevention film 28 is supported in the cleaner vessel 26 and brought into contact with the photoconductor Pk on the upstream side of the cleaning blade 27 in the rotation direction of the photoconductor Pk so as to prevent developer from leaking out.

In FIG. 9C, a residual developer transport path 26*a* extending from the inside photoconductor cleaner CLk toward the outside cartridge attachment/detachment portion U4 is coupled with the cleaner vessel 26. A residual developer outlet 26*b* from which residual developer transported through the residual developer transport path 26*a* should flow out is formed in the right end portion which is the downstream end portion of the residual developer transport path 26*a*. The residual developer transport path 26*a* according to the first exemplary embodiment is disposed in a position obliquely upward displaced from the supplied developer transport path, adjacently thereto and in parallel therewith.

In FIGS. 3 and 9C, a cylindrical waste outlet shutter 26*c* as an example of an outlet closing member is supported in the right end portion of the residual developer transport path 26*a* so as to be movable in the left/right direction. The waste outlet shutter 26*c* is supported so as to be movable between an outlet closing position to close the residual developer outlet 26*b* as shown in FIG. 3 and an outlet opening position to open the residual developer outlet 26*b* as shown in FIG. 9C. A spring 26*d* as an example of an urging member is attached to the left of the waste outlet shutter 26*c* so as to urge the waste outlet shutter 26*c* to move and hold the waste outlet shutter 26*c* in the outlet closing position.

In FIGS. 5 and 6, a waste auger 29 as an example of a developer waste member for transporting the developer recovered by the cleaning blade 27 toward the residual developer outlet 26*b* is supported rotatably in the cleaner vessel 26 and the residual developer transport path 26*a*. The waste auger 29 has a rotary shaft 29*a* and a spiral agitation blade 29*b* supported on the outer circumference of the rotary shaft 29*a*, in the same manner as the augers 7, 8 and 13.

In FIG. 3, the residual developer transport path 30 extending from the belt cleaner CLb extends downward inside the side wall U4*c* of the cartridge attachment/detachment portion U4, that is, on the left side thereof, so as to be connected to the black residual developer transport path 26*a*. Accordingly, the developer recovered by the belt cleaner CLb is transported through the residual developer transport path 30 by the residual material transport member CLb4, merged with the black residual developer transport path 26*a*, and transported downstream by the black waste auger 29.

(Description of Toner Cartridge)

Figure 10A:
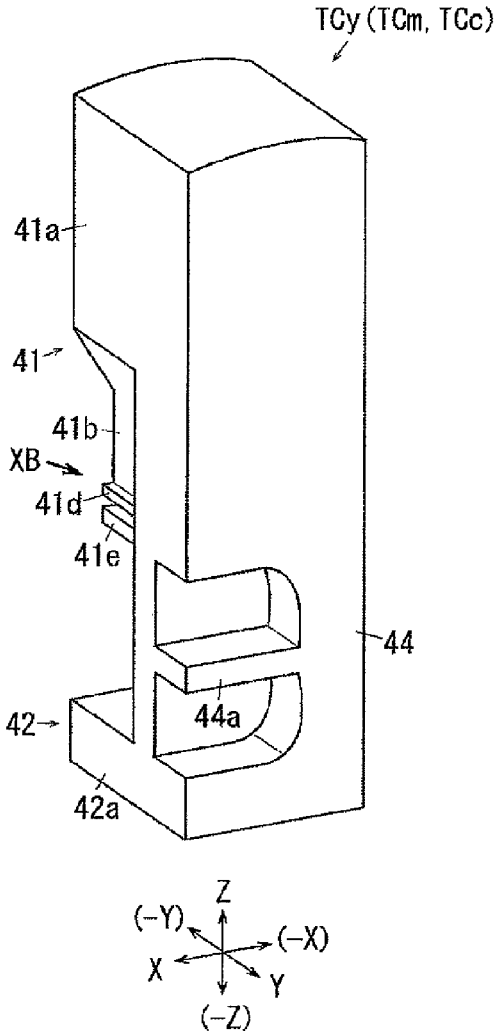
FIGS. 10A-10B are views for explaining each toner cartridge according to the first exemplary embodiment, FIG. 10A being a perspective view where the toner cartridge is viewed obliquely from its front, FIG. 10B being a perspective view where the toner cartridge is viewed from the arrow XB direction in FIG. 10A.
Figure 10B:
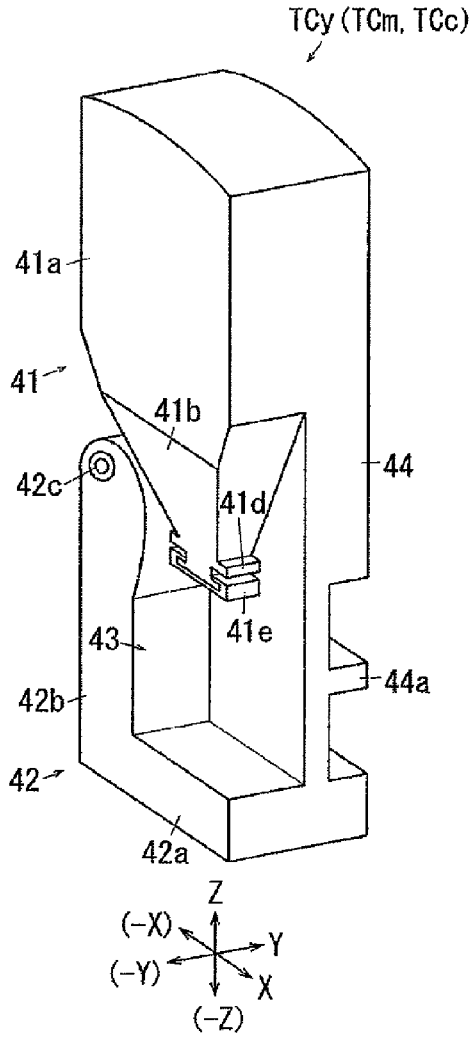

FIGS. 10A and 10B are views for explaining each toner cartridge according to the first exemplary embodiment. FIG. 10A is a perspective view where the toner cartridge is viewed obliquely from its front. FIG. 10B is a perspective view where the toner cartridge is viewed from the arrow XB direction in FIG. 10A.

In FIGS. 2, 3 and 9A-9C, the toner cartridges TCy, TCm, TCc and TCk are supported on the right side of the developing units Gy to Gk respectively. When the toner cartridges TCy, TCm, TCc and TCk are moved in the left/right direction in the state where the side cover U3 has been opened, the toner cartridges TCy, TCm, TCc and TCk can be attached to or detached from the cartridge attachment/detachment portion U4.

The toner cartridges TCy, TCm, TCc and TCk have the same configuration, except that the black toner cartridge TCk has a larger capacity than that of any other color toner cartridge TCy, TCm, TCc. In the following description of the toner cartridges, therefore, only the yellow toner cartridge TCy will be described, but the other color toner cartridges TCm, TCc and TCk will not be described in detail.

In FIGS. 9A-9C and 10A-10B, the toner cartridge TCy has a supplied developer storing portion 41 in its upper portion and a residual developer recovery portion 42 in its lower portion. The residual developer recovery portion 42 is an example of a recovered developer storing portion.

The supplied developer storing portion 41 has a main supply portion 41*a* as an example of a first supply storing portion where developer to be supplied to corresponding one of the developing units Gy to Gk should be stored. A sub-supply portion 41*b* extending downward is formed in the front end portion of the main supply portion 41*a*. The sub-supply portion 41*b* is an example of a second supply storing portion. In comparison with the main supply portion 41*a*, the sub-supply portion 41*b* is formed so that the width in the front/rear direction is narrowed as it goes down. A supply outlet 41*c* from which developer will flow out is formed in the lower end portion of the sub-supply portion 41*b* to be open downward. In FIGS. 10A and 10B, a shutter guide 41*d* as an example of a shield member guide portion is formed in the circumferential edge of the supply outlet 41*c*.

A cartridge-side outlet shutter 41*e* as an example of a supply outlet shield member for opening/closing the supply outlet 41*c* is supported on the shutter guide 41*d* movably in the front/rear direction. The cartridge-side outlet shutter 41*e* is supported to be moved and retained in a closing position by a not-shown spring as an example of an urging member. In the closing position, the cartridge-side outlet shutter 41*e* closes the supply outlet 41*c* as shown in FIG. 10B.

When the toner cartridge TCy is moved from the right to the left to be attached, the rear end face of the cartridge-side outlet shutter 41*e* is pushed by the upper end of the outlet portion 12*b* so as to slide and move along the shutter guide 41*d*. Thus, the supply outlet 41*c* is opened. On this occasion, the rear end face of the shutter guide 41 pushes the inlet shutter 12*f* so that the inlet shutter 12*f* rotates. Thus, the supplied developer inlet 12*c* is opened. As a result, the supplied developer inlet 12*c* and the supply outlet 41*c* are connected so that developer can flow in. When the toner cartridge TCy is detached, the shutters 12*f* and 41*e* are moved by the springs respectively so that the supplied developer inlet 12*c* and the supply outlet 41*c* are closed.

The residual developer recovery portion 42 has a main recovery portion 42*a* as an example of a first recovery storing portion. The main recovery portion 42*a* is disposed in the lower end of the toner cartridge TCy as an example of the lower portion of the supplied developer storing portion 41.

In the rear end portion of the main recovery portion 42*a*, a sub-recovery portion 42*b* is formed as an example of a second recovery storing portion extending upward. The sub-recovery portion 42*b* is formed so that the width of the sub-recovery portion 42*b* in the front/rear direction is narrower than that of the main recovery portion 42*a*. A recovery inlet 42*c* to which the residual developer transport path 26*a* will be connected is formed in the upper end portion of the sub-recovery portion 42*b*. As shown in FIGS. 9A-9C and 10A-10B, the recovery inlet 42*c* according to the first exemplary embodiment is disposed to be higher in the direction of gravity than the supply outlet 41*c* and to be inside the horizontal width of the main supply portion 41*a*. The recovery inlet 42*c* is disposed near the boundary between the main supply portion 41*a* and the sub-supply portion 41*b*.

Accordingly, in the residual developer recovery portion 42 according to the first exemplary embodiment, when the toner cartridge TCy is attached, the residual developer transport path 26*a* penetrates the recovery inlet 42*c* while the circumferential edge portion of the recovery inlet 42*c* in the outer surface of the residual developer recovery portion 42 pushes the waste outlet shutter 26*c* to the left against the elastic force of the spring 26*d* to open the waste developer outlet 26*b*. Thus, waste developer flows into the sub-recovery portion 42*b* from the waste developer outlet 26*b* and drops down into the main recovery portion 42*a* so that the waste developer can be recovered.

Between the main recovery portion 42*a* and the supply outlet 41*c*, a supply/transmission system (in other words, drive transmission system) storing space 43 is formed as an example of a configuration space. When the toner cartridge TCy is attached, a drive transmission system including the clutch 11 and the like and the supply path forming member 12 are stored in the storing space 43.

In FIGS. 2 and 10A-10B, a side plate 44 extending in the up/down direction and connecting the supplied developer storing portion 41 and the residual developer recovery portion 42 is formed integrally with the right face of the toner cartridge TCy. In the front lower portion of the side plate 44, a handle 44*a* is formed as an example of an operation portion for allowing a user to grasp the toner cartridge TCy and perform operation such as attachment, detachment or the like. That is, the handle 44*a* is disposed in a position corresponding to an opposite side to the drive transmission system storing space 43 while disposed in a position to bypass the supplied developer storing portion 41 and the residual developer recovery portion 42.

As shown in FIG. 2, the main supply portion 41*a* of the black toner cartridge TCk is formed into a shape enlarged upward in comparison those of the other color toner cartridges TCy, TCm and TCc. Thus, the capacity of black developer which will be used often can be increased.

(Description about Layout of Members of Visible Image Forming Unit)

In FIG. 5, in the visible image forming unit UK according to the first exemplary embodiment, the admix auger 8 of the developing unit Gk is disposed on the opposite side to the side where the developing roller G1*k* is disposed, with respect to a virtual line connecting the primary transfer area Q4*k* and the rotation center of the photoconductor Pk. Accordingly, a major part of the developing unit Gk according to the first exemplary embodiment, particularly the supply auger 7 and the admix auger 8 are disposed within a projected plane of the photoconductor Pk virtually irradiated with light from the primary transfer area Q4*k* side.

In addition, in FIG. 5, in the developing unit Gk according to the first exemplary embodiment, the angle between a virtual line connecting the rotation center of the developing roller G1*k* and the rotation center of the supply auger 7 and a virtual line connecting the rotation center of the supply auger 7 and the rotation center of the admix auger 8 is set as an obtuse angle.

Further, in the visible image forming unit UK according to the first exemplary embodiment, the LED head LHk is disposed above the second agitation chamber 4 of the developing vessel 1, and the LED head LHk is disposed between the photoconductor Pk and the admix auger 8.

In addition, the charging roller CRk and the charger cleaner CCk are disposed above the developing vessel 1, and disposed to be stored on the inner side of the rear end of the developing vessel 1.

Accordingly, in the visible image forming unit UK according to the first exemplary embodiment, the primary transfer roller T1*k* is disposed above the photoconductor Pk, and the photoconductor cleaner CLk is disposed at the rear of the photoconductor Pk. In addition, the developing unit OK, the LED head LHk and the charging roller CRk are disposed locally under the photoconductor Pk. No member for black is disposed in front of the photoconductor Pk.

According to the first exemplary embodiment, the visible image forming units UY to UK are designed to be irreplaceable, and serve as reinforcing members for connecting left and right frames of the image forming apparatus body U1, that is, as so-called strength members (reinforcing frames).

Operation of First Exemplary Embodiment

In the printer U as an example of an image forming apparatus according to the first exemplary embodiment provided with the aforementioned constituent features, when image formation is carried out, developer is consumed in each developing unit Gy to Gk. With the consumption of the developer, developer stored in the main supply portion 41*a* and the sub-supply portion 41*b* of the supplied developer stored portion 41 of each toner cartridge TCy to TCk is supplied through the supply path forming member 12. On this occasion, waste developer recovered by the cleaner CLy to CLk, CLb is recovered into the residual developer recovery portion 42 of each toner cartridge TCy to TCk through the residual developer transport path 26*a*. On this occasion, developer to be supplied flows out through the supply outlet 41*c* in the lower end of the sub-supply portion 41*b* while the recovered developer flows in through the recovery inlet 42*c* in the upper end of the sub-recovery portion 42*b*. Those developers are designed to flow in and out by use of gravity. Accordingly, members for transporting developers into the toner cartridges TCy to TCk are dispensable. Thus, the number of parts can be restrained from increasing.

In each toner cartridge TCy to TCk according to the first exemplary embodiment, the sub-supply portion 41*b* and the sub-recovery portion 42*b* are disposed adjacently to each other and the recovery inlet 42*c* is disposed above the supply outlet 41*c* in the direction of gravity. In comparison with the case where the sub-supply portion 41*b* and the sub-recovery portion 42*b* are not adjacent to each other or the recovery inlet 42*c* is disposed under the supply outlet 41*c* in the direction of gravity, the space is used effectively so that a useless space can be reduced. Accordingly, each toner cartridge TCy to TCk is miniaturized while the total volume of the supplied developer storing portion 41 and the total volume of the residual developer recovery portion 42 are increased.

Further, in each toner cartridge TCy to TCk according to the first exemplary embodiment, the handle 44*a* is disposed correspondingly to the drive transmission system storing space 43 as a so-called dead space which cannot be used for storing developer. In comparison with the case where the handle 44*a* is provided in a position corresponding to the supplied developer storing portion 41 or the residual developer recovery portion 42 to reduce the volume thereof, the space is used effectively so that the volume of the supplied developer storing portion 41 or the volume of the residual developer recovery portion 42 can be maximized.

In addition, in each toner cartridge TCy to TCk according to the first exemplary embodiment, the supplied developer storing portion 41 and the residual developer recovery portion 42 are formed integrally so that they can be replaced together in one time. In comparison with the case where a supply vessel and a residual developer recovery vessel are separated, the work of replacement and the number of times of replacement can be reduced.

Further, in the printer U according to the first exemplary embodiment, assume that the toner cartridges TCy to TCk are replaced by new ones. On this occasion, the new ones can be attached with a simple operation with the shutters 12*f*, 26*e* and 41*e* being opened if the new ones are moved in one direction from the right to the left only in one side face, that is, the right side face of the printer U.

Further, according to the first exemplary embodiment, the black toner cartridge TCk whose developer will be used often is disposed in a rear end portion which tends to have a free space, and disposed in a position where the black toner cartridge TCk can be easily increased in volume in comparison with the other color toner cartridges TCy to TCc. According to the first exemplary embodiment, therefore, the configurations of the Y, M and C color toner cartridges TCy to TCc are standardized to reduce the number of parts, while the capacity of black developer which will be used often can be increased. Thus, the frequency of replacement of the back toner cartridge CLk can be restrained from being too much.

In addition, waste developer from the black photoconductor cleaner CLk and the belt cleaner Clb is recovered into the black toner cartridge TCk whose developer will be used often and which will be replaced more often than any other color toner cartridge. According to the first exemplary embodiment, therefore, in comparison with the case where a vessel for storing waste developer recovered by the belt cleaner CLb is formed separately and has to be replaced independently, it is unnecessary to change the vessel for recovering waste developer. Further, in comparison with the case where the developer recovered by the belt cleaner CLb is collected by the Y, M or C color toner cartridge TCy to TCc which will be used with lower frequency than the black toner cartridge TCk, the residual developer recovery portion 42 can be restrained from being filled with developer due to a large number of times of unicolor printing with black developer before the developer of the supplied developer storing portion 41 of the Y, M or C color toner cartridge TCy to TCc is completely used up.

In addition, in each visible image forming unit UY to UK, the admix auger 8 of the developing unit Gy to Gk is disposed on the opposite side to the developing roller G1*y* to G1*k* unlike that in the background-art configuration. When the admix auger 8 is disposed on the same side as the developing roller G1*y* to G1*k*, that is, not on the rear side but on the front side in FIG. 4 or on the side at a longer distance from the photoconductor Py to Pk as in the background-art configuration, the visible image forming unit UY to UK or the printer U as a whole would be elongated in the front/rear direction. In comparison with such a configuration, the length of each visible image forming unit UY to UK can be shortened in the front/rear direction according to the first exemplary embodiment.

Particularly, a major part of each developing unit Gy to Gk is disposed within a projected plane of the photoconductor Py to Pk in view from the primary transfer unit T1*y* to T1*k* side, but there are disposed no member in front of the photoconductor Py to Pk. That is, while the four photoconductors Py to Pk are arranged horizontally in parallel, only the photoconductor cleaners CLy to CLk are put among the photoconductors Py to Pk, but the developing units Gy to Gk are not put there. Accordingly, in comparison with the background-art configuration where developing units are put among plural of photoconductors Py to Pk, the length of the printer U according to the first exemplary embodiment becomes short in the front/rear direction so that the printer U can be miniaturized.

In the printer U according to the first exemplary embodiment, the admix auger 8 of each developing unit Gy to Gk is disposed to run behind the photoconductor Py to Pk. Thus, the position where developer is supplied to the developing unit Gy to Gk and the position where developer discharged from the photoconductor cleaner CLy to CLk is discharged are set to be close to each other. In a typical background-art configuration, the admix auger 8 is often disposed at a longer distance from the photoconductor Py to Pk. Thus, new developer is often supplied to the admix auger 8 side in order to reduce the insufficiently agitated developer supplied from the supply auger 7 to the developing roller G1*y* to G1*k*. Accordingly, the supply path forming member 12 and the residual developer transport path 26*a* for the same color are often disposed at a long distance from each other with interposition of the photoconductor Py to Pk. Thus, the supply path forming member 12 or the residual developer transport path 26*a* often interfere with an adjacent residual developer transport path 26*a* for another color. In contrast, in each visible image forming unit according to the first exemplary embodiment, the supply path forming member 12 and the residual developer transport path 26*a* for the same color can be disposed closely to each other and in parallel with each other. Thus, it is easy to design the visible image forming unit, while it is easy to form the supplied developer storing portion 41 and the residual developer recovery portion 42 integrally in each toner cartridge TCy to TCk.

In addition, in the printer U according to the first exemplary embodiment, the rotation direction of each developing roller G1*y* to G1*k* is set to be reverse to the rotation direction of the photoconductor Py to Pk. Thus, the layer thickness limiting member 6 can be disposed on the LED head LHy to LHk side. That is, the layer thickness limiting member 6 can be disposed in a closer position on the opposite side to the primary transfer area Q4*y* to Q4*k* with interposition of the photoconductor Py to Pk. It is therefore possible to miniaturize the printer U in comparison with the case where the conductor Py to Pk and the developing roller G1*y* to G1*k* rotate in the same direction and the layer thickness limiting member 6 is disposed at a longer distance from the LED head LHy to LHk.

Further, in the printer U according to the first exemplary embodiment, each inlet portion 5*a*, 5*b* is formed outside the image forming area L1 as shown in FIG. 8. When the right inlet portion 5*b* is set in the image forming area L1, the direction with which developer flows in through the inlet portion 5*b* is reverse to the direction with which the surface of the developing roller G1*y* to G1*k* moves. Thus, there is a fear that the transport of the developer may be delayed. According to the first exemplary embodiment, however, the right inlet portion 5*b* is set outside the image forming area L1. It is possible to reduce the fear that the developer retained by the developing roller G1*y* to G1*k* and the developer flowing into each inlet portion 5*a*, 5*b* flow in opposite directions to block the flow of each other. Thus, it is possible to well transport developer to each photoconductor Py to Pk.

In addition, according to the first exemplary embodiment, both the direction of developer moving from the supply auger 7 to the developing roller G1*y* to G1*k* or the layer thickness limiting member 6 and the direction of developer flowing from the supply auger 7 to the admix auger 8 in the left inlet portion 5*a* have rearward components. Accordingly, if the inlet portion 5*a* is set inside the image forming area L1, a part of developer supplied from the supply auger 7 to the developing roller G1*y* to G1*k* in the inlet portion 5*a* would flow into the admix auger 8 so that there is a fear that the amount of developer in the left end portion of the developing roller G1*y* to G1*k* might be reduced to lower the density of an image formed by the developer. On the other hand, according to the first exemplary embodiment, the left inlet portion 5*a* is set outside the image forming area L1 to eliminate the fear that sufficient developer cannot be retained on the developing roller G1*y* to G1*k* so that the developer flows to the admix auger 8 side. Thus, the amount of developer retained on the developing roller G1*y* to G1*k* can be restrained from decreasing, or the density of an image formed by the developer can be restrained from lowering.

In addition, according to the first exemplary embodiment, the supplied developer inlet position 5*c* is set in the left inlet portion 5*a* outside the image forming area L1. New developer flowing from the supplied developer inlet position 5*c* is agitated sufficiently by the admix auger 8 and then supplied to the photoconductor Py to Pk. That is, developer agitated sufficiently can be supplied and transported well in comparison with the case where new developer flowing in through the left inlet portion 5*a* is supplied to the developing roller G1*y* to G1*k* before the developer is agitated sufficiently.

Further, according to the first exemplary embodiment, the front end of the upper wall TR1*c* of the paper feed tray TR1 can be inclined upward in accordance with the shortened length of the visible image forming unit UY to UK. Thus, the entrance of the supply port TR1*d* can be widened. In the background-art typical configuration, when the length of the printer U in the front/rear direction is increased, the distance with which the recording sheet S should be inserted to abut against the rear wall TR1*b* becomes so long that it becomes difficult to insert the recording sheet S. It is indeed desired to widen the entrance of the supply port TR1*d*, but the height of the printer U has to be increased to widen the supply port TR1*d*. According to the first exemplary embodiment, the length of the visible image forming unit UY to UK in the front/rear direction is so short that a sufficient space can be secured in front of the visible image forming unit UY to UK, that is, under the belt cleaner CLb. Thus, the entrance of the supply port TR1*d* can be widened without increasing the height of the printer U. Accordingly, the recording sheets S can be supplied or extracted easily through the wide supply port TR1*d*.

Second Exemplary Embodiment

Figure 11:
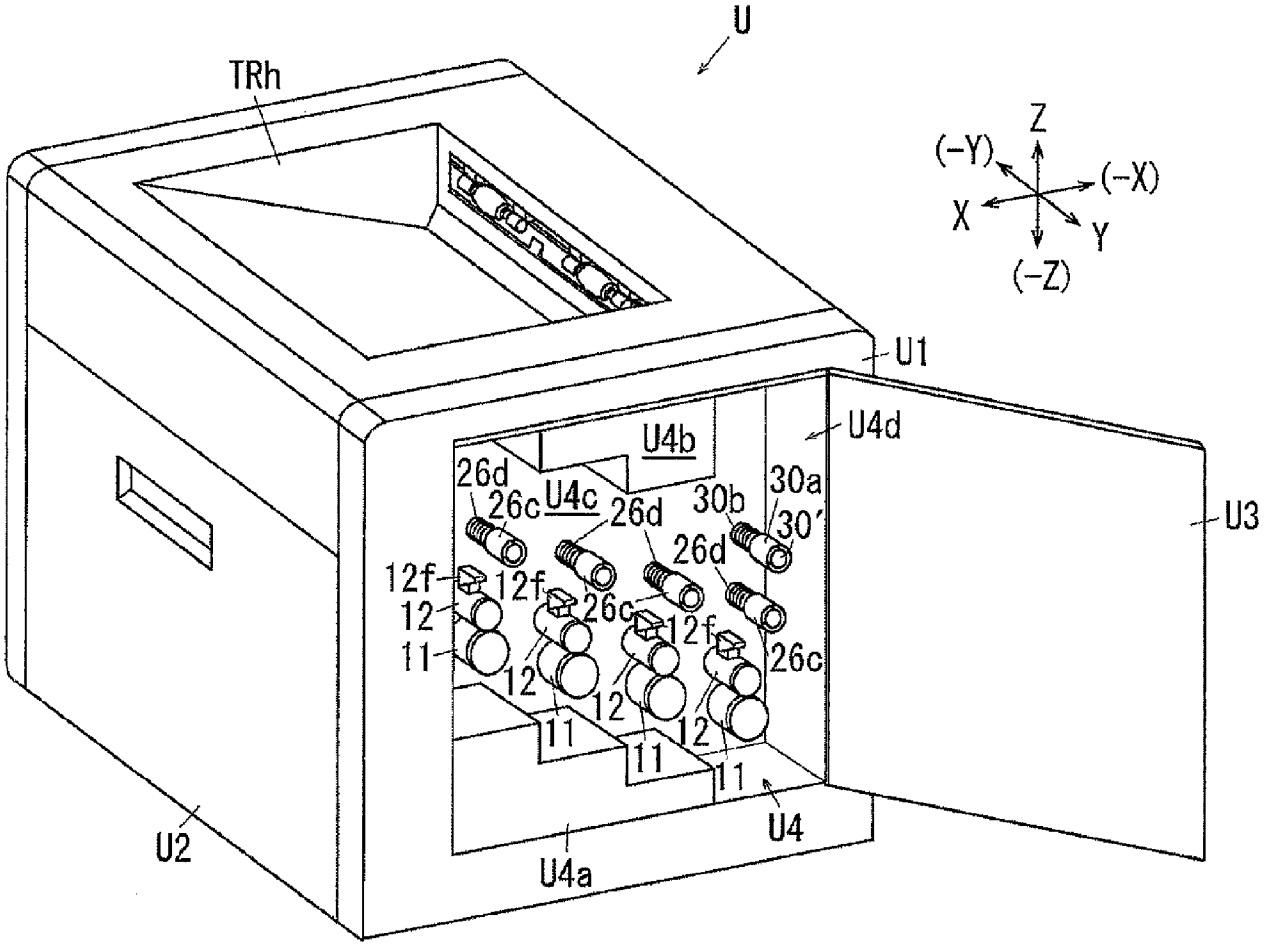
FIG. 11 is a perspective view showing an image forming apparatus according to a second exemplary embodiment of the invention, from which toner cartridges have been removed, and which corresponds to FIG. 3 showing the first exemplary embodiment.

FIG. 11 is a perspective view showing an image forming apparatus according to a second exemplary embodiment of the invention, from which toner cartridges have been removed. FIG. 11 corresponds to FIG. 3 showing the first exemplary embodiment.

Next, the second exemplary embodiment of the invention will be described. In the description of the second exemplary embodiment, constituent members corresponding to those in the first exemplary embodiment are referred to by the same numerals, and detailed description thereof will be omitted.

The second exemplary embodiment is configured in the same manner as the first exemplary embodiment, except the following points.

In FIG. 11, in the printer U according to the second exemplary embodiment, a residual developer transport path 30' extending from the belt cleaner CLb protrudes outward from the side wall U4*c* unlike the residual developer transport path 30 in the first exemplary embodiment but in the same manner as the residual developer transport paths 26*a* extending from the photoconductor cleaners CLy to CLk. A not-shown residual developer outlet, a waste outlet shutter 30*a* and a spring 30*b* are provided in the front end of the residual developer transport path 30' in the same manner as the residual developer transport paths 26*a*.

Figure 12:
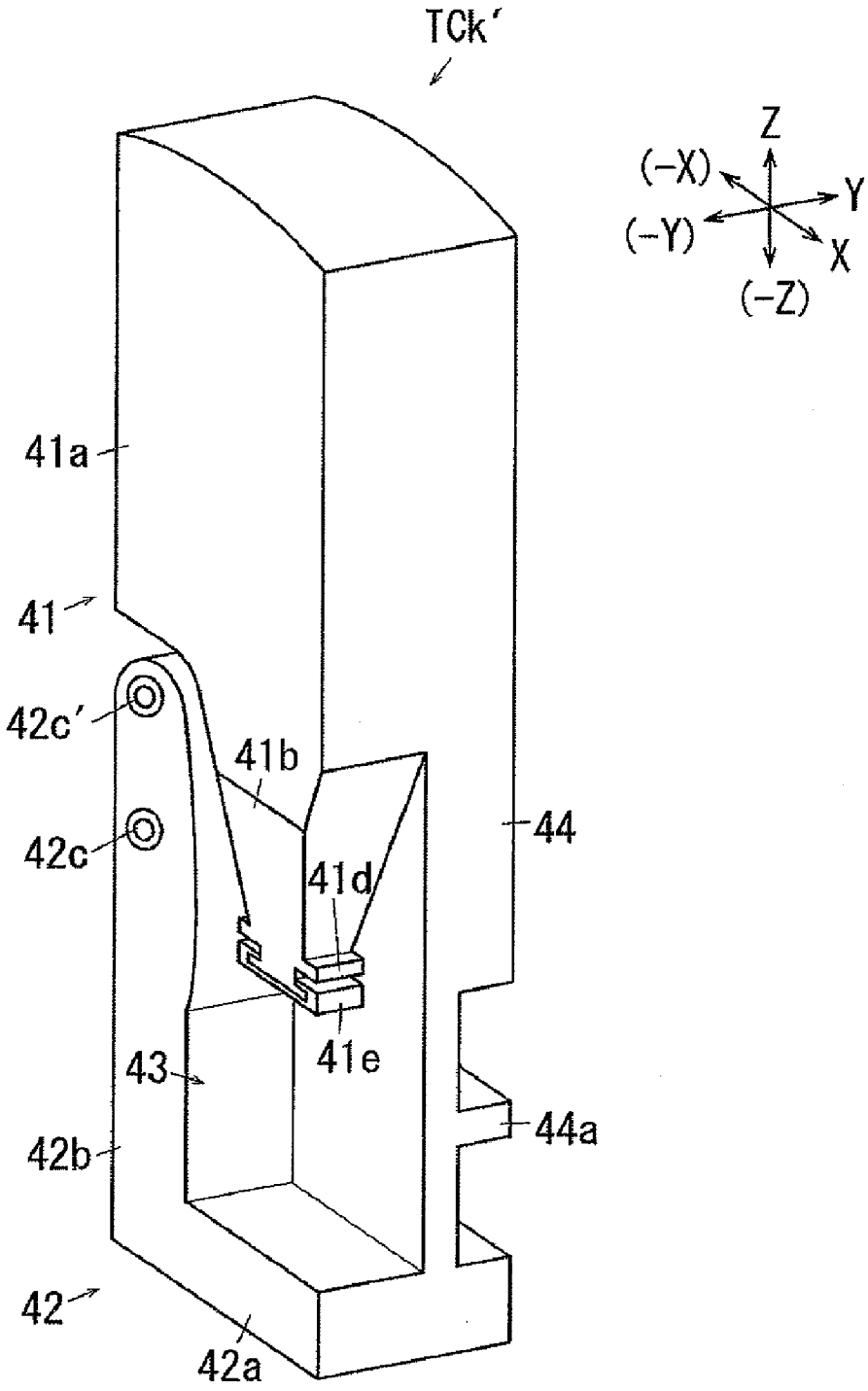
FIG. 12 is an overall view for explaining a black toner cartridge according to the second exemplary embodiment, which corresponds to FIGS. 10A-10B showing the first exemplary embodiment.

FIG. 12 is an overall view for explaining a black toner cartridge according to the second exemplary embodiment. FIG. 12 corresponds to FIGS. 10A-10B showing the first exemplary embodiment.

In the printer U according to the second exemplary embodiment, the Y, M and C color toner cartridges TCy, TCm and TCc are configured in the same manner as those in the first exemplary embodiment. In a black toner cartridge TCk', as shown in FIG. 12, a recovery inlet 42*c* corresponding to the residual developer transport path 26*a* from the black photoconductor cleaner CLk and a recovery inlet 42*c'* corresponding to the residual developer transport path 30' from the belt cleaner CLb are formed.

Operation of Second Exemplary Embodiment

In the printer U according to the second exemplary embodiment configured thus, developers recovered by the black photoconductor cleaner CLk and the belt cleaner CLb are recovered into the black toner cartridge TCk' which will be used more often and replaced more often than any other color toner cartridge TCy to TCc. Accordingly, the work of replacement and the number of times of replacement can be reduced in comparison with the configuration where the developer recovered by the belt cleaner CLb is recovered into a separate vessel which may be replaced independently.

In addition, the printer U according to the second exemplary embodiment has similar operations to those of the printer U according to the first exemplary embodiment.

Third Exemplary Embodiment

Figure 13:
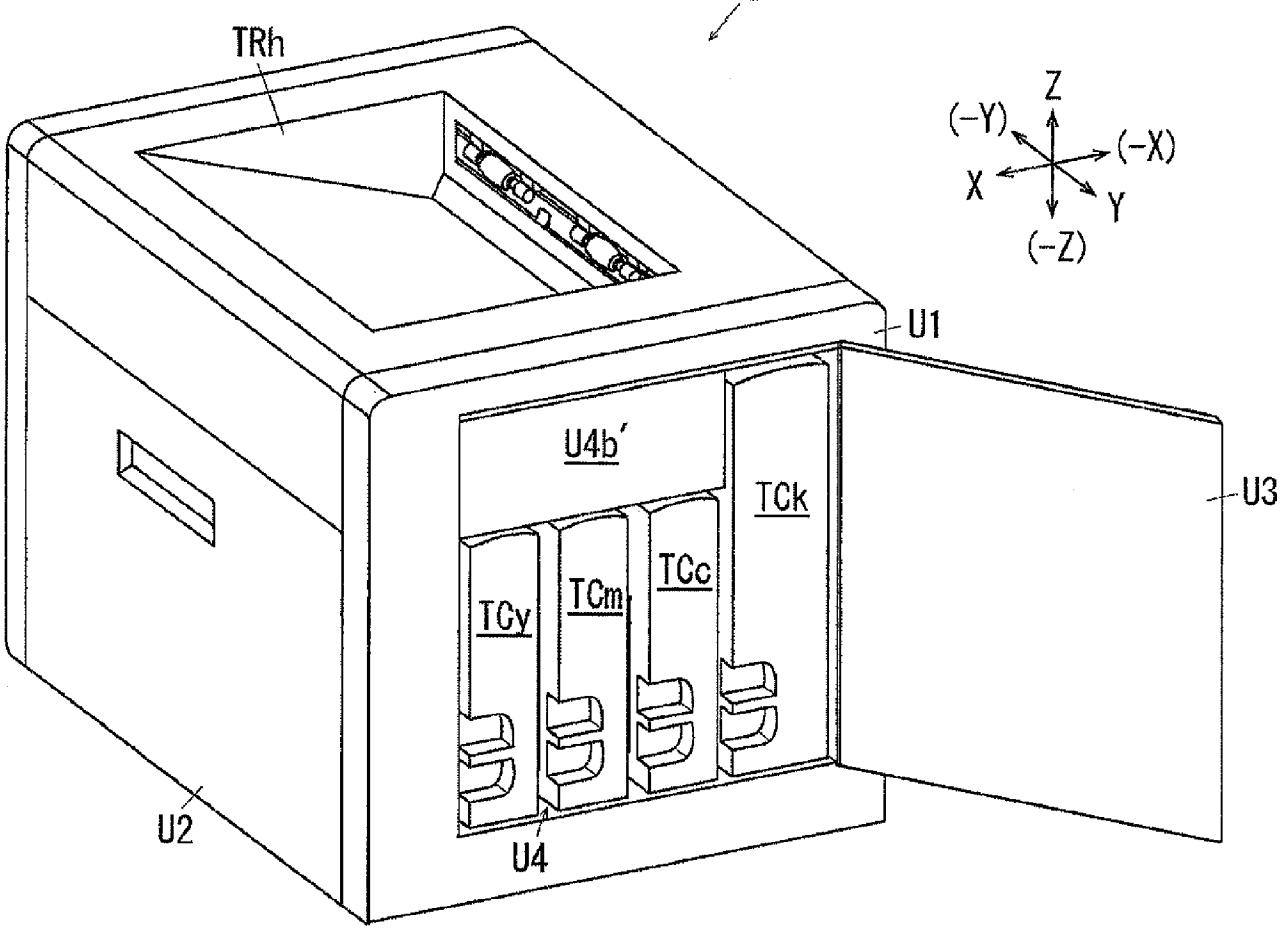
FIG. 13 is a perspective view showing an image forming apparatus according to a third exemplary embodiment of the invention, whose side cover has been opened and which corresponds to FIG. 2 showing the first exemplary embodiment.

FIG. 13 is a perspective view showing an image forming apparatus according to a third exemplary embodiment of the invention, whose side cover have been opened. FIG. 13 corresponds to FIG. 2 showing the first exemplary embodiment.

Figure 14:
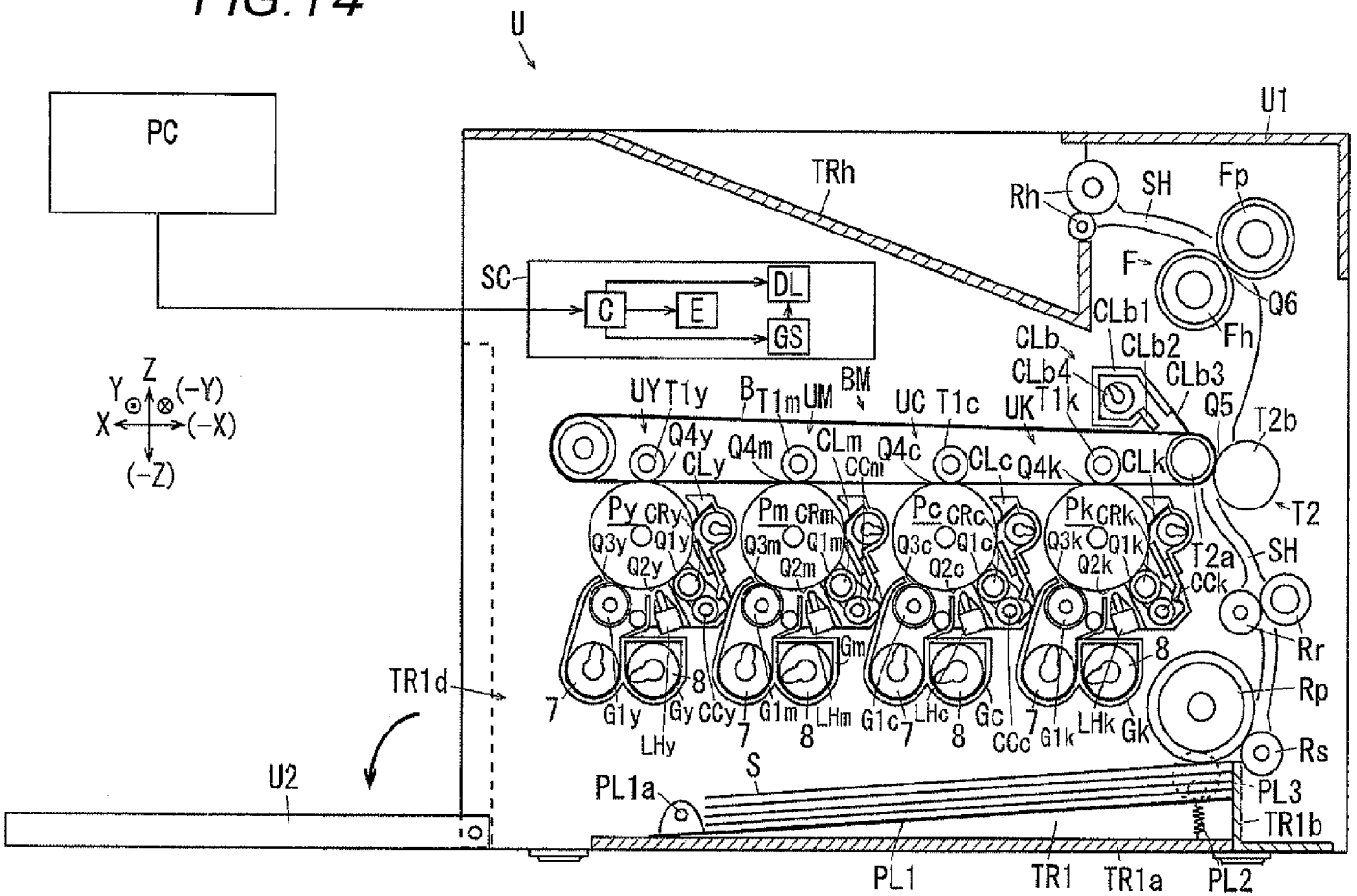
FIG. 14 is an overall view for explaining the image forming apparatus according to the third exemplary embodiment, which corresponds to FIG. 4 showing the first exemplary embodiment.

FIG. 14 is an overall view for explaining the image forming apparatus according to the third exemplary embodiment. FIG. 14 corresponds to FIG. 4 showing the first exemplary embodiment.

Next, the third exemplary embodiment of the invention will be described. In the description of the third exemplary embodiment, constituent members corresponding to those in the first exemplary embodiment are referred to by the same numerals, and detailed description thereof will be omitted.

The third exemplary embodiment is configured in the same manner as the first exemplary embodiment, except the following points.

In the configuration of the first exemplary embodiment, there has the intermediate transfer belt B disposed so that the primary transfer areas Q4*y* to Q4*k* are inclined with respect to the horizontal plane. Instead of the configuration of the first exemplary embodiment, in the printer U according to the third exemplary embodiment in FIGS. 13 and 14, the intermediate transfer belt B is disposed so that the primary transfer areas Q4*y* to Q4*k* are arranged horizontally. Accordingly, the layout of the visible image forming units UY to UK is also different from that of the first exemplary embodiment. The visible image forming units UY to UK are disposed in positions of the same height in the direction of gravity. The developing units Gy to Gk to which developers are supplied from the toner cartridges TCy to TCk or the photoconductor cleaners CLy to CLk from which developers are discharged are also disposed at the same height. Thus, as shown in FIG. 13, the lower ends of the toner cartridges TCy to TCk according to the third exemplary embodiment are at the same height unlike the configuration of the first exemplary embodiment where the toner cartridges TCy to TCk are displaced like steps. As a result, the lower guide step portion U4*c* in the first exemplary embodiment is omitted in the third exemplary embodiment, but only an upper guide portion U4*b'* having a quadrilateral shape is provided.

In addition, each developing unit Gy to Gk according to the third exemplary embodiment is different from that according to the first exemplary embodiment, so that the angle between the virtual line connecting the rotation center of the developing roller G1 and the rotation center of the supply auger 7 and the virtual line connecting the rotation center of the supply auger 7 and the rotation center of the admix auger 8 is set as an acute angle.

Operation of Third Exemplary Embodiment

In the printer U according to the third exemplary embodiment configured thus, the toner cartridges TCy to TCk can be arranged horizontally without any step unlike those in the first exemplary embodiment.

In the configuration of the third exemplary embodiment, the upper guide portion U4*b*' of the printer U may be omitted. In this case, the capacity of the supplied developer storing portion 41 of each Y, M, C color toner cartridge TCy to TCc can be made as large as that of the black toner cartridge TCk.

In addition, in the printer U according to the third exemplary embodiment, the admix auger 8 of each developing unit Gy to Gk is partially disposed on the opposite side to the developing roller G1 with respect to the virtual line extending from the center of the photoconductor Py to Pk in the direction of gravity, while the angle between the virtual lines connecting the centers of the developing roller G1, the supply auger 7 and the admix auger 8 with each other is set as an acute angle. Thus, each visible image forming unit UY to UK and the printer U as a whole can be miniaturized in the same manner as in the configuration of the first exemplary embodiment and in comparison with the background-art configuration.

In addition, the printer U according to the third exemplary embodiment has similar operations to those of the printer U according to the first exemplary embodiment.

Fourth Exemplary Embodiment

Figure 15:
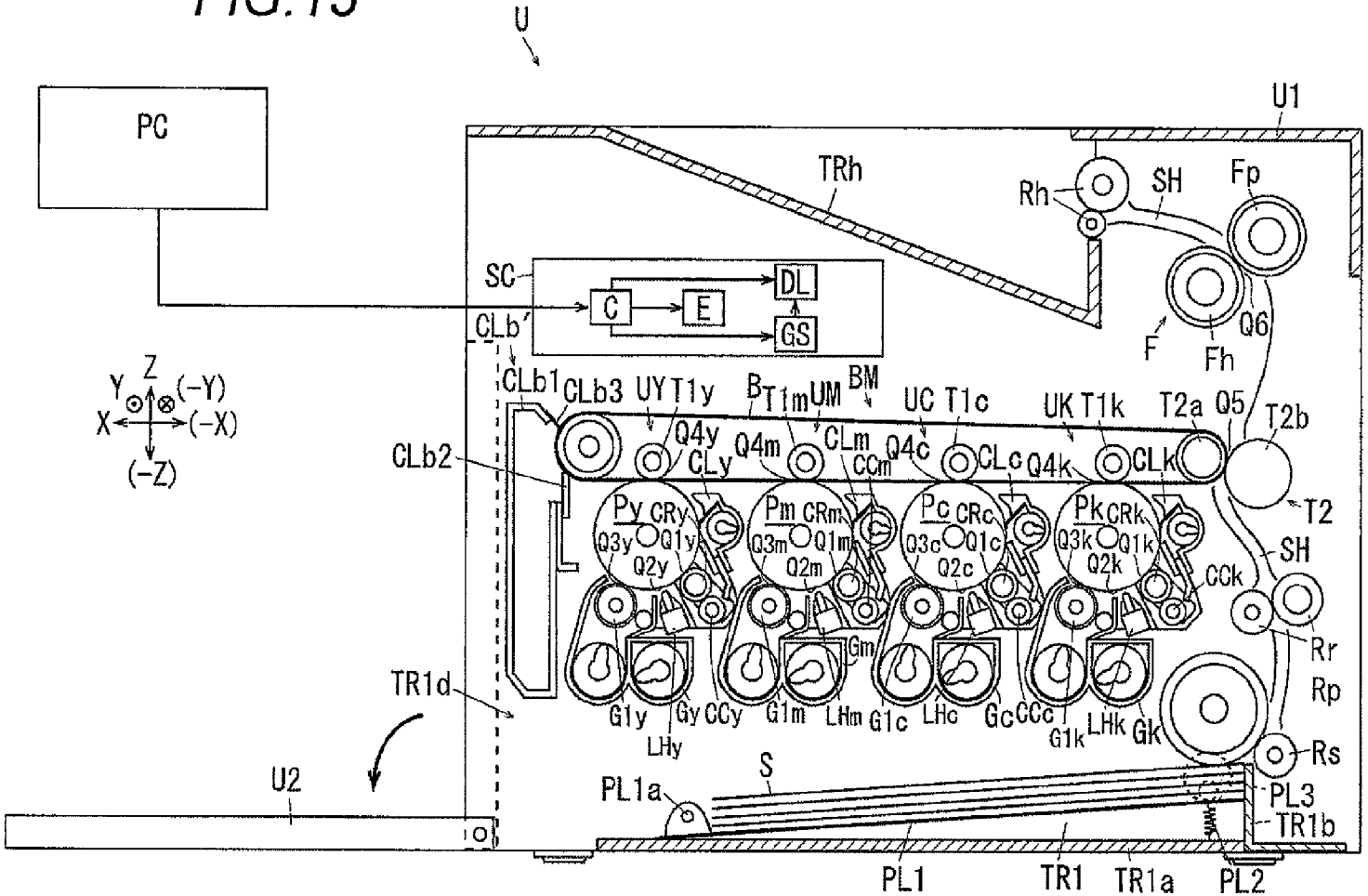
FIG. 15 is an overall view for explaining the image forming apparatus according to a fourth exemplary embodiment of the invention, which corresponds to FIG. 4 showing the first exemplary embodiment.

FIG. 15 is an overall view for explaining an image forming apparatus according to a fourth exemplary embodiment of the invention. FIG. 15 corresponds to FIG. 4 showing the first exemplary embodiment.

Next, the fourth exemplary embodiment of the invention will be described. In the description of the fourth exemplary embodiment, constituent members corresponding to those in the first and third exemplary embodiments are referred to by the same numerals, and detailed description thereof will be omitted.

The fourth exemplary embodiment is configured in the same manner as the third exemplary embodiment, except the following points.

In FIG. 15, the intermediate transfer belt B in the printer U according to the fourth exemplary embodiment is disposed so that the primary transfer areas Q4*y* to Q4*k* are arranged horizontally in the same manner as in the printer U according to the third exemplary embodiment. In addition, in the printer U according to the fourth exemplary embodiment, a belt cleaner CLb' is disposed in front of the belt driving roll Rd unlike that in the printer U according to the third exemplary embodiment. A cleaning vessel CLb1 of the belt cleaner CLb' is formed to be long in the up/down direction. Thus, the capacity of the cleaning vessel CLb1 is increased in comparison with those in the first to third exemplary embodiments. In addition, the belt cleaner CLb' according to the fourth exemplary embodiment is configured to be removably attached to the image forming apparatus body U1. Recovered developer is accumulated in the cleaning vessel CLb1. When the cleaning vessel CLb1 is filled with the recovered developer, the belt cleaner CLb' can be replaced. With this configuration, the residual material transport member CLb4 and the residual developer transport path 30 are omitted in the fourth exemplary embodiment.

Operation of Fourth Exemplary Embodiment

In the printer U according to the fourth exemplary embodiment configured thus, developer recovered by the belt cleaner CLb' is not discharged into the black toner cartridge TCk but accumulated in the cleaning vessel CLb1 designed to be replaceable, unlike that of the first or third exemplary embodiment.

In addition, the printer U according to the fourth exemplary embodiment has similar operations to those of the printer U according to the first exemplary embodiment.

Fifth Exemplary Embodiment

Figure 16:
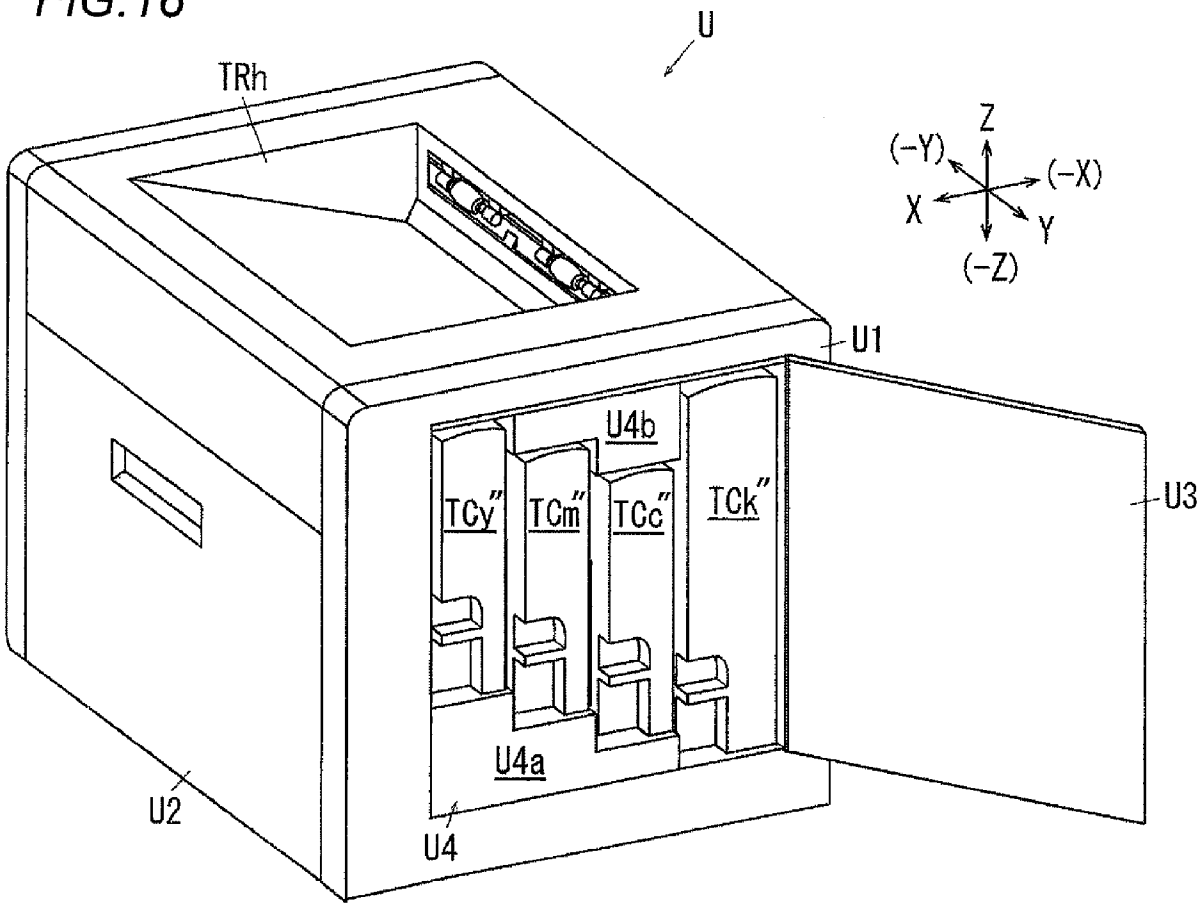
FIG. 16 is a perspective view showing an image forming apparatus according to a fifth exemplary embodiment of the invention, which corresponds to FIG. 2 showing the first exemplary embodiment.

FIG. 16 is an overall view for explaining an image forming apparatus according to a fifth exemplary embodiment of the invention. FIG. 15 corresponds to FIG. 2 showing the first exemplary embodiment.

Figure 17A:
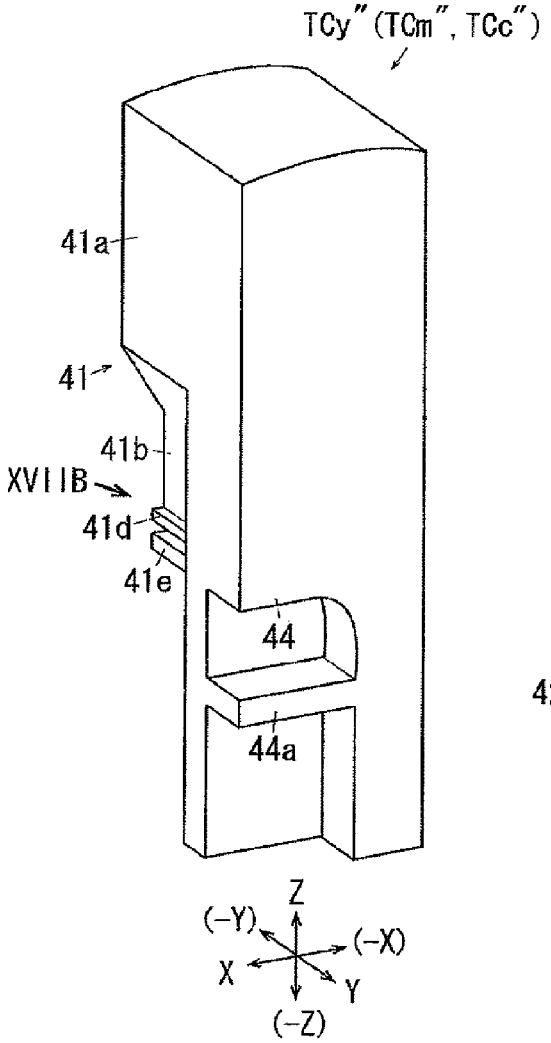
FIGS. 17A-17B are views for explaining a toner cartridge according to the fifth exemplary embodiment, which correspond to FIGS. 10A-10B showing the first exemplary embodiment, FIG. 17A being a perspective view showing the state where the toner cartridge is viewed obliquely from its front, FIG. 17B being a perspective view showing the state where the toner cartridge is viewed from the arrow XVIIB direction in FIG. 17A.
Figure 17B:
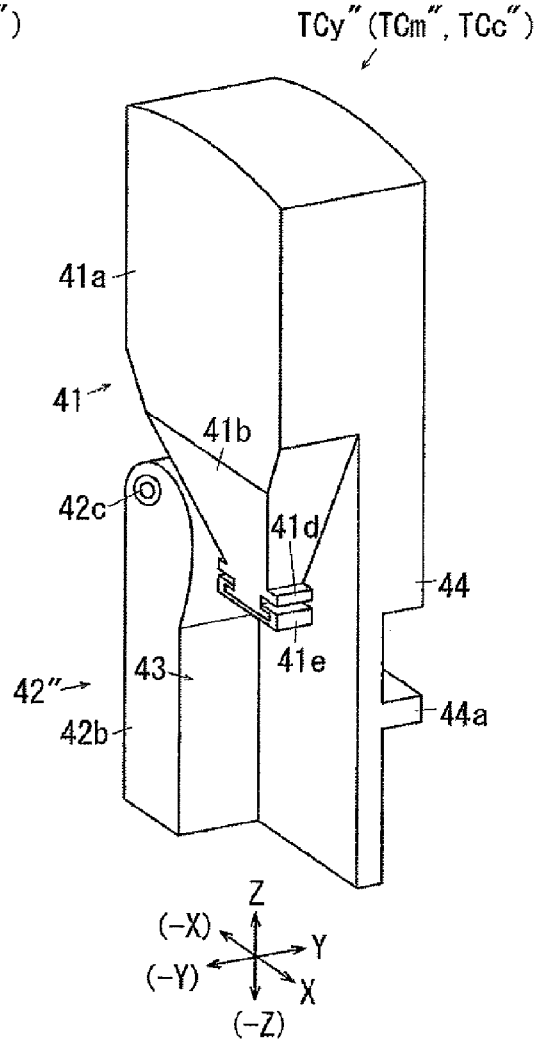

FIGS. 17A-17B are views for explaining a toner cartridge according to the fifth exemplary embodiment. FIGS. 17A-17B correspond to FIGS. 10A-10B showing the first exemplary embodiment. FIG. 17A is a perspective view showing the state where the toner cartridge is viewed obliquely from its front. FIG. 17B is a perspective view showing the state where the toner cartridge is viewed from the arrow XVIIB direction in FIG. 17A.

Next, the fifth exemplary embodiment of the invention will be described. In the description of the fifth exemplary embodiment, constituent members corresponding to those in the first exemplary embodiment are referred to by the same numerals, and detailed description thereof will be omitted.

The fifth exemplary embodiment is configured in the same manner as the first exemplary embodiment, except the following points.

In FIGS. 16 and 17A-17B, each toner cartridge TCy" to TCk" in the printer U according to the fifth exemplary embodiment has a residual developer recovery portion 42" which consists of only the sub-recovery portion 42*b* and from which the main recovery portion 42*a* of the residual developer recovery portion 42 in each toner cartridge TCy to TCk according to the first exemplary embodiment is omitted.

Operation of Fifth Exemplary Embodiment

In the printer U according to the fifth exemplary embodiment configured thus, the volume of the residual developer recovery portion 42" can be changed in accordance with the amount of developer to be recovered when the transfer efficiency of the developer is so high that residual developer is rarely produced in each photoconductor Py to Pk or the intermediate transfer belt B. The volume may be too much in spite of only the sub-recovery portion 42*b*. In such a case, the sub-recovery portion 42*b* may be shortened in the up/down direction to change and adjust the volume. In this case, the toner cartridges TCy" to TCk" as a whole can be shortened in the up/down direction while a required volume is secured.

In addition, the printer U according to the fifth exemplary embodiment has similar operations to those of the printer U according to the first exemplary embodiment.

Although the residual developer recovery portion 42" in the fifth exemplary embodiment has a shape from which the main recovery portion 42*a* has been omitted, the sub-recovery portion 42*b* may be instead omitted or shortened in the up/down direction to change the volume of the residual developer recovery portion 42". In this case, the toner cartridges TCy" to TCk" as a whole can be shortened in the up/down direction while a required volume is secured.

Sixth Exemplary Embodiment

Figure 18A:
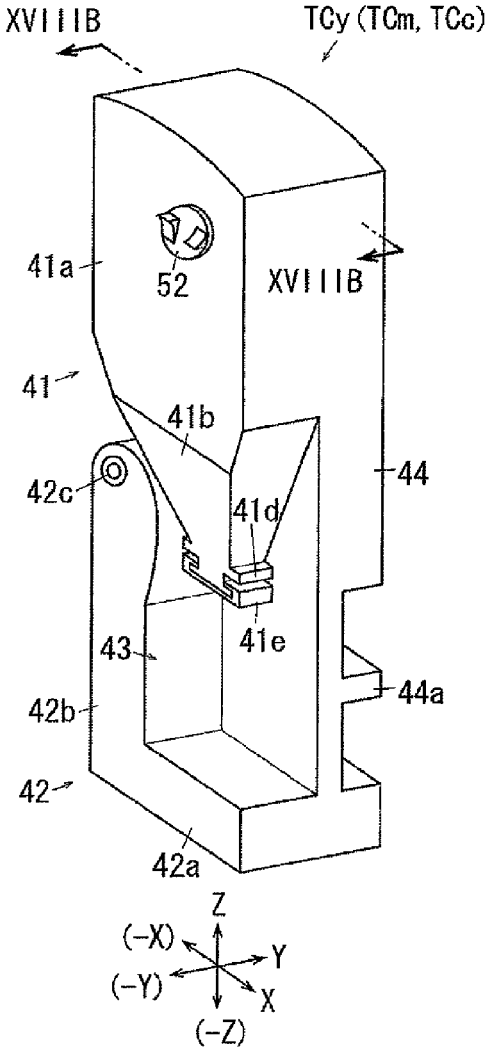
FIGS. 18A-18B are views for explaining a toner cartridge according to a sixth exemplary embodiment of the invention, FIG. 18A being a perspective view corresponding to FIG. 10B showing the first exemplary embodiment, FIG. 18B being a sectional view taken on line XVIIIB-XVIIIB in FIG. 18A and corresponding to FIG. 9C showing the first exemplary embodiment.
Figure 18B:
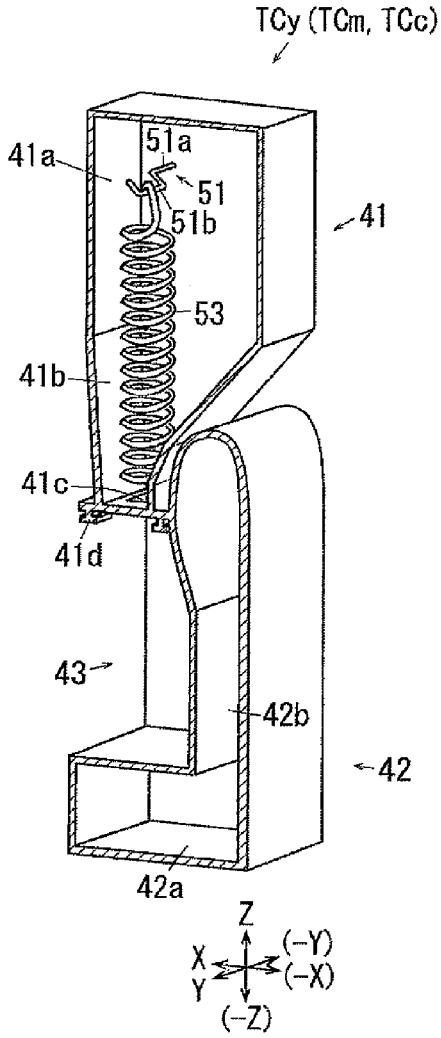

FIGS. 18A-18B are views for explaining a toner cartridge according to a sixth exemplary embodiment of the invention. FIG. 18A is a perspective view corresponding to FIG. 10B showing the first exemplary embodiment. FIG. 18B is a sectional view taken on line XVIIIB-XVIIIB in FIG. 18A. FIG. 18B corresponds to FIG. 9C showing the first exemplary embodiment.

Next, the sixth exemplary embodiment of the invention will be described. In the description of the sixth exemplary embodiment, constituent members corresponding to those in the first exemplary embodiment are referred to by the same numerals, and detailed description thereof will be omitted.

The sixth exemplary embodiment is configured in the same manner as the first exemplary embodiment, except the following points.

In FIGS. 18A-18B, in the printer U according to the sixth exemplary embodiment, an agitation spring support member 51 as an example of an agitation member support is rotatably support on the side surface on the side wall U4*c* side in an upper portion of the main supply portion 41*a* of the supplied developer storing portion 41 in each toner cartridge TCy to TCk. A coupling 52 as an example of a driven transmission member is supported on an outside end portion of the agitation spring support member 51. When the toner cartridge TCy to TCk is mounted, the coupling 52 engages with a not-shown drive transmission member provided in the printer U so that a driving force can be transferred to the coupling 52.

In FIG. 18B, the agitation spring support member 51 is formed into a U-shape bent like a so-called crank inside the main supply portion 41*a*. The agitation spring support member 51 has a support portion 51*b* formed in a position axially displaced from a rotation center 51*a*. An agitation spring 53 as an example of an agitation member is supported on the support portion 51*b* so as to extend from an upper portion of the main supply portion 42*a* to the vicinity of the supply outlet 41*c* through the sub-supply portion 42*b*. Thus, when rotation is transferred via the coupling 52, the agitation spring 53 supported on the support portion 51*b* displaced from the rotation center 51*a* reciprocates in the up/down direction.

Operation of Sixth Exemplary Embodiment

In the printer U according to the sixth exemplary embodiment configured thus, when developer is supplied to each developing unit Gy to Gk, the agitation spring 53 is driven to move in the up/down direction to agitate the developer in the supplied developer storing portion 41. Accordingly, even if the developer stored in the supplied developer storing portion 41 is lumpy, the developer can be agitated and loosened and flow out from the supply output 41*e*. That is, failure in supply can be restrained from occurring due to the lumpy developer, in comparison with the case where the agitation spring 53 is not provided.

In addition, when the agitation spring 53 which is reciprocating touches the inner wall surface of the supplied developer storing portion 41, the supplied developer storing portion 41 or the residual developer recovery portion 42 formed integrally therewith vibrates so that the developer adhering to the wall surface can drop off easily. Accordingly, the developer in the supplied developer storing portion 41 can be restrained from staying without being supplied, or the developer adhering to the residual developer recovery portion 42 can be restrained from clogging the residual developer recovery portion 42.

In addition, the printer U according to the sixth exemplary embodiment has similar operations to those of the printer U according to the first exemplary embodiment.

Seventh Exemplary Embodiment

Next, a seventh exemplary embodiment of the invention will be described. In the description of the seventh exemplary embodiment, constituent members corresponding to those in the first exemplary embodiment are referred to by the same numerals, and detailed description thereof will be omitted.

The seventh exemplary embodiment is configured in the same manner as the first exemplary embodiment, except the following points.

Figure 19:
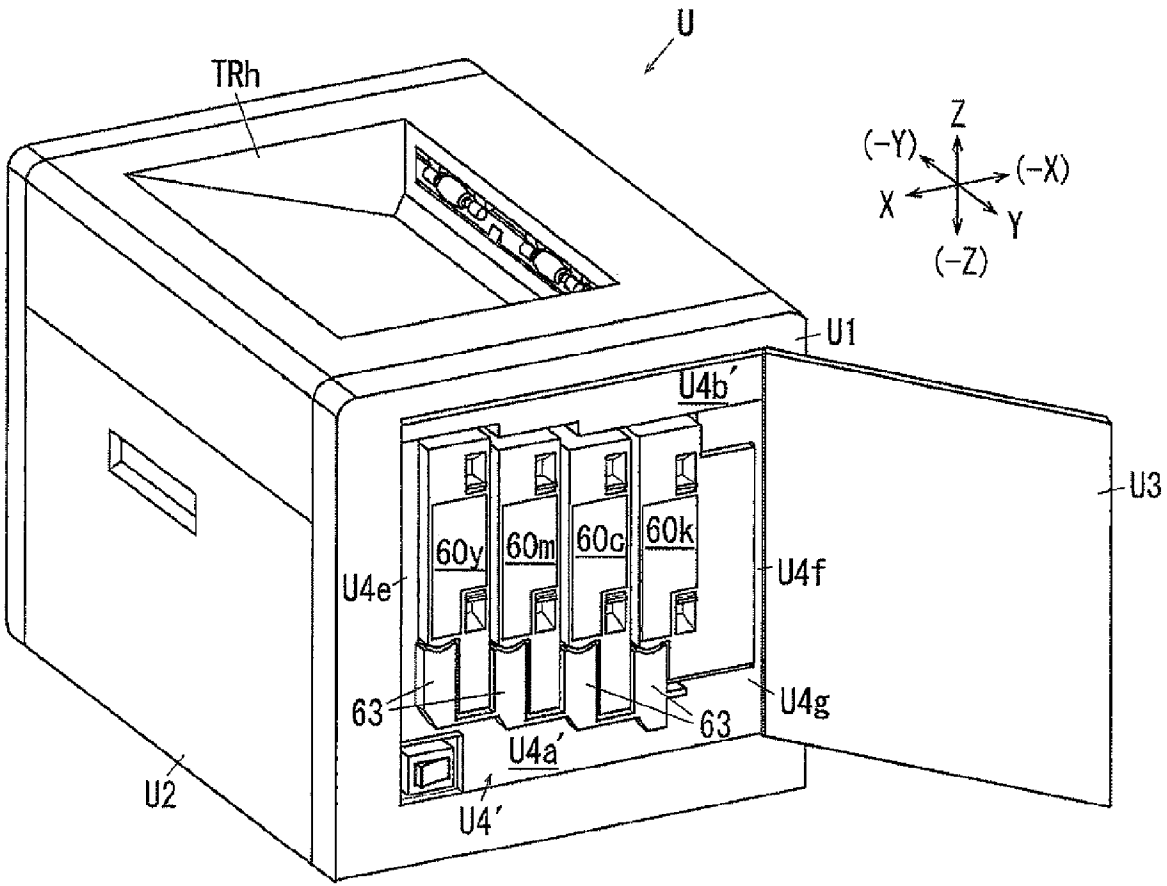
FIG. 19 is a view for explaining an image forming apparatus according to a seventh exemplary embodiment of the invention, which corresponds to FIG. 2 showing the first exemplary embodiment.

FIG. 19 is a view for explaining an image forming apparatus according to the seventh exemplary embodiment. FIG. 19 corresponds to FIG. 2 showing the first exemplary embodiment.

Figure 20:
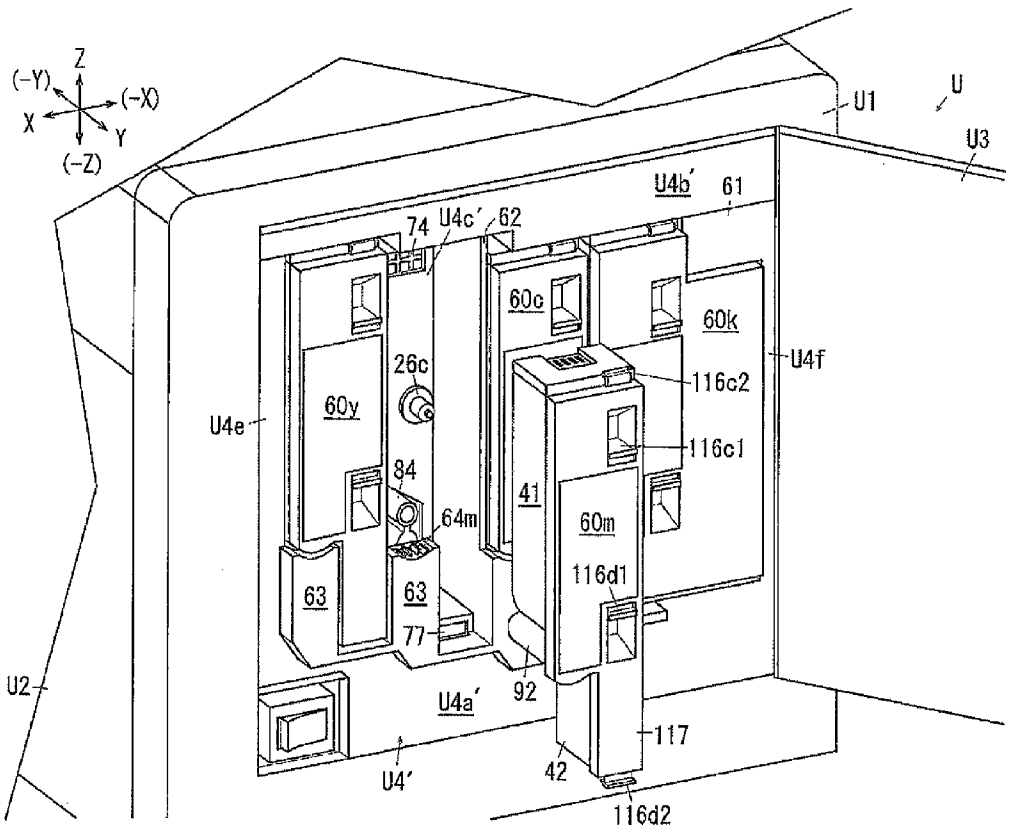
FIG. 20 is a view for explaining the image forming apparatus according to the seventh exemplary embodiment from which a toner cartridge has been removed, and which corresponds to FIG. 3 showing the first exemplary embodiment.

FIG. 20 is a view for explaining the image forming apparatus according to the seventh exemplary embodiment from which a toner cartridge has been removed. FIG. 20 corresponds to FIG. 3 showing the first exemplary embodiment.

Figure 21:
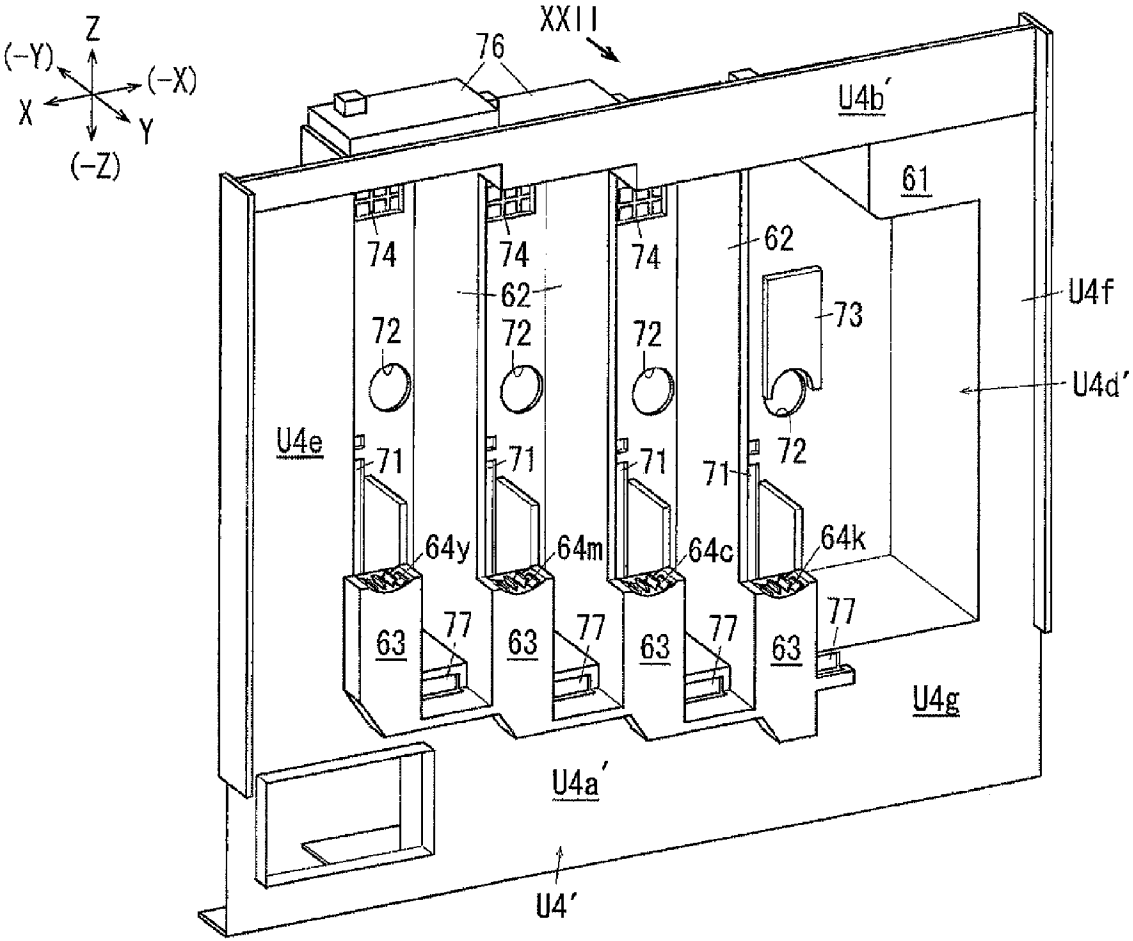
FIG. 21 is a view for explaining a cartridge attachment/detachment portion according to the seventh exemplary embodiment.

FIG. 21 is a view for explaining a cartridge attachment/detachment portion according to the seventh exemplary embodiment.

In FIGS. 19 and 20, the printer U according to the seventh exemplary embodiment has a side cover U3 openable around its lower end, in place of the side cover U3 openable around its rear end in the first exemplary embodiment.

In FIGS. 19-21, a cartridge attachment/detachment portion U4' according to the seventh exemplary embodiment has a lower guide step portion U4*a*', an upper guide step portion U4*b*', a front wall portion U4*e*, a rear wall portion U4*f*, and a side wall U4*c*'. The lower guide step portion U4*a*' descends two steps toward the rear side. The upper guide step portion U4*b*' descends two steps toward the rear side. The side wall U4*c*' is disposed in a recessed position deeper than the guide step portions U4*a*' and U4*b*', the front wall portion U4*e* and the rear wall portion U4*f*.

A black cartridge raising portion U4*g* having a top surface higher than the two-step descending surface of the lower guide step portion U4*a*' in the up/down direction is formed at the rear of the lower guide step portion U4'. In addition, on the rear end lower surface of the upper guide step portion U4*b*', a protrusion portion 61 for storing the lower front portion of the fixing unit F is formed to be convex downward.

Partition walls 62 extending in the up/down direction to connect step portions of the lower guide step portion U4*a*' and step portions of the upper guide step portion U4*b*' with each other are formed between the lower guide step portion U4*a*' and the upper guide step portion U4*b*'.

Thus, attachment/detachment spaces U4*d*' to which the color toner cartridges 60*y* to 60*k* should be removably attached respectively are constituted by the four spaces surrounded by the guide step portions U4*a*' and U4*b*' and the partition walls 62. As shown in FIG. 19, the color toner cartridges 60*y* to 60*k* are stored in the attachment/detachment spaces U4*d*' according to the seventh exemplary embodiment so that the color toner cartridges 60*y*, 60*m* and 60*c* mounted in turn from the front side are displaced like steps and the top surface of the color toner cartridge 60*c* are as high as the top surface of the color toner cartridge 60*k*. In addition, the rearmost space where the black toner cartridge 60*k* should be stored is formed to be longer in the front/rear direction than any other space where the color toner cartridge 60*y*, 60*m*, 60*c* should be stored.

Figure 22:
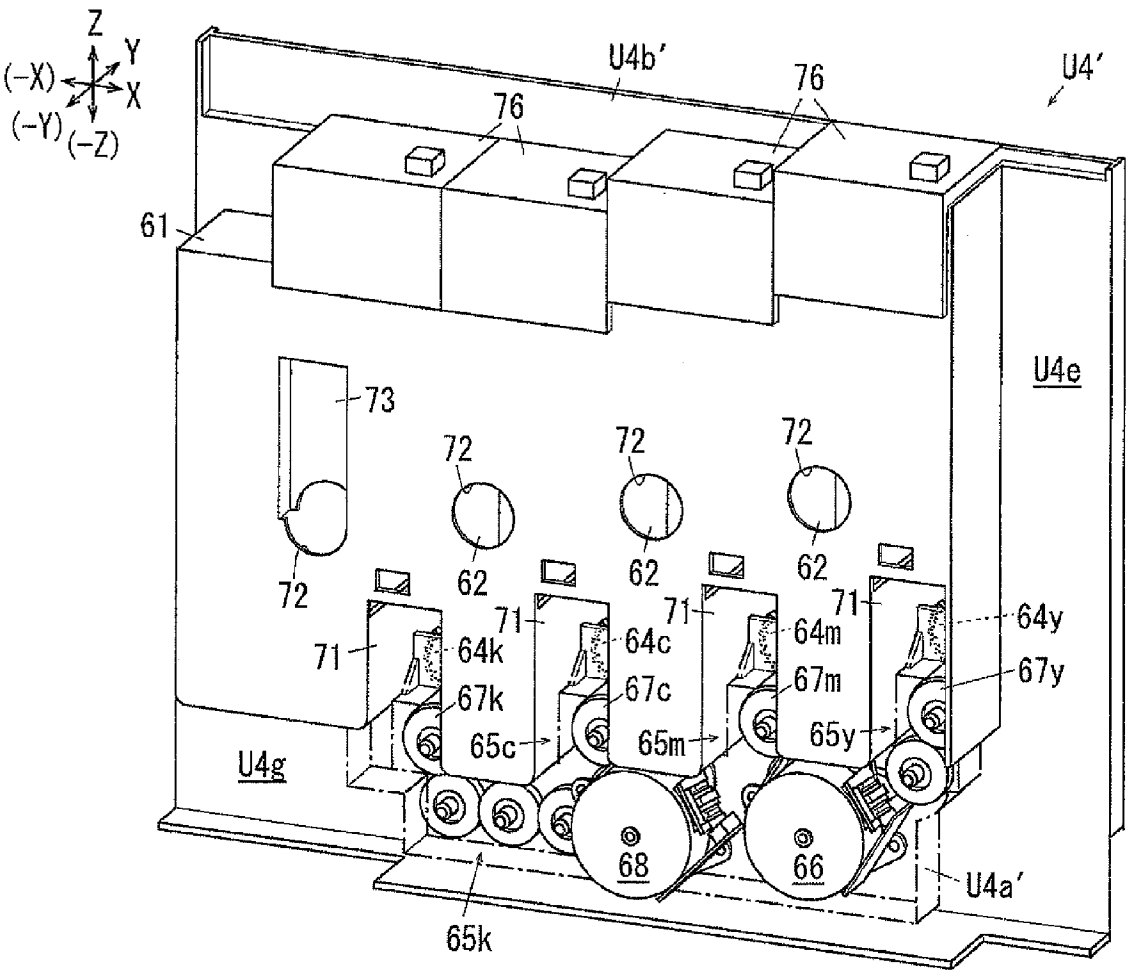
FIG. 22 is a view seen from the arrow XXII direction in FIG. 21.

FIG. 22 is a view from the arrow XXII direction in FIG. 21.

In FIGS. 19-21, a transmission system storing portion 63 is formed in the front lower end portion of each attachment/detachment space U4*d*'. In FIGS. 21 and 22, a transmission gear 64*y* to 64*k* is rotatably supported on the upper end of each transmission system storing portion 63, and an upper portion of the transmission gear 64*y* to 64*k* is partially exposed into the attachment/detachment space U4*d*'.

In FIG. 22, a gear array or a so-called gear train 65*y* as an example of a transmission system including plural of gears is supported in the transmission system storing portion 63. A first cartridge motor 66 as an example of a first drive unit is disposed inside the lower guide step portion U4*a*'. A driving force is transmitted from the first cartridge motor 66 to the yellow transmission gear 64*y* through the gear train 65*y*. The yellow gear train 65*y* has a yellow one-way clutch 67*y* as an example of a one-way transmission member for transmitting rotations in one direction but idling rotations in the other direction to thereby disconnect the transmission.

A driving force is transmitted to the magenta transmission gear 64*m* from the first cartridge motor 66 through a magenta gear train 65*m* having a magenta one-way clutch 67*m* in the same manner as that to the yellow transmission gear 64*y*.

In FIG. 22, a second cartridge motor 68 as an example of a second drive unit is supported at the rear of the first cartridge motor 66. A driving force is transmitted to each of the cyan and black transmission gears 64*c* and 64*k* from the second cartridge motor 68 through a gear train 65*c*, 65*k* having a one-way clutch 67*c*, 67*k* in the same manner as those to the yellow and magenta transmission gears 64*y* and 64*m*.

Accordingly, in the seventh exemplary embodiment, the transmission system storing portions 63 serve as storing portions for storing constituent members of the printer U including the transmission gears 64*y* to 64*k* and the gear trains 65*y* to 65*k*. The lower guide step portion U4*a*' serves as a storing portion for storing constituent members of the printer U including the cartridge motors 66 and 68 and the gear trains 65*y* to 65*k*.

Each cartridge motor 66, 68 according to the seventh exemplary embodiment is configured to be able to rotate forward and backward. Each transmission gear 64*y* to 64*k* is driven by the combination of the rotation direction of the cartridge motor 66, 68 and the corresponding one-way clutch 67*y* to 67*k*. For example, to rotate the yellow transmission gear 64*y*, the first cartridge motor 66 is driven to rotate forward and the rotation is transmitted by the yellow one-way clutch 67*y* while the magenta one-way clutch 67*m* is idled. Thus, the yellow transmission gear 64*y* rotates without rotating the magenta transmission gear 64*m*. On the contrary, to rotate the magenta transmission gear 64*m*, the first cartridge motor 66 is driven to rotate backward and the yellow one-way clutch 67*y* is idled while the rotation is transmitted by the magenta one-way clutch 67*m*. Thus, the magenta transmission gear 64*m* rotates without rotating the yellow transmission gear 64*y*. The same rules are applied to the cyan transmission gear 64*c* and the black transmission gear 64*k*. This manner is not limited to the one-way clutches, but relationally known drive transmission/disconnection units such as electromagnetic clutches to be turned on/off in accordance with input signals may be used to implement a similar function.

In FIGS. 21 and 22, on the left side of each transmission system storing portion 63, that is, on the deeper side thereof, a supply portion passage port 71 is formed in the side wall U4*c*'. In addition, a discharge portion passage port 72 shaped like a circular hole is formed above and at the rear of each supply portion passage port 71 in the side wall U4*c*'. Above the black discharge portion passage port 72, a combined path storing portion 73 is formed to be convex on the right side, that is, on the front side. In an upper portion of the side wall U4*c*', a body-side hardware key 74 is formed in each color attachment/detachment space U4*d*' as an example of an identification portion for identifying the color of each toner cartridge 60*y*, 60*m*, 60*c*. The shape of the hardware key 74 in one color attachment/detachment space U4*d*' differs from that in another.

In FIGS. 21 and 22, CRUM readers/writers 76 are supported inside the upper guide step portion U4*b*'. Each CRUM reader/writer 76 is an example of an information reader/writer for reading/writing information of the corresponding toner cartridge 60*y* to 60*k* on a recording member by radio communication.

Figure 30B:
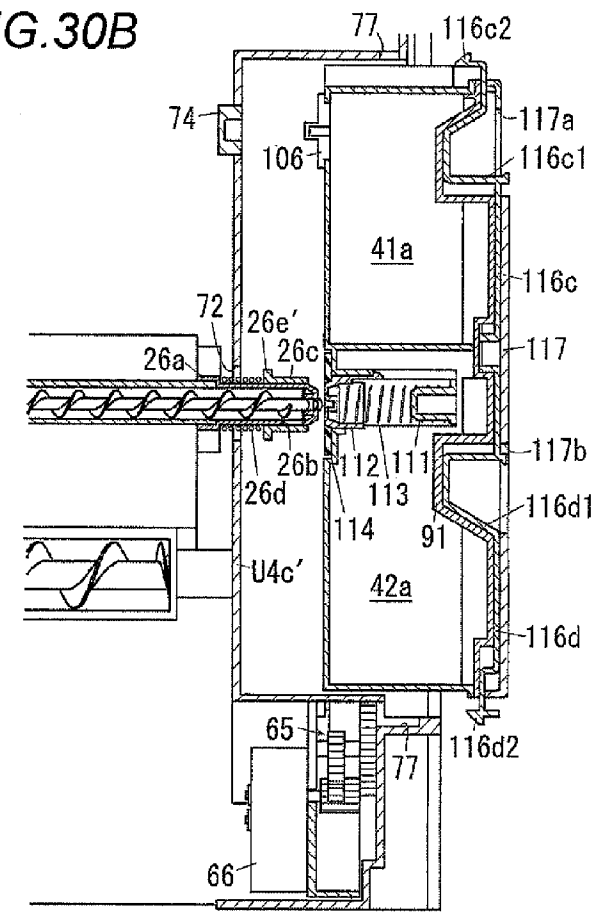
FIGS. 30A-30B are views for explaining the state where each toner cartridge according to the seventh exemplary embodiment is attached/detached, FIG. 30A being a main portion sectional view showing a supply path portion in the state where the toner cartridge has been attached, FIG. 30B being a main portion sectional view showing a recovery inlet portion in the state where the toner cartridge has been attached.
Figure 31B:
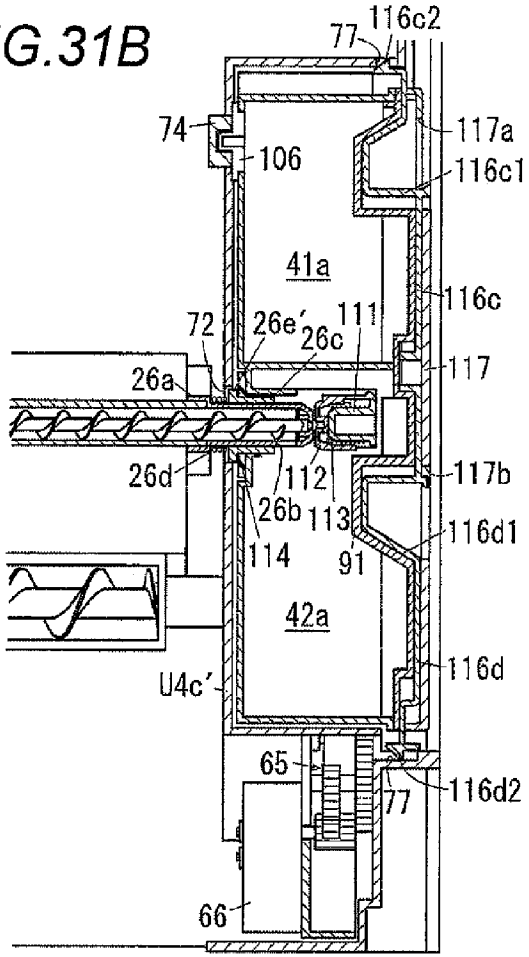
FIGS. 31A-31B are views for explaining the state where the toner cartridge according to the seventh exemplary embodiment is attached/detached, FIG. 31A being a main portion sectional view showing the supply path portion in the state where the toner cartridge has been detached.

In addition, a hooked opening 77 is formed at the rear of each transmission system storing portion 63 on the lower guide step portion U4*a*'. The hooked opening 77 is an example of a holding portion for holding the corresponding toner cartridge 60*y* to 60*k*. Also on the upper guide step portion U4*b*', a hooked opening 77 formed similarly is formed above each hooked opening 77 on the lower guide step portion U4*a*' correspondingly, as shown in FIGS. 30B and 31B.

(Description of Visible Image Forming Unit)

Figure 23A:
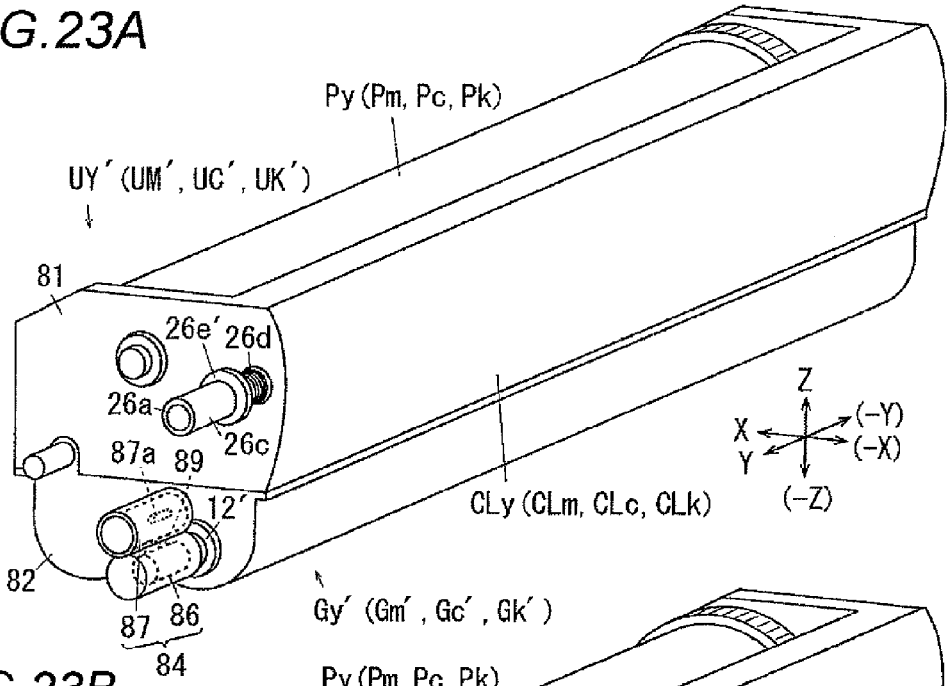
FIGS. 23A-23B are views for explaining a main portion of each visible image forming unit according to the seventh exemplary embodiment, FIG. 23A being a perspective view of each Y, M, C color visible image forming unit, FIG. 23B being a perspective view of a K color visible image forming unit, FIG. 23C being an exploded view for explaining a waste outlet shutter in FIG. 23A.
Figure 23B:
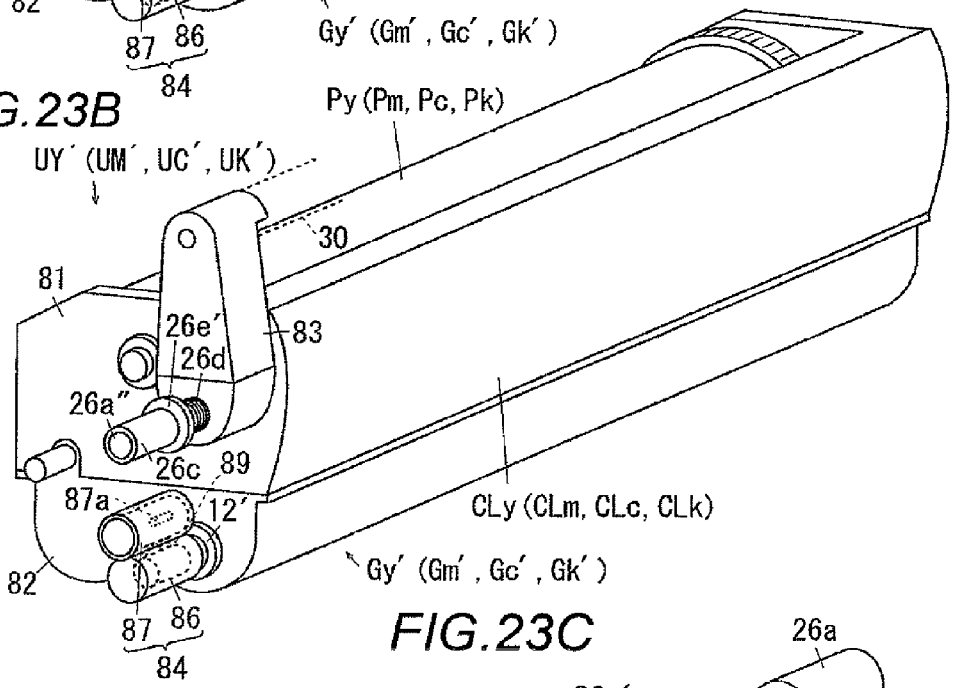
Figure 23C:
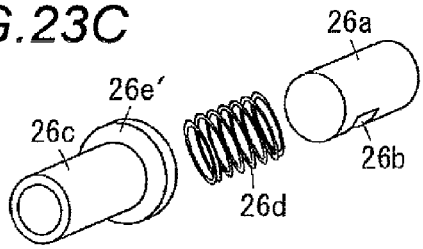

FIGS. 23A-23B are views for explaining a main portion of each visible image forming unit according to the seventh exemplary embodiment. FIG. 23A is a perspective view of each Y, M, C color visible image forming unit. FIG. 23B is a perspective view of a K color visible image forming unit. FIG. 23C is an exploded view for explaining a waste outlet shutter in FIG. 23A.

Figure 24:
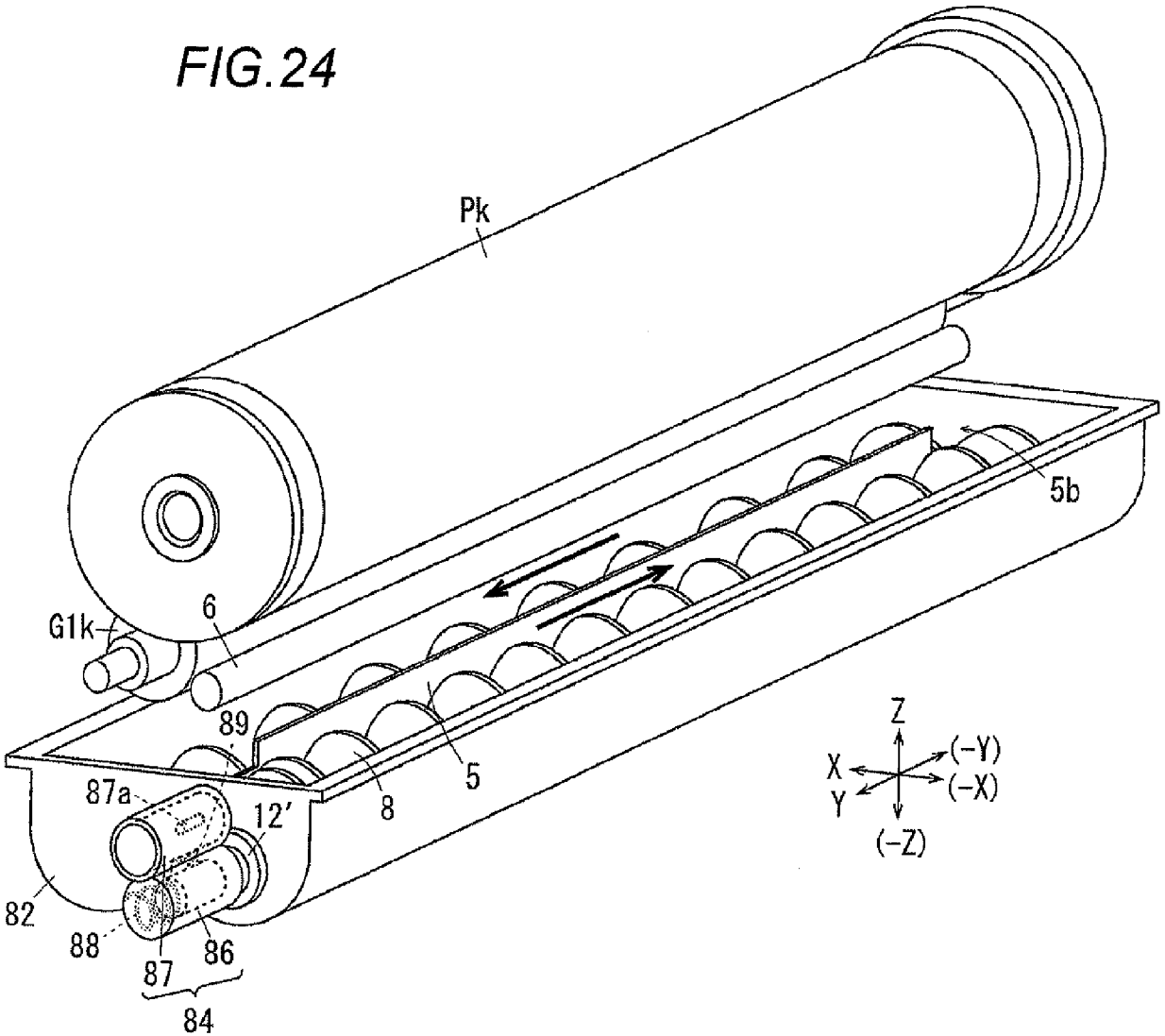
FIG. 24 is a view for explaining a main portion of a developing vessel according to the seventh exemplary embodiment.

FIG. 24 is a view for explaining a main portion of a developing vessel according to the seventh exemplary embodiment.

Figure 25:
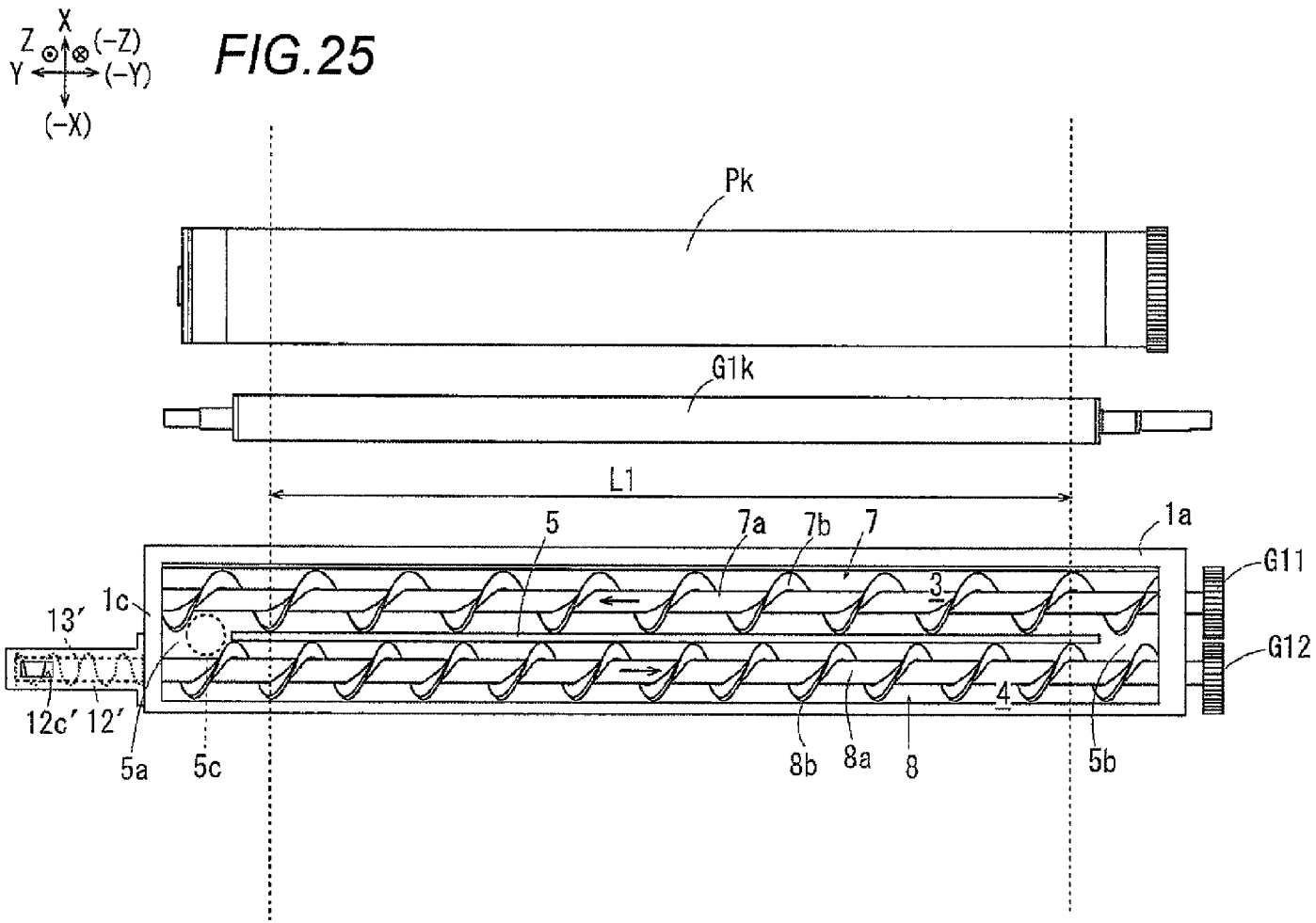
FIG. 25 is a plan view of the developing vessel according to the seventh exemplary embodiment.

FIG. 25 is a plan view of the developing vessel according to the seventh exemplary embodiment.

In FIGS. 23A-23C and 24-25, each visible image forming unit UY' to UK' according to the seventh exemplary embodiment includes an upper frame 81 and a lower frame 82. The upper frame 81 supports the photoconductor Py to Pk, the charging roll CRy to CRk and the LED head LHy to LHk and includes the photoconductor cleaner CLy to CLk internally. The lower frame 82 consists of the developing unit Gy to Gk.

In FIGS. 23A and 23C, a residual developer transport path 26*a* and a residual developer outlet 26*b* configured in the same manner as those in the first exemplary embodiment are provided in the right end surface of the upper frame 81 in each Y, M, C color visible image forming unit UY' to UC'. The residual developer transport path 26*a* penetrates the discharge portion passage port 72 of the cartridge attachment/detachment portion U4'. In the right end portion of the residual developer transport path 26*a*, a cylindrical waste outlet shutter 26*c*' as an example of an outlet closing member is supported movably in the left/right direction. The waste outlet shutter 26*c*' has a flange portion 26*e*' as an example of a collar portion. The waste outlet shutter 26*c*' is urged by a spring 26*d* so as to be moved to and retained in an outlet closing position. The spring 26*d* is an example of an urging member, which is disposed between the flange portion 26*e*' and the right end face of the upper frame 81.

In FIG. 23B, in the K color visible image forming unit UK', a combined path 83 is connected to a K color residual developer transport path 26*a*". The combined path 83 extends in the up/down direction so as to connect a residual developer transport path 30 with the residual developer transport path 26*a*". The residual developer transport path 30 extends from the upper belt cleaner CLb. In FIG. 21, the combined path 83 is stored inside the combined path storing portion 73, that is, on the left side thereof. Thus, the combined path storing portion 73 stores the combined path 83 which is a constituent member of the printer U.

In FIGS. 23A-23C and 24-25, in each developing unit Gy' to Gk' provided in the lower frame 82, the configurations of the supply cylinder portion 12*a* and the supply auger 13 in the first exemplary embodiment have been changed. A supply cylinder portion 12' extending along the axial direction of the rotation shaft 8*a* of the admix auger 8 is supported, and a supply auger 13' is formed in the axially outside end portion of the rotation shaft 8*a* of the admix auger 8. In FIGS. 24 and 25, a supplied developer inlet 12*c*' is formed in the upper face of the end portion of the supply cylinder portion 12'.

In FIGS. 23A-23C and 24-25, an inlet shutter 84 as an example of an inlet closing member is attached to the supply cylinder portion 12'. The inlet shutter 84 in the seventh exemplary embodiment has a lower cylinder portion 86 and an upper cylinder portion 87. The lower cylinder portion 86 fitted into the supply cylinder portion 12' is supported movably in the left and right direction. The upper cylinder portion 87 is formed integrally with an upper portion of the lower cylinder portion 86.

The right end of the lower cylinder portion 86, which is an outer end thereof, is closed by an end wall. A cylinder urging spring 88 as an example of an urging member is mounted between the end wall and the supply cylinder portion 12' inside the lower cylinder portion 86. The lower cylinder portion 86 and the upper cylinder portion 87 are connected through a supply inlet path 89 extending in the up/down direction. Thus, the inlet shutter 84 is supported movably between an opening position and a closing position. When the inlet shutter 84 moves right axially against the elastic force of the cylinder urging spring 88 and reaches the opening position, the supply inlet path 89 and the supplied developer inlet 12*c*' are connected. When the inlet shutter 84 moves axially left from the opening position by the elastic force of the cylinder urging spring 88 and reaches the closing position, the supply inlet path 89 and the supplied developer inlet 12*c*' are displaced from each other.

The left end of the upper cylinder portion 87, which is an inner end thereof, is closed by an end wall. A cooperative opening portion 87*a* shaped like a protrusion extending right from the left end wall is formed inside the upper cylinder portion 87.

(Description of Toner Cartridge)

Figure 26C:
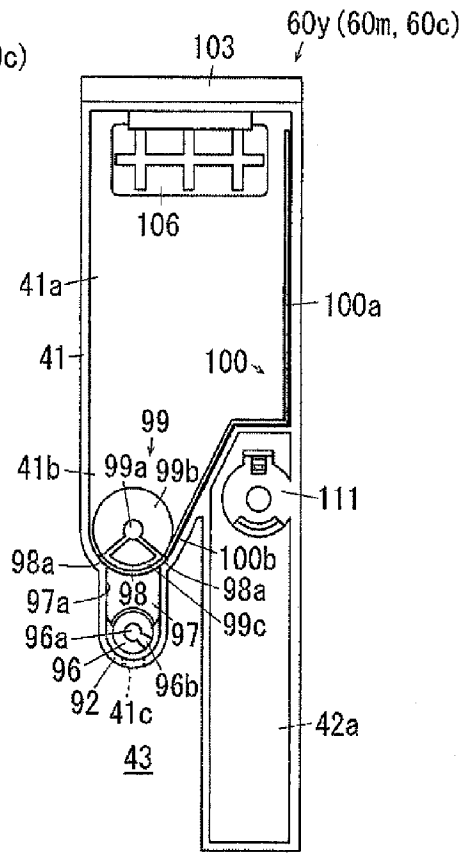
FIGS. 26A-26C are views for explaining a Y, M, C color toner cartridge according to the seventh exemplary embodiment, FIG. 26A being a perspective view in which the Y, M, C color toner cartridge is viewed right obliquely from its front, FIG. 26B being a perspective view in which the Y, M, C color toner cartridge is viewed left obliquely from its rear, FIG. 26C being a sectional view taken on line XXVIX-XXVIC in FIG. 26A.
Figure 26B:
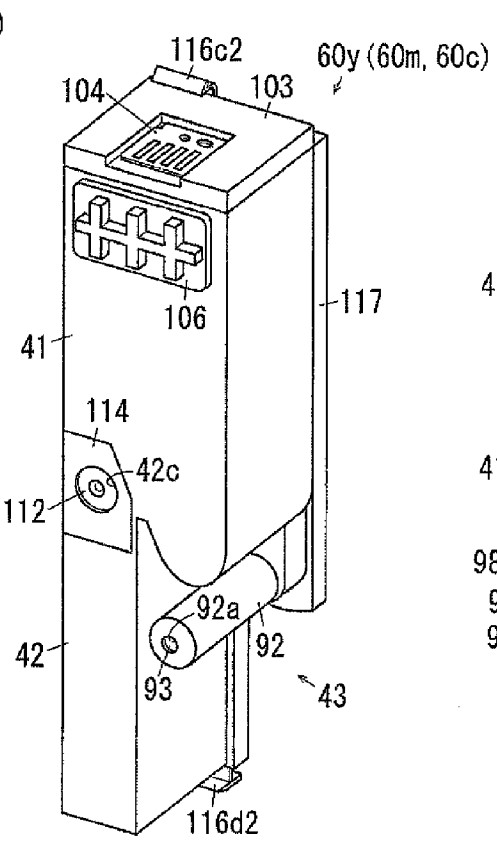
Figure 26A:
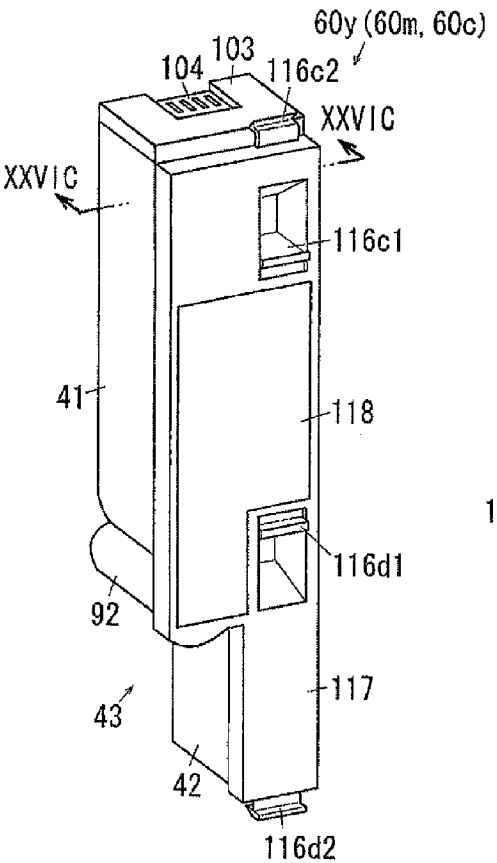

FIGS. 26A-26C are views for explaining each Y, M, C color toner cartridge according to the seventh exemplary embodiment. FIG. 26A is a perspective view in which the Y, M, C color toner cartridge is viewed right obliquely from its front. FIG. 26B is a perspective view in which the Y, M, C color toner cartridge is viewed left obliquely from its rear. FIG. 26C is a sectional view taken on line XXVIC-XXVIC in FIG. 26A.

Figure 27A:
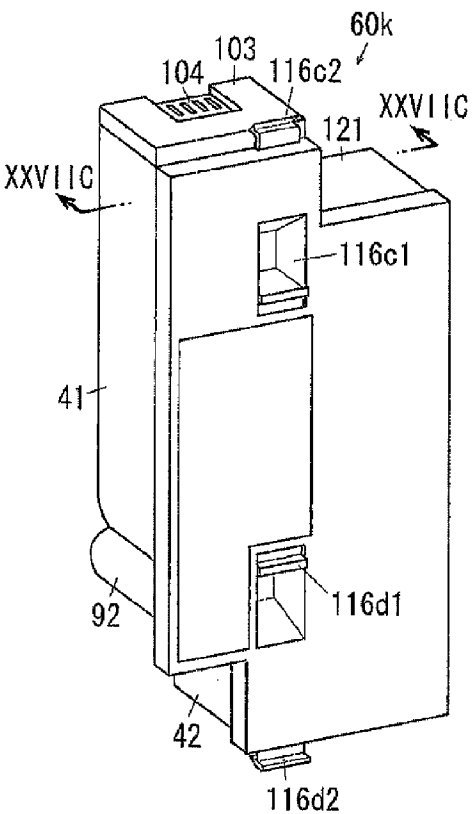
FIGS. 27A-27C are views for explaining the K color toner cartridge according to the seventh exemplary embodiment, FIG. 27A being a perspective view in which the K color toner cartridge is viewed right obliquely from its front, FIG. 27B being a perspective view in which the K color toner cartridge is viewed left obliquely from its rear, FIG. 27C being a sectional view taken on line XXVIIC-XXVIIC in FIG. 27A.
Figure 27B:
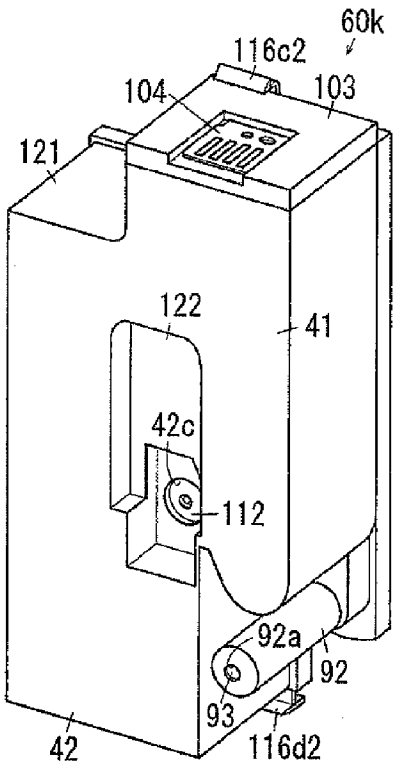
Figure 27C:
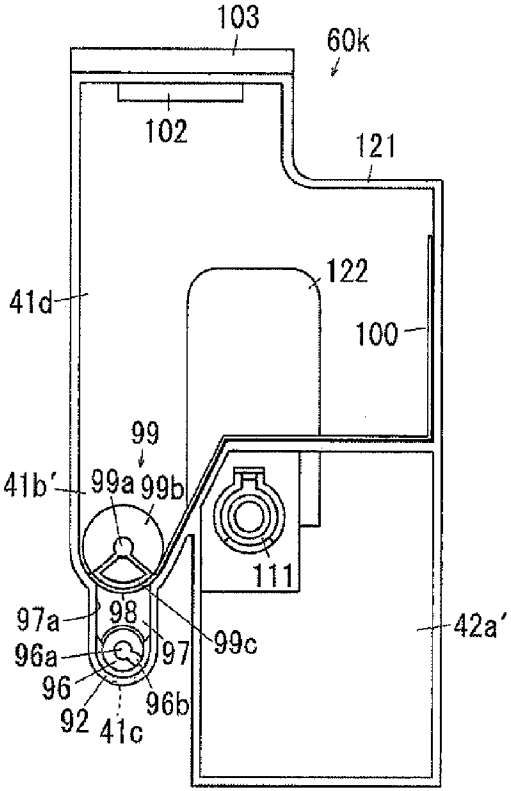

FIGS. 27A-27C are views for explaining the K color toner cartridge according to the seventh exemplary embodiment. FIG. 27A is a perspective view in which the K color toner cartridge is viewed right obliquely from its front. FIG. 27B is a perspective view in which the K color toner cartridge is viewed left obliquely from its rear. FIG. 27C is a sectional view taken on line XXVIIC-XXVIIC in FIG. 27A.

Figure 28:
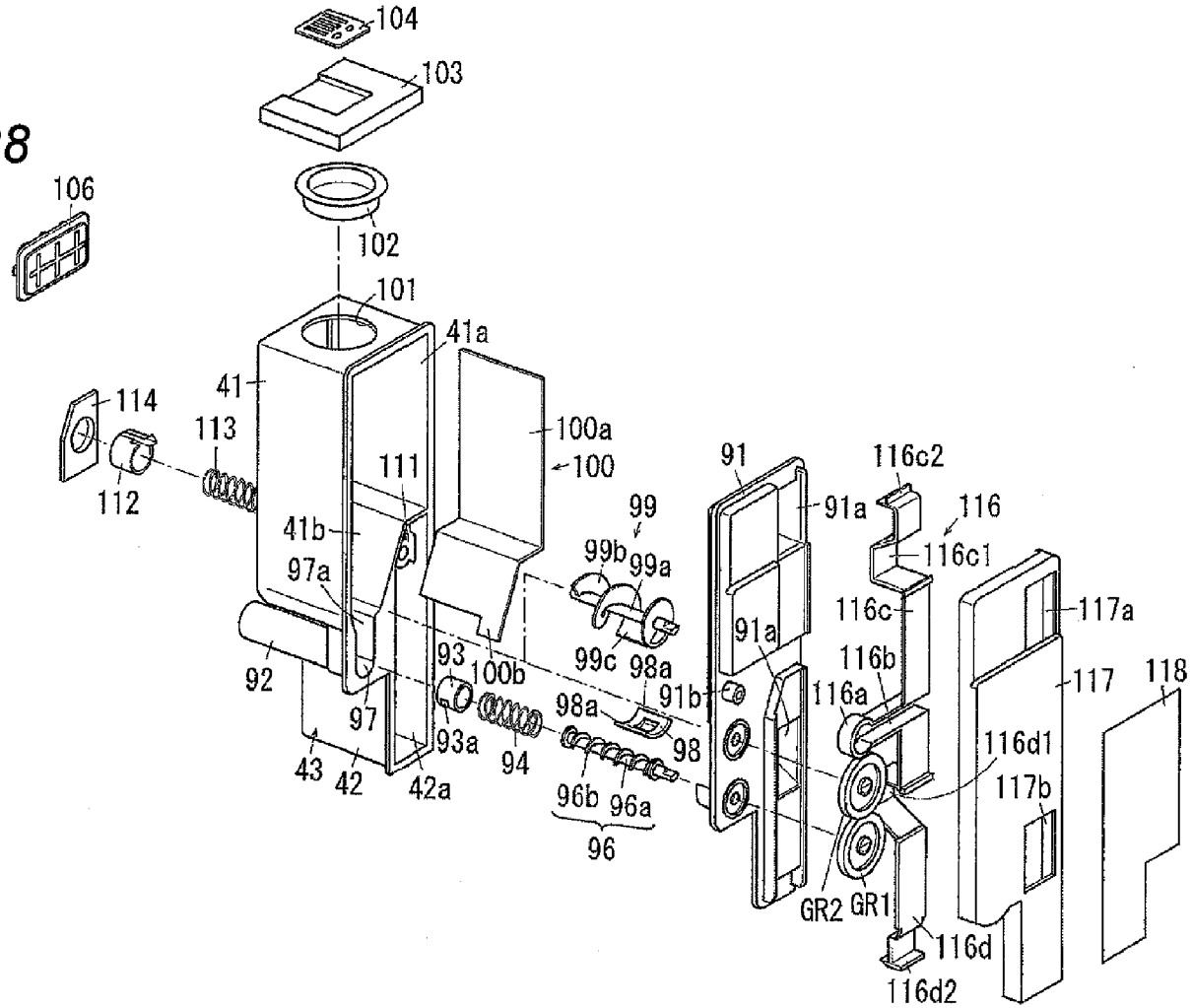
FIG. 28 is an exploded view for explaining the toner cartridge shown in FIGS. 26A-26C.

FIG. 28 is an exploded view for explaining the toner cartridge shown in FIGS. 26A-26C.

Figure 29A:
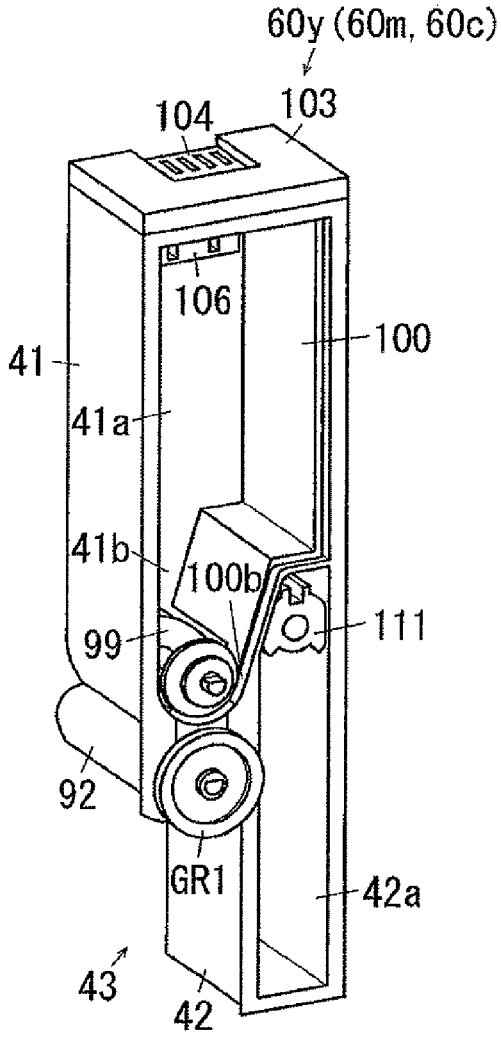
FIGS. 29A-29B are views for explaining a main portion of the toner cartridge shown in FIG. 26A, FIG. 29A being a main portion explanatory view for explaining driving members in the cartridge, FIG. 29B being a main portion explanatory view for explaining unlocking members.
Figure 29B:
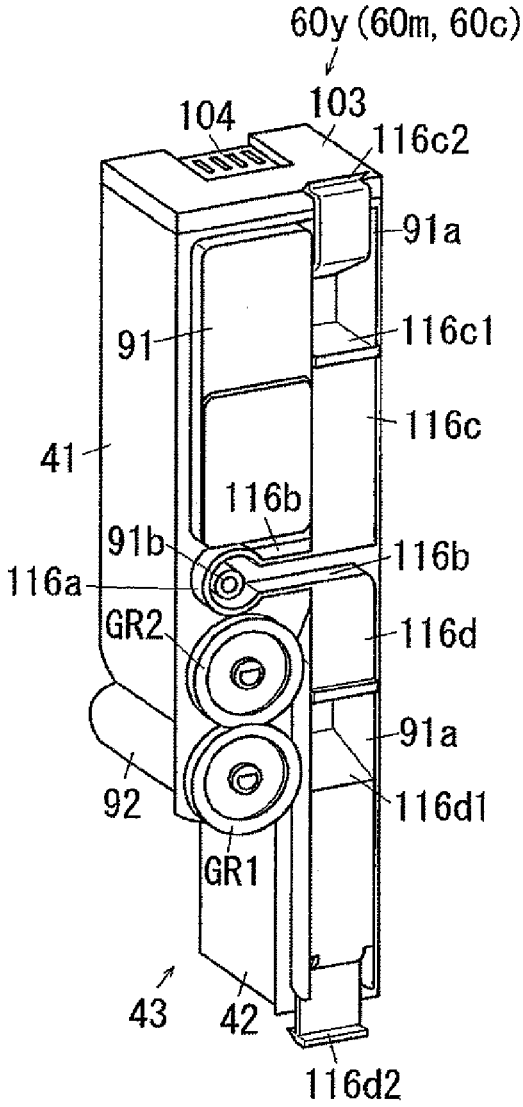

FIGS. 29A-29B are views for explaining a main portion of the toner cartridge shown in FIG. 26A. FIG. 29A is a main portion explanatory view for explaining driving members in the cartridge. FIG. 29B is a main portion explanatory view for explaining unlocking members.

In FIGS. 19, 20, 26A-26C and 27A-27C, each toner cartridge 60*y* to 60*k* according to the seventh exemplary embodiment has a supplied developer storing portion 41 disposed in its upper portion and a residual developer storing portion 42 disposed in its lower portion and extending in the up/down direction, in the same manner as in the fifth exemplary embodiment. In the toner cartridge 60*y* to 60*k* according to the seventh exemplary embodiment, unlike that in the fifth exemplary embodiment, the side plate 44 where the handle 44*a* is formed is omitted, but the supply transmission system storing space 43 is exposed to the outside in accordance with the transmission system storing portion 63. Accordingly, the toner cartridge 60*y* to 60*k* is attached in the state where the transmission system storing portion 63 has been fitted into the supply transmission system storing space 43 adjacent thereto under the sub-supply portion 41*b* and in front of the residual developer recovery portion 42.

(Y, M, C Color Toner Cartridge)

In FIG. 28, in each Y, M, C color toner cartridge 60*y* to 60*c* according to the seventh exemplary embodiment, the right ends of the supplied developer storing portion 41 and the recovered developer storing portion 42 are opened, and a cartridge cover 91 is supported on the right ends. The cartridge cover 91 is an example of a wall member, which closes the right ends of the supplied developer storing portion 41 and the recovered developer storing portion 42. A pair of upper and lower handle storing recess portions 91*a* are formed in the upper end portion rear side and the rear side lower portion of the cartridge cover 91. Each handle storing recess portion 91*a* has a shape sunk left. In addition, a handle support protrusion 91*b* is formed on the front side of a vertically central portion of the cartridge cover 91. The handle support protrusion 91*b* is an example of an operation portion support portion, which protrudes right.

In FIGS. 26A-26C, 28 and 29A-29B, in each Y, M, C color toner cartridge 60*y* to 60*c*, the supplied developer storing portion 41 has a main supply portion 41*a* and a sub-supply portion 41*b* extending downward from the front end portion of the main supply portion, in the same manner as in the first and fifth exemplary embodiments. In FIGS. 26B, 26C, 28 and 29A-29B, a cylindrical supply path 92 extending in the left/right direction is formed under the sub-supply portion 41*b* in the direction of gravity. An open through hole 92*a* shaped like a circular hole is formed in the left end wall of the supply path 92. The cooperative opening portion 87*a* can penetrate the open through hole 92*a*.

A supply outlet 41*c* opened downward is formed in the left portion of the supply path 92, that is, on the deeper side thereof.

In FIG. 28, a cylindrical outlet shutter 93 as an example of an outlet shield member is supported inside the supply path 92. The outlet shutter 93 is supported movably in the left/right direction along the supply path 92. An opening 93*a* corresponding to the supply outlet 41*c* is formed in the outlet shutter 93 according to the seventh exemplary embodiment. The outlet shutter 93 according to the seventh exemplary embodiment is supported movably between a closing position and an opening position. When the outlet shutter 93 is located on the deeper side than the supply outlet 41*c* and reaches the closing position, the supply outlet 41*c* and the opening 93*a* are displaced so that the supply outlet 41*c* can be closed. When the outlet shutter 93 is pushed by the cooperative opening portion 87*a* to move right across the opening position, the supply outlet 41*c* and the opening 93*a* are aligned with each other so that the supply outlet 41*c* can be opened.

A shutter holding spring 94 is stored in the supply path 92. The shutter holding spring 94 is attached between the cartridge cover 91 and the outlet shutter 93 so as to impart a force to the outlet shutter 93 to move the outlet shutter 93 toward the closing position on the deeper side and hold the outlet shutter 93 in the closing position. In the seventh exemplary embodiment, the spring modulus of the shutter holding spring 94 is set to be higher than that of the cylinder urging spring 88, so that the cylinder urging spring 88 can be elastically deformed earlier when a force acts thereon.

In addition, a supply transport member 96 is disposed in the supply path 92. The supply transport member 96 transports developer in the supply path 92 toward the supply outlet 41*c*, that is, from the right to the left. The supply transport member 96 has a rotation shaft 96*a* and a spiral transport blade 96*b*. The rotation shaft 96*a* is supported rotatably at its right end by the cartridge cover 91. The transport blade 96*b* is disposed on the outer circumference of the rotation shaft 96*a*.

In FIGS. 26A-26C, 28 and 29A-29B, a connection path 97 is formed at the right end of the bottom portion of the sub-supply portion 41*b*. The connection path 97 extending in the up/down direction is connected to the right end of the supply path 91. A connection inlet 97*a* to which developer will be flow from the sub-supply portion 41*b* is formed in an upper end of the connection path 97. The bottom portion of the sub-supply portion 41*b* according to the seventh exemplary embodiment is formed so that a portion corresponding to the connection inlet 97*a* is formed in the inner circumferential surface shaped like an arc, and the front end is formed along a tangent extending upward from the arc in the direction of gravity while the rear end is formed along a tangent extending obliquely rearward and upward from the arc.

In FIGS. 27C and 28, a connection port seal 98 as an example of a sealing member is supported around the connection inlet 97*a*. The connection port seal 98 is pasted and supported like an arc along the bottom portion of the sub-supply portion 41*b*. In an outer end portion 98*a* along the arc, the connection port seal 98 is formed to be thinner in a portion closer to the outer end.

In FIGS. 26A-26C, 28 and 29A-29B, a connection transport member 99 is disposed in the bottom portion of the sub-supply portion 41*b*. The connection transport member 99 extending in the front/rear direction transports developer in the sub-supply portion 41*b* toward the connection inlet 97*a*, that is, from the left to the right. The connection transport member 99 has a rotation shaft 99*a* and a spiral transport blade 99*b*. The rotation shaft 99*a* extending in the left/right direction is supported at its right end rotatably on the cartridge cover 91. The transport blade 99*b* is formed integrally with the outer circumference of the rotation shaft 99*a*. An inflow control portion 99*c* consisting of an arc plate extending circumferentially is supported on the transport blade 99*b* and in a position corresponding to the connection inlet 97*a*.

By adjusting and stopping the rotation position of the rotation shaft 99*a*, the inflow control portion 99*c* can be opposed to the connection inlet 97*a* to close the connection inlet 97*a*. Thus, the developer in the sub-supply portion 41*b* flowing into the supply path 92 can be controlled. Accordingly, when new developer is sealed in the state where the connection inlet 97*a* has been closed by the inflow control portion 99*c* before the new developer is supplied, leakage of the developer from the connection inlet 97*a* can be suppressed during its storage, for example, before shipping of each toner cartridge 60*y* to 60*c*. In the background art, such a connection inlet 97*a* is sealed with an adhesive tape or the like. The tape has to be taken off before use. In comparison with the background-art configuration, however, each toner cartridge 60*y* to 60*c* according to the seventh exemplary embodiment can be mounted directly on the printer U without any step of taking off the tape or the like. Thus the convenience can be improved. In addition, it is eco-friendly to suppress waste materials such as the tape taken off or the like.

According to the seventh exemplary embodiment, the axially outer ends of the transport blade 99*b* and the inflow control portion 99*c* can rotate without touching the bottom surface of the sub-supply portion 41*b*. In addition, in the area where the inflow control portion 99*c* is opposed to the connection port seal 98, the inflow control portion 99*e* is set to touch the connection port seal 98 so that the connection port seal 98 can seal the gap between the inflow control portion 99*c* and the connection inlet 97*a*. The outer end portion 98*a* where the connection port seal 98 is thin is disposed outside the rotation trajectory of the inflow control portion 99*c*. Thus, the outer end portion 98*a* is restrained from touching the rotary inflow control portion 99*c* and thereby being separated.

At the right end of the rotation shaft 96*a* of the supply transport member 96, a first driven gear GR1 is supported on the right side of the cartridge cover 91. At the right end of the connection transport member 99, a second driven gear GR2 engaging with the first driven gear GR1 is supported on the right side of the cartridge cover 91. The lower portion of the first driven gear GR1 is exposed downward below the supply path 92. When each toner cartridge 60*y* to 60*c* is mounted in the attachment/detachment space U4*a*', the first driven gear GR1 engages with an exposed portion of the transmission gear 64*y* to 64*c* so that a driving force can be transmitted through the first driven gear GR1. Accordingly, when the cartridge motor 66, 68 is driven, a driving force is transmitted through the transmission gear 64*y* to 64*c* so that the supply transport member 96 and the connection transport member 99 can be driven.

In FIGS. 28 and 29A, an agitation paddle 100 as an example of an agitation member is disposed in the supplied developer storing portion 41 so as to extend along the rear face of the main supply portion 41*a* from the rear slope of the sub-supply portion 41*b* inclined upward. The agitation paddle 100 has a plate-like paddle body 100*a* and a tongue-like contact drive portion 100*b*. The paddle body 100*a* extends along the rear faces of the sub-supply portion 41*b* and the main supply portion 41*a*. The contact drive portion 100*b* extends from the lower end right side of the paddle body 100*a* toward the connection transport member 99. Accordingly, with the rotation of the connection transport member 99, the contact drive portion 100*b* of the agitation paddle 100 touches and leaves the rotating spiral transport blade 99*b* or the arc inflow control portion 99*c* so that the agitation paddle 100 reciprocates in the up/down direction. Thus, developer in the rear portion of the main supply portion 41*a* is agitated due to the up/down reciprocating motion of the agitation paddle 100 so as to be urged to move toward the sub-supply portion 41*b*.

In FIGS. 26A-26C and 28, a supply port 101 shaped like a circular hole is formed on the upper end of the main supply portion 41*a*. A cartridge cap 102 as an example of a supply port closing member is removably attached to the supply port 101. Accordingly, when the cartridge cap 102 is removed, new developer can be supplied into the supplied developer storing portion 41.

An upper end cover 103 as an example of an upper end member is supported on the top of the cartridge cap 102. A CRUM (Customer Replaceable Unit Memory) 104 as an example of an information storage member for storing information about the toner cartridge 60*y* to 60*c* is supported on the upper end cover 103. A board using a relationally known RFID (Radio Frequency Identification) technique can be used as the CRUM 104. The color of stored developer, the cumulative number of prints, information for checking whether developer has been used up or not, etc. are stored as information about the toner cartridge 60*y* to 60*c*. The information is read and written by radio communication between the CRUM reader/writer 76 and the CRUM 104 which is attached to the cartridge attachment/detachment portion U4'.

A cartridge hardware key 106 is supported on the left outer surface of the upper end of the main supply portion 41*a*, that is, on the deeper outer surface thereof. The cartridge hardware key 106 is an example of an identified portion corresponding to the body-side hardware key 74. The cartridge hardware key 106 for one color differs from that for another color in accordance with a corresponding one of the body-side hardware keys 74 which differ from one to another in accordance with the colors. When the color of the cartridge hardware key 106 agrees with the color of the body-side hardware key 74, their protrusion portion and recess portion are fitted into each other so that the toner cartridge 60*y* to 60*c* can be stored in the attachment/detachment space U4*d*'. When the colors does not agree with each other, the protrusion portion interferes so that the toner cartridge 60*y* to 60*c* cannot be stored into the deeper portion of the attachment/detachment space U4*d*'. Thus, each toner cartridge 60*y* to 60*c* can be identified.

In FIGS. 26A-26C, 28 and 29A-29B, a recovered developer storing portion 42 according to the seventh exemplary embodiment consists of the main recovery portion 42*a* disposed at the rear of the sub-supply portion 41*b*, and the sub-recovery portion 42*b* in the first exemplary embodiment is omitted. In FIG. 26B, a recovery inlet 42*c* is formed in the left face of the upper end of the main recovery portion 42*a*. In FIGS. 28 and 29A, a cylindrical shutter support portion 111 as an example of a shield support portion is formed in the main recovery portion 42*b*. The shutter support portion 111 extends right from the recovery inlet 42*c*. The lower surface of the shutter support portion 111 is made open. Developer can pass the lower surface of the shutter support portion 111.

A cylindrical inlet shutter 112 as an example of an inlet shield member is supported on the shutter support portion 111 movably in the left/right direction. The inlet shutter 112 is closed at its left end. Accordingly, the inlet shutter 112 is supported movably in the left/right direction between a closing position and an opening position. In the closing position, the inlet shutter 112 closes the recovery inlet 42*c*. When the inlet shutter 112 moves right from the closing position, the inlet shutter 112 opens the recovery inlet 42*c* in the opening position.

In addition, a shutter urging spring 113 for urging the inlet shutter 112 left toward the closing position is supported inside the shutter support portion 111.

As shown in FIG. 26B, a seal 114 is supported on the left outer surface of the recovered developer storing portion 42. The seal 114 is an example of a leakage preventing member, which surrounds the recovery inlet 42*c*.

In FIGS. 28 and 29B, a handle 116 as an example of an operation member is disposed on the right side face of the cartridge cover 91. The handle 116 has a supported portion 116*a* like an arc, a pair of upper and lower coupling portions 116*b*, an upper handle portion 116*c*, and a lower handle portion 116*d*. The supported portion 116*a* is supported on the handle support protrusion 91*b*. The coupling portions 116*b* extend rearward from the opposite upper and lower ends of the supported portion 116*a* respectively. The upper handle portion 116*c* extends upward from the rear end of the upper coupling portion 116*b*. The lower handle portion 116*d* extends downward from the rear end of the lower coupling portion 116*b*. An upper grip portion 116*e*1 is formed on the upper handle 116*c*. The upper grip portion 116*c*1 is stored in the upper handle storing recess portion 91*a*. In the upper end of the upper handle 116*c*, an upper lock claw 116*c*2 is formed as an example of a locking portion, which protrudes upward correspondingly to the upper hooked opening 77. A lower grip portion 116*d*1 is formed on the lower handle 116*d*. The lower grip portion 116*d*1 is stored in the lower handle storing recess portion 91*a*. In the lower end of the lower handle 116*d*, a lower lock claw 116*d*2 is formed as an example of a locking portion, which protrudes downward correspondingly to the lower hooked opening 77.

The handle 116 according to the seventh exemplary embodiment is formed integrally out of resin as an example of an elastic material. When an operator pinches and holds the grip portions 116*c*1 and 116*d*1 from above and below, the handle 116 is elastically deformed around the supported portion 116*a* so that the lock claws 116*c*2 and 116*d*2 can be retracted inward.

In FIGS. 26A-26C and 28, a plate-like gear cover 117 is supported on the right of the handle 116. The gear cover 117 is an example of a gear protection member, which is formed into a shape similar to that of the cartridge cover 91. A pair of upper and lower finger passage ports 117*a* as examples of operation ports are formed in the gear cover 117 correspondingly to the handle storing recess portions 91*a*. Thus, the grip portions 116*c*1 and 116*d*1 of the handle 116 can be operated from the outside of the gear cover 117.

An explanatory seal 118 is pasted on the outside surface of the gear cover 117. The explanatory seal 118 is an example of an information description member, in which information about a stored color, a corresponding model, etc. is described.

(Black Toner Cartridge)

The black toner cartridge 60*k* according to the seventh exemplary embodiment is configured in the same manner as the Y, M and C color toner cartridges 60*y* to 60*c*, except the following points. Constituent members of the black toner cartridge 60*k* the same as those of the Y, M and C color toner cartridges 60*y* to 60*c* are referred to by the same numerals, and detailed description thereof will be omitted.

In FIGS. 27A-27C, the toner cartridge 60*k* according to the seventh exemplary embodiment is formed so that the main supply portion 41*a*' is longer in width in the front/rear direction than the main supply portion 41*a* of any other color. Accordingly, the capacity for storing developer in the supplied black developer storing portion 41 is made larger than the capacity for storing developer in the supplied developer storing portion 41 of any other color.

In addition, the main recovery portion 42*a*' is also formed to be longer in width in the front/rear direction than the main recovery portion 42*a* of any other color. Accordingly, the capacity of the recovered black developer storing portion 42 is made larger than that of the recovered developer storing portion 42 of any other color so that the recovered black developer storing portion 42 can store developer from the belt cleaner CLb as well as developer from the black photoconductor cleaner CLk which is used often.

A configuration recess portion 121 is formed on the top rear end portion of the main supply portion 41*a*' correspondingly to the protrusion portion 61 for storing a lower-side front portion of the fixing unit F. The protrusion portion 61 where a part of the fixing unit F has been stored can be disposed in the configuration recess portion 121.

In addition, an inflow recess portion 122 is formed on the left side of the toner cartridge 60*k*, that is, on the deeper side wall thereof. The inflow recess portion 122 is formed into a shape depressed inside the main supply portion 41*a*' so that the combined path storing portion 73 can be fitted into the inflow recess portion 122 when the toner cartridge 60*k* is attached to the attachment/detachment space U4*d*'. The inflow recess portion 122 extends in the up/down direction from the main supply portion 41*a*' to the main recovery portion 42*a*'.

Accordingly, in the seventh exemplary embodiment, the black toner cartridge 60*k* where the inflow recess portion 122 is formed can be easily distinguished from the other color toner cartridges 60*y* to 60*c* in each of which the inflow recess portion 122 is not formed. Thus, false recognition and false attachment can be prevented. Further, even if any other color toner cartridge 60*y* to 60*c* is going to be attached into the black attachment/detachment space U4*d*' accidentally, the other color toner cartridge 60*y* to 60*c* where the inflow recess portion 122 is not formed interferes with the combined path storing portion 73. Thus, the toner cartridge 60*y* to 60*c* cannot be attached into the black attachment/detachment space U4*d*'. False attachment is prevented also mechanically. Therefore, according to the seventh exemplary embodiment, a member for distinguishing black from any other color, that is, the hardware key 106 is omitted so that the expense required for the hardware key 106 can be reduced. The black hardware key can be omitted, but may be provided.

In addition, in the black toner cartridge 60*k* according to the seventh exemplary embodiment, the supply port 101 standardized with the supply ports 101 of the other colors is formed, and the cartridge cap 102 is also standardized.

Operation of Seventh Exemplary Embodiment

Figure 30A:
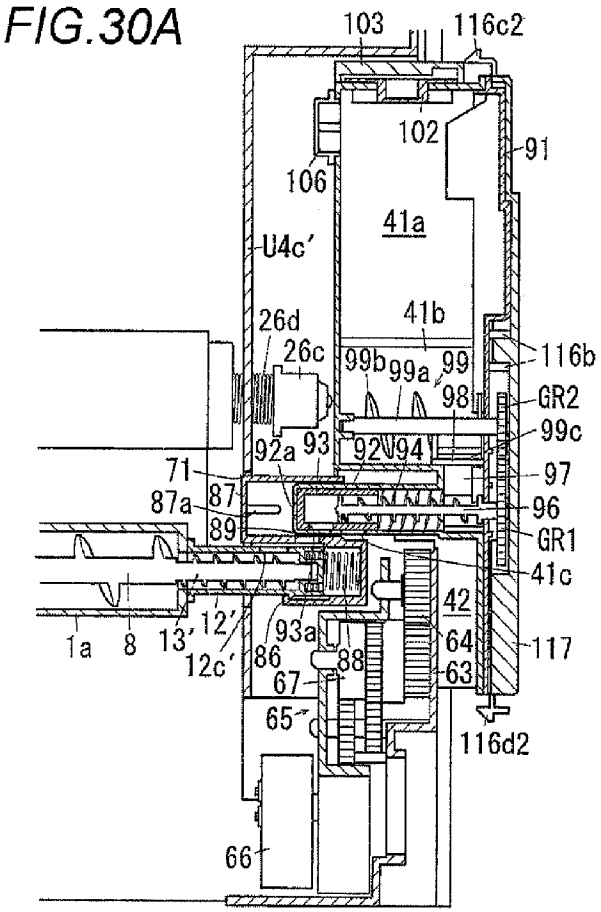

FIGS. 30A and 30B are views for explaining the state where each toner cartridge according to the seventh exemplary embodiment is attached/detached. FIG. 30A is a main portion sectional view showing a supply path portion in the state where the toner cartridge has been attached. FIG. 30B is a main portion sectional view showing a recovery inlet portion in the state where the toner cartridge has been attached.

Figure 31A:
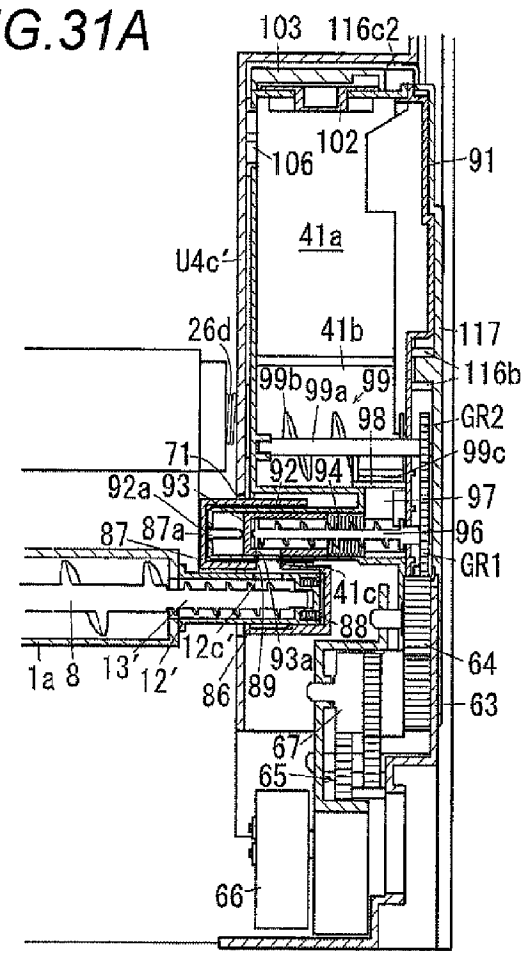

FIGS. 31A and 31B are views for explaining the state where the toner cartridge according to the seventh exemplary embodiment is attached/detached. FIG. 31A is a main portion sectional view showing the supply path portion in the state where the toner cartridge has been detached. FIG. 31B is a main portion sectional view showing the recovery inlet portion in the state where the toner cartridge has been detached.

In the printer U according to the seventh exemplary embodiment configured thus, when developer in the supplied developer storing portion 41 becomes empty because the developer has been used up due to image formation, the toner cartridge 60*y* to 60*k* is replaced with a new one.

When the toner cartridge 60*y* to 60*k* is detached in the state where it has been attached as shown in FIGS. 30A and 30B, the operator pinches the grip portions 116*c*1 and 116*d*1 of the handle 116 from above and below The lock claws 116*c*2 and 116*d*2 are retracted inward and detached from the hooked openings 77. Thus, the lock claws 116*c*2 and 116*d*2 are released from being locked in the hooked openings 77.

When the toner cartridge 60*y* to 60*k* is pulled out to the right in the state where the lock claws 116*c*2 and 116*d*2 have been released from being locked, the outlet shutter 93 moves to the closing position on the left end deeper side due to the shutter holding spring 94 in the toner cartridge 60*y* to 60*k* as shown in FIG. 31A. Thus, the supply outlet 41*c* is closed. At the same time, the inlet shutter 112 moves to the closing position on the left end deeper side due to the shutter urging spring 113. Thus, the recovery inlet 42*c* is closed.

In addition, when the toner cartridge 60*y* to 60*k* is detached, the inlet shutter 84 on the printer U side moves right to the closing position due to the cylindrical urging spring 88 as shown in FIG. 31A. Thus, the supplied developer inlet 12*c* is closed. At the same time, the waste outlet shutter 26*c*' moves right to the outlet closing position as shown in FIG. 31B. Thus, the residual developer outlet 26*b* is closed.

In FIGS. 30A-30B and 31A-31B, assume that the toner cartridge 60*y* to 60*k* moves to turn from the state shown in FIGS. 31A-31B to the state shown in FIGS. 30A-30B. In this case, in the supply path shown in FIGS. 30A and 31A, the cooperative opening portion 87*a* penetrates the open through hole 92*a* and touches the outlet shutter 93. When the toner cartridge 60*y* to 60*k* is further pushed to the left in this state, the cylindrical urging spring 88 is elastically deformed earlier than the shutter holding spring 94. As a result, the inlet shutter 84 on the body side of the printer U begins to move from the closing position to the opening position. Thus, due to the movement of the inlet shutter 84 to the opening position, the body-side supplied developer inlet 12*c*' is opened earlier than the supply outlet 41*c*.

Then, when the inlet shutter 84 having moved to the opening position cannot move further, the shutter holding spring 94 is elastically deformed. As a result, the outlet shutter 93 begins to move from the closing position to the opening position. Then, when the outlet shutter 93 reaches the opening position, the supplied developer outlet 41*c* on the toner cartridge 60*y* to 60*k* side is opened to turn into the state shown in FIG. 30A. In this state, the supply path 92 is connected to the supply cylinder portion 12' so that developer can flow from the supplied developer storing portion 41 to the developing unit Gy to Gk.

In the waste path shown in FIGS. 30B and 31B, when the toner cartridge 60*y* to 60*k* moves left in the state shown in FIG. 31B, the front end of the residual developer transport path 26*a* on the body side of the printer U touches the inlet shutter 112 on the toner cartridge 60*y* to 60*k* side.

When the toner cartridge 60*y* to 60*k* is pushed left in this state, the flange portion 26*e*' of the waste outlet shutter 26*c*' touches the edge of the recovery inlet 42*c*. With the movement of the toner cartridge 60*y* to 60*k*, the waste outlet shutter 26*c*' moves to the outlet opening position at the rear thereof. On this occasion, the inlet shutter 112 is pushed by the front end of the residual developer transport path 26*a* so as to move right relatively to the recovery inlet 42*c*. When the toner cartridge 60*y* to 60*k* is then pushed to turn into the state shown in FIG. 30B, the residual developer transport path 26*a* sticks into the recovered developer storing portion 42 so that developer can drop down into the recovered developer storing portion 42 from the residual developer outlet 26*b*.

In this state, the lock claws 116*c*2 and 116*d*2 are elastically deformed inward, and then fitted into the hooked openings 77. Thus, the lock claws 116*c*2 and 116*d*2 are locked in the hooked openings 77 to restrict the movement of the toner cartridge 60*y* to 60*k*.

In addition, the printer U according to the seventh exemplary embodiment 7 has similar operations to those of the printer U according to the first or fifth exemplary embodiment.

(Modifications)

The exemplary embodiments of the invention have been described above in detail. The invention is not limited to the exemplary embodiments, but various modifications can be made on the invention within the scope of the gist of the invention stated in the appending claims. Modifications (H01) to (H09) of the invention will be described below by way of example.

(H01) Each of the aforementioned exemplary embodiments has been described on a printer as an image forming apparatus by way of example. The invention is however not limited thereto but can be applied to a facsimile machine, a copying machine, or a composite machine provided with all of or plural of those functions of the facsimile machine and the copying machine. In addition, the invention is not limited to a color image forming apparatus, but can be applied to a monochrome image forming apparatus.

(H02) Each of the aforementioned exemplary embodiments has been described on a configuration in which an intermediate transfer belt is used as an intermediate transfer body. The invention is however not limited to the configuration, but can be applied to a configuration in which an intermediate transfer drum is used. In addition, a transfer unit having an intermediate transfer belt has been shown as the transfer unit. The invention is not limited to the configuration. For example, a configuration may be made in such a manner that the intermediate transfer body is omitted and toner images are transferred directly from the photoconductors Py to Pk onto the recording sheet S as an object to be transferred.

(H03) In each of the aforementioned exemplary embodiments, the charger cleaners CCy to CCk may be omitted.

(H04) The fourth exemplary embodiment has been described on a configuration where developer recovered by the belt cleaner CLb is accumulated. The invention is however not limited to the configuration. A configuration may be made in such a manner that the recovered developer is transported and recovered into a recovery vessel as a separate vessel or into the nearest Y color toner cartridge TCy, in the same manner as in the first to third exemplary embodiments.

(H05) In each of the aforementioned exemplary embodiments, it is desired to make the capacity of the black toner cartridge large as illustrated. The invention is however not limited thereto. The black toner cartridge may have the same capacity as that of any other color toner cartridge. In this case, the shapes of the toner cartridges may be standardized.

(H06) In the sixth exemplary embodiment, the agitation spring 53 is provided in the supplied developer storing portion 41. However, the agitation spring 53 may be provided in the waste developer recovery portion 42. In addition, the shape of the agitation member is not limited to the spring shape but may be formed into any shape such as a blade, a so-called paddle, or the like.

(H07) In each of the aforementioned exemplary embodiments, it is desired to locate the handle 44*a* in the position illustrated in the exemplary embodiment. However, the handle 44*a* may be located in any position in accordance with design, specification, etc. The shape of the handle 44*a* may be also formed into any shape.

(H08) Each of the aforementioned exemplary embodiments has been described on a configuration where the residual developer transport path 26*a* is inserted into the recovery inlet 42*c* and connected thereto, by way of example. The invention is however not limited to the configuration. A connection structure known in the background art, for example a configuration where a recovery inlet is formed to be open in the upper surface of the sub-recovery portion 42*b* and the residual developer transport path is connected to the upper side of the recovery inlet.

(H09) Each of the aforementioned exemplary embodiments has been described on a configuration where the sub-supply portion 41*b* has a funnel-like shape, by way of example. The invention is not limited to the configuration. The sub-supply portion 41*b* may be formed into any shape if the horizontal width, that is, one or both of the widths in the front/rear direction and the left/right direction is smaller than that of the main supply portion 41*a*.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A developer storing vessel comprising:

a supplied developer storing portion including:

a first supply storing portion in which a developer to be supplied to a developer unit is stored;

a second supply storing portion which is provided under the first supply storing portion and formed with a horizontal width narrower than that of the first supply storing portion; and a supply outlet from which the developer stored in the second supply storing portion flows out; and a recovered developer storing portion including:

a recovery inlet which is disposed above the supply outlet in a direction of gravity, in a position displaced therefrom horizontally and within the horizontal width of the first supply storing portion, and from which recovered developer flows in; and a recovery storing portion which is provided under the recovery inlet and in which the developer flowing from the recovery inlet is stored, wherein the recovery storing portion is adjacent to the second supply storing portion in a direction of the horizontal width of the second supply storing portion.

2. The developer storing vessel according to claim 1, wherein the recovery inlet is disposed adjacent to a vicinity of a boundary portion between the first supply storing portion and the second supply storing portion.

3. The developer storing vessel according to claim 1, wherein:

the second supply storing portion extends downward from one horizontal end of the first supply storing portion; and the recovery storing portion extends in a vertical direction adjacently to the second supply storing portion.

4. The developer storing vessel according to claim 1, further comprising:

a space which is formed under the second supply storing portion and horizontally adjacent to the recovery storing portion, and in which constituent members of an image forming apparatus to be mounted with the developer storing vessel are disposed.

5. The developer storing vessel according to claim 1, wherein:

the supplied developer storing portion stores a black developer, and the first supply storing portion is formed with a horizontal width longer than that of a first supply storing portion of a supplied developer storing portion for storing developer of any other color than black; and an inflow recess portion is formed into a shape depressed on an inner space side where the developer of the supplied developer storing portion and the developer of the recovered developer storing portion are stored, and the recovery inlet is formed in the inflow recess portion.

6. The developer storing vessel according to claim 5, further comprising:

a configuration recess portion which is formed in a horizontal end portion of an upper end portion of the first supply storing portion for the black developer, and in which constituent members of an image forming apparatus to be mounted with the developer storing vessel are disposed.

7. The developer storing vessel according to claim 1, further comprising:

a supply port which is formed in an upper end surface of the first supply storing portion and from which a developer to be supplied is supplied into the supplied developer storing portion; and a supply port closing member which is attached to the supply port and which closes the supply port.

8. The developer storing vessel according to claim 7, wherein the supply port is formed in the first supply storing portion for a black developer, and formed into the same shape as that of a supply port formed in a first supply storing portion for any other color developer.

9. The developer storing vessel according to claim 1, further comprising:

a supply path which is formed in a lower end of the second supply storing portion in the direction of gravity, and which extends in a depth direction perpendicular to the direction of gravity and a width direction;

the supply outlet which is formed in an end portion of the supply path in the depth direction;

a supply transport member which is disposed in the supply path and which transports the developer toward the supply outlet;

a connection path which is connected to an upstream side in a transport direction of the developer in the supply path, and which allows the developer to flow in the direction of gravity;

a connection inlet which is formed above the connection path and which allows the developer to flow into the connection path; and a connection transport member which is disposed in the second supply storing portion and transports the developer toward the connection inlet, wherein the connection transport member includes: a rotation shaft, a transport blade on the rotation shaft, an inflow control portion in a position of the rotation shaft corresponding to the connection inlet, and closing the connection inlet and restricting inflow of the developer when the rotation shaft stops to be opposed to the connection inlet.

10. The developer storing vessel according to claim 9, further comprising:

a sealing member which is disposed around the connection inlet and which contacts with the inflow control portion to seal a gap between the inflow control portion and the connection inlet, a remoter end portion of the sealing member from the connection inlet being disposed outside a rotation trajectory of the inflow control portion rotating with rotation of the connection transport member.

11. The developer storing vessel according to claim 9, further comprising:

an agitation member which includes a contact drive portion that contacts with and leaves the transport blade or the inflow control portion, and which is disposed in the first supply storing portion so as to reciprocate in contact with the inflow control portion or the transport blade with rotation of the connection transport member to thereby agitate the developer.

12. An image forming apparatus comprising:

an image retainer which rotates while retaining an image on a surface thereof;

a developing unit which develops a latent image on the surface of the image retainer into a visible image;

a transfer unit which is disposed to be opposed to the surface of the image retainer, and which transfers the visible image on the surface of the image retainer to a to-be-transferred object in a transfer area where the transfer unit is opposed to the surface of the image retainer;

an image retainer cleaner which recovers and cleans residual developer on the image retainer; and a developer storing vessel which includes a supplied developer storing portion for storing developer to be supplied to the developing unit, and a recovered developer storing portion for storing the developer recovered by the image retainer cleaner;

wherein the supplied developer storing portion includes:

a first supply storing portion in which a developer to be supplied to a developer unit is stored;

a second supply storing portion which is provided under the first supply storing portion and formed with a horizontal width narrower than that of the first supply storing portion; and a supply outlet from which the developer stored in the second supply storing portion flows out; and wherein the recovered developer storing portion includes:

a recovery inlet which is disposed above the supply outlet in a direction of gravity, in a position displaced therefrom horizontally and within the horizontal width of the first supply storing portion, and from which recovered developer flows in, and a recovery storing portion which is provided under the recovery inlet and in which the developer flowing from the recovery inlet is stored, wherein the recovery storing portion is adjacent to the second supply storing portion in a direction of the horizontal width of the second supply storing portion.

13. An image forming apparatus comprising:

a plurality of image retainers which rotate while retaining an image on a surface thereof;

a plurality of developing units which develop a latent image on the surface of the plurality of image retainers into a visible image;

a transfer unit which is disposed to be opposed to the surface of the plurality of image retainers, and which transfers the visible image on the surface of the plurality of image retainers to a to-be-transferred object in a transfer area where the transfer unit is opposed to the surface of the plurality of image retainers;

a plurality of image retainer cleaners which recover and clean residual developer on the plurality of image retainers; and a plurality of developer storing vessels which include a supplied developer storing portion for storing developer to be supplied to the plurality of developing units, and a recovered developer storing portion for storing the developer recovered by the plurality of image retainer cleaners;

wherein at least one of the plurality of developer storing vessels includes:

the supplied developer storing portion including:

a first supply storing portion in which a developer to be supplied to a developer unit is stored;

a second supply storing portion which is provided under the first supply storing portion and formed with a horizontal width narrower than that of the first supply storing portion; and a supply outlet from which the developer stored in the second supply storing portion flows out; and the recovered developer storing portion including:

a recovery inlet which is disposed above the supply outlet in a direction of gravity, in a position displaced therefrom horizontally and within the horizontal width of the first supply storing portion, and from which recovered developer flows in, and a recovery storing portion which is provided under the recovery inlet and in which the developer flowing from the recovery inlet is stored, wherein the plurality of developing units are provided for storing different color developers respectively, wherein the plurality of image retainers, the plurality of image retainers cleaners and the plurality of developer storing vessels are provided correspondingly to the plurality of developing units, and wherein the recovery storing portion is adjacent to the second supply storing portion in a direction of the horizontal width of the second supply storing portion.

14. The image forming apparatus according to claim 13, wherein:

the plurality of developer storing vessels include a black developer storing vessel for storing a black developer, and other color developer storing vessels for storing developers of other colors than black; and the supplied developer storing portion of the black developer storing vessel is formed to have an internal volume larger than that of the supplied developer storing portion of any other color developer storing vessel.

15. The image forming apparatus according to claim 14, wherein:

the transfer unit includes:

an intermediate transfer body that rotates while contacting with the plurality of image retainers in turn;

a primary transfer unit that is disposed correspondingly to the plurality of image retainers respectively and transfers visible images on surfaces of the plurality of image retainers to a surface of the intermediate transfer body; and a secondary transfer unit that transfers the visible images on the surface of the intermediate transfer body to the to-be-transferred object;

an intermediate transfer body cleaner recovers and cleans residual developers on the surface of the intermediate transfer body after transferring with the secondary transfer unit; and the developer recovered by the black image retainer cleaner and the developer recovered by the intermediate transfer body cleaner are stored in the recovered developer storing portion of the black developer storing vessel.

16. A developer storing vessel comprising:

a supplied developer storing portion including:

a first supply storing portion in which a developer to be supplied to a developer unit is stored;

a second supply storing portion which is provided under the first supply storing portion, which is formed with a horizontal width narrower than that of the first supply storing portion and in which the developer stored in the first supply storing portion moves; and a supply outlet from which the developer stored in the second supply storing portion flows out; and a recovered developer storing portion including:

a recovery inlet which is disposed above the supply outlet in a direction of gravity, in a position displaced therefrom horizontally and within the horizontal width of the first supply storing portion, and from which recovered developer flows in, and a recovery storing portion which is provided under the recovery inlet and in which the developer flowing from the recovery inlet is stored, wherein:

the recovery storing portion is adjacent to the second supply storing portion in a direction of the horizontal width of the second supply storing portion, and the recovery inlet is disposed adjacent to a vicinity of a boundary portion between the first supply storing portion and the second supply storing portion, the second supply storing portion extends downward from one horizontal end of the first supply storing portion, the recovery storing portion extends in a vertical direction adjacent to the second supply storing portion, and a space which is formed under the second supply storing portion and horizontally adjacent to the recovery storing portion, in which constituent members of an image forming apparatus to be mounted with the developer storing vessel are disposed, and which is also capable of disposing therein a transmission system for supplying the developer stored in the developer storing vessel.

17. A developer storing vessel comprising:

a supplied developer storing portion including:

a first supply storing portion in which a developer to be supplied to a developer unit is stored;

a second supply storing portion which is provided under the first supply storing portion, which is formed with a horizontal width narrower than that of the first supply storing portion and in which the developer stored in the first supply storing portion moves; and a supply outlet from which the developer stored in the second supply storing portion flows out;

a recovered developer storing portion including:

a recovery inlet which is disposed above the supply outlet in a direction of gravity, in a position displaced therefrom horizontally and within the horizontal width of the first supply storing portion, and from which recovered developer flows in, and a recovery storing portion which is provided under the recovery inlet and in which the developer flowing from the recovery inlet is stored;

the recovery storing portion is adjacent to the second supply storing portion in a direction of the horizontal width of the second supply storing portion, and a supply path which is formed in a lower end of the second supply storing portion in the direction of gravity, and which extends in a depth direction perpendicular to the direction of gravity and a width direction;

wherein the supply outlet is formed in an end portion of the supply path in the depth direction;

a supply transport member which is disposed in the supply path and which transports the developer toward the supply outlet;

a connection path which is connected to an upstream side in a transport direction of the developer in the supply path, and which allows the developer to flow in the direction of gravity;

a connection inlet which is formed above the connection path and which allows the developer to flow into the connection path; and a connection transport member which is disposed in the second supply storing portion and transports the developer toward the connection inlet, wherein the connection transport member includes: a rotation shaft, a transport blade on the rotation shaft, an inflow control portion in a position of the rotation shaft corresponding to the connection inlet, and closing the connection inlet and restricting inflow of the developer when the rotation shaft stops to be opposed to the connection inlet.

* * * * *